US009121414B2

(12) United States Patent
Lofy et al.

(10) Patent No.: US 9,121,414 B2
(45) Date of Patent: Sep. 1, 2015

(54) LOW-PROFILE BLOWERS AND METHODS

(75) Inventors: John Lofy, Claremont, CA (US); Ryan Walsh, Los Angeles, CA (US)

(73) Assignee: GENTHERM INCORPORATED, Northville, MI (US)

( * ) Notice: Subject to any disclaimer, the term of this patent is extended or adjusted under 35 U.S.C. 154(b) by 917 days.

(21) Appl. No.: 13/289,923

(22) Filed: Nov. 4, 2011

(65) Prior Publication Data

US 2012/0114512 A1 May 10, 2012

Related U.S. Application Data

(60) Provisional application No. 61/410,823, filed on Nov. 5, 2010, provisional application No. 61/483,590, filed on May 6, 2011.

(51) Int. Cl.

| | |
|---|---|
| ***F04D 25/06*** | (2006.01) |
| ***F04D 29/42*** | (2006.01) |
| ***F04D 29/70*** | (2006.01) |

(52) U.S. Cl.

CPC ..... *F04D 29/4226* (2013.01); *F04D 25/068* (2013.01); *F04D 25/0693* (2013.01); *F04D 29/703* (2013.01)

(58) Field of Classification Search

CPC . F04D 25/068; F04D 25/0693; F04D 29/703; F04D 29/4226

USPC ..... 417/354, 423.14

See application file for complete search history.

(56) References Cited

U.S. PATENT DOCUMENTS

| | | | |
|---|---|---|---|
| 1,839,156 | A | 12/1931 | Lumpkin |
| 2,362,259 | A | 11/1944 | Findley |
| 2,363,168 | A | 11/1944 | Findley |
| 2,519,241 | A | 8/1950 | Findley |
| 2,813,708 | A | 11/1957 | Frey |
| 2,884,956 | A | 5/1959 | Perlin |

(Continued)

FOREIGN PATENT DOCUMENTS

| | | |
|---|---|---|
| CA | 0979490 | 12/1975 |
| DE | 19503291 C2 | 8/1996 |

(Continued)

OTHER PUBLICATIONS

Feher, Steve, Thermoelectric Air Conditioned Variable Temperature Seat (VTS) & Effect Upon Vehicle Occupant Comfort, Vehicle Energy Efficiency, and Vehicle Environment Compatibility, SAE Technical Paper, Apr. 1993, pp. 341-349.

(Continued)

*Primary Examiner* — Charles Freay

*Assistant Examiner* — Philip Stimpert

(74) *Attorney, Agent, or Firm* — Knobbe Martens Olson & Bear LLP

(57) ABSTRACT

A blower configured to be positioned in confined spaces and to provide ventilation of a fluid, such as temperature controlled air, is disclosed. In various embodiments, the blower is configured to have a reduced axial thickness, which can be desired in such confined spaces. In some embodiments, the blower has an integral filter, a wire channel for the routing of one or more wires, and/or an exposed backplate. In some embodiments, the blower has a snap-fit circuit board, containment system for mounting the motor, one or more vanes for directing fluid flow, shrouded impeller, and/or integrated connector.

12 Claims, 43 Drawing Sheets

(56) References Cited

U.S. PATENT DOCUMENTS 2,959,017 A 11/1960 Gilman et al.
2,984,077 A 5/1961 Gaskill
3,019,609 A 2/1962 Pietsch
3,085,405 A 4/1963 Frantti
3,136,577 A 6/1964 Richard
3,137,142 A 6/1964 Venema
3,137,523 A 6/1964 Karner
3,186,240 A 6/1965 Daubert
3,197,342 A 7/1965 Neild
3,212,275 A 10/1965 Tillman
3,253,649 A 5/1966 Laing
3,298,195 A 1/1967 Raskhodoff
3,392,535 A 7/1968 De Castelet
3,486,177 A 12/1969 Marshack
3,529,310 A 9/1970 Olmo
3,599,437 A 8/1971 Panas
3,627,299 A 12/1971 Schwartze et al.
3,640,456 A 2/1972 Sturgis
3,703,141 A 11/1972 Pernoud
3,786,230 A 1/1974 Brandenburg, Jr.
3,839,876 A 10/1974 Privas
3,876,860 A 4/1975 Nomura et al.
3,899,054 A 8/1975 Huntress et al.
3,916,151 A 10/1975 Reix
3,927,299 A 12/1975 Sturgis
4,002,108 A 1/1977 Drori
4,044,824 A 8/1977 Eskeli
4,124,794 A 11/1978 Eder
4,152,094 A * 5/1979 Honda et al. ..... 415/119
4,195,687 A 4/1980 Taziker
4,223,205 A 9/1980 Sturgis
4,224,565 A 9/1980 Sosniak et al.
4,315,599 A 2/1982 Biancardi
4,336,444 A 6/1982 Bice et al.
4,373,861 A * 2/1983 Papst et al. ..... 415/218.1
4,391,009 A 7/1983 Schild et al.
4,413,857 A 11/1983 Hayashi
4,437,702 A 3/1984 Agosta
4,491,173 A 1/1985 Demand
4,506,510 A 3/1985 Tircot
4,518,847 A 5/1985 Horst, Sr. et al.
4,549,134 A 10/1985 Weiss
4,554,968 A 11/1985 Haas
4,567,351 A 1/1986 Kitagawa et al.
4,572,430 A 2/1986 Takagi et al.
4,665,707 A 5/1987 Hamilton
4,671,567 A 6/1987 Frobose
4,685,727 A 8/1987 Cremer et al.
4,711,294 A 12/1987 Jacobs et al.
4,791,274 A 12/1988 Horst
4,806,081 A * 2/1989 Harmsen et al. ..... 417/354
4,823,554 A 4/1989 Trachtenberg et al.
4,923,248 A 5/1990 Feher
4,969,684 A 11/1990 Zarotti
4,988,847 A 1/1991 Argos et al.
5,002,336 A 3/1991 Feher
5,014,909 A 5/1991 Yasuo
5,070,937 A 12/1991 Mougin et al.
5,077,709 A 12/1991 Feher
5,088,790 A 2/1992 Wainwright et al.
5,106,161 A 4/1992 Meiller
5,111,025 A 5/1992 Barma et al.
5,111,664 A 5/1992 Yang
5,117,638 A 6/1992 Feher
5,119,640 A 6/1992 Conrad
5,148,977 A 9/1992 Hibino et al.
5,187,349 A 2/1993 Curhan et al.
5,255,735 A 10/1993 Raghava et al.
5,256,857 A 10/1993 Curhan et al.
5,278,936 A 1/1994 Shao
5,279,128 A 1/1994 Tomatsu et al.
5,375,421 A 12/1994 Hsieh
5,385,382 A 1/1995 Single, II et al.
5,409,547 A 4/1995 Watanabe et al.
5,413,166 A 5/1995 Kerner et al.
5,416,935 A 5/1995 Nieh
5,419,780 A 5/1995 Suski
5,448,891 A 9/1995 Nakagiri et al.
5,449,275 A * 9/1995 Gluszek et al. ..... 417/14
5,505,520 A 4/1996 Frusti et al.
5,524,439 A 6/1996 Gallup et al.
5,542,503 A 8/1996 Dunn et al.
5,544,487 A 8/1996 Attey et al.
5,544,488 A 8/1996 Reid
5,555,732 A 9/1996 Whiticar
5,561,981 A 10/1996 Quisenberry et al.
5,597,200 A 1/1997 Gregory et al.
5,601,399 A 2/1997 Okpara et al.
5,606,639 A 2/1997 Lehoe et al.
5,623,828 A 4/1997 Harrington
5,626,021 A 5/1997 Karunasiri et al.
5,626,386 A 5/1997 Lush
5,634,342 A 6/1997 Peeters et al.
5,645,314 A 7/1997 Liou
5,721,804 A 2/1998 Greene, III
5,729,981 A 3/1998 Markus et al.
5,798,583 A 8/1998 Morita
5,822,993 A 10/1998 Attey
5,827,424 A 10/1998 Gillis et al.
5,833,321 A 11/1998 Kim et al.
5,850,741 A 12/1998 Feher
5,884,486 A 3/1999 Hughes et al.
5,887,304 A 3/1999 Von der Heyde
5,888,261 A 3/1999 Fortune
5,902,014 A 5/1999 Dinkel et al.
5,921,100 A 7/1999 Yoshinori et al.
5,921,314 A 7/1999 Schuller et al.
5,924,766 A 7/1999 Esaki et al.
5,927,817 A 7/1999 Ekman et al.
5,934,748 A 8/1999 Faust et al.
5,937,908 A 8/1999 Inoshiri et al.
5,988,568 A 11/1999 Drews
5,992,154 A 11/1999 Kawada et al.
5,995,711 A 11/1999 Fukuoka et al.
6,003,950 A 12/1999 Larsson
6,019,420 A 2/2000 Faust et al.
6,048,024 A 4/2000 Wallman
6,049,544 A 4/2000 Kurdzo et al.
6,049,655 A 4/2000 Vazirani
6,059,018 A 5/2000 Yoshinori et al.
6,062,641 A 5/2000 Suzuki et al.
6,072,924 A 6/2000 Sato et al.
6,072,938 A 6/2000 Peterson et al.
6,073,998 A 6/2000 Siarkowski et al.
6,079,485 A 6/2000 Esaki et al.
6,084,172 A 7/2000 Kishi et al.
6,085,369 A 7/2000 Feher
6,087,638 A 7/2000 Silverbrook
6,101,815 A 8/2000 Van Oort et al.
6,116,029 A 9/2000 Krawec
6,119,463 A 9/2000 Bell
6,145,925 A 11/2000 Eksin et al.
6,158,224 A 12/2000 Hu et al.
6,164,719 A 12/2000 Rauh
6,178,292 B1 1/2001 Fukuoka et al.
6,179,706 B1 1/2001 Yoshinori et al.
6,186,592 B1 2/2001 Orizakis et al.
6,189,966 B1 2/2001 Faust et al.
6,196,627 B1 3/2001 Faust et al.
6,206,465 B1 3/2001 Faust et al.
6,213,198 B1 4/2001 Shikata et al.
6,222,243 B1 4/2001 Kishi et al.
6,223,539 B1 5/2001 Bell
6,233,959 B1 5/2001 Kang et al.
6,250,083 B1 6/2001 Chou
6,263,530 B1 7/2001 Feher
6,289,982 B1 9/2001 Naji
6,291,803 B1 9/2001 Fourrey
6,338,251 B1 1/2002 Ghoshal
6,378,311 B1 4/2002 McCordic
6,393,842 B2 5/2002 Kim et al.
6,402,470 B1 6/2002 Kvasnak et al.
6,427,449 B1 8/2002 Logan et al.
6,434,328 B2 8/2002 Rutherford

(56) References Cited

U.S. PATENT DOCUMENTS 6,470,696 B1 10/2002 Palfy et al.
6,481,801 B1 11/2002 Schmale
6,490,879 B1 12/2002 Lloyd et al.
6,509,704 B1 1/2003 Brown
6,539,725 B2 4/2003 Bell
6,541,743 B2 4/2003 Chen
RE38,128 E 6/2003 Gallup et al.
6,571,564 B2 6/2003 Upadhye et al.
6,580,025 B2 6/2003 Guy
6,598,251 B2 7/2003 Habboub et al.
6,598,405 B2 7/2003 Bell
6,604,576 B2 8/2003 Noda et al.
6,604,785 B2 8/2003 Bargheer et al.
6,606,866 B2 8/2003 Bell
6,619,736 B2 9/2003 Stowe et al.
6,625,990 B2 9/2003 Bell
6,626,488 B2 9/2003 Pfahler
6,637,210 B2 10/2003 Bell
6,644,735 B2 11/2003 Bargheer et al.
6,672,076 B2 1/2004 Bell
6,676,207 B2 1/2004 Rauh et al.
6,695,402 B2 2/2004 Sloan, Jr.
6,700,052 B2 3/2004 Bell
6,719,039 B2 4/2004 Calaman et al.
6,725,669 B2 4/2004 Melaragni
6,739,655 B1 5/2004 Schwochert et al.
6,761,399 B2 7/2004 Bargheer et al.
6,772,829 B2 8/2004 Lebrun
6,774,346 B2 8/2004 Clothier
6,786,541 B2 9/2004 Haupt et al.
6,786,545 B2 9/2004 Bargheer et al.
6,808,230 B2 10/2004 Buss et al.
6,812,395 B2 11/2004 Bell
6,817,197 B1 11/2004 Padfield
6,817,675 B2 11/2004 Buss et al.
6,828,528 B2 12/2004 Stowe et al.
6,834,509 B2 12/2004 Palfy et al.
6,841,957 B2 1/2005 Brown
6,855,880 B2 2/2005 Feher
6,857,697 B2 2/2005 Brennan et al.
6,868,690 B2 3/2005 Faqih
6,886,351 B2 5/2005 Palfy et al.
6,893,086 B2 5/2005 Bajic et al.
6,907,739 B2 6/2005 Bell
6,923,216 B2 8/2005 Extrand et al.
6,935,122 B2 8/2005 Huang
6,954,944 B2 10/2005 Feher
6,959,555 B2 11/2005 Bell
6,962,195 B2 11/2005 Smith et al.
6,963,053 B2 11/2005 Lutz
6,976,734 B2 12/2005 Stoewe
6,977,360 B2 12/2005 Weiss
7,000,490 B1 2/2006 Micheels
7,040,710 B2 5/2006 White et al.
7,052,091 B2 5/2006 Bajic et al.
7,063,163 B2 6/2006 Steele et al.
7,066,306 B2 6/2006 Gavin
7,070,232 B2 7/2006 Minegishi et al.
7,075,034 B2 7/2006 Bargheer et al.
7,082,772 B2 8/2006 Welch
7,108,319 B2 9/2006 Hartwich et al.
7,114,771 B2 10/2006 Lofy et al.
7,124,593 B2 10/2006 Feher
7,131,689 B2 11/2006 Brennan et al.
7,147,279 B2 12/2006 Bevan et al.
7,168,758 B2 1/2007 Bevan et al.
7,178,344 B2 2/2007 Bell
7,201,441 B2 4/2007 Stoewe et al.
7,213,876 B2 5/2007 Stoewe
7,220,048 B2 5/2007 Kohlgrüber et al.
7,231,772 B2 6/2007 Bell
7,246,496 B2 7/2007 Goenka et al.
7,272,936 B2 9/2007 Feher
7,273,981 B2 9/2007 Bell
7,337,615 B2 3/2008 Reidy
7,355,146 B2 4/2008 Angelis et al.
7,360,416 B2 4/2008 Manaka et al.
7,370,479 B2 5/2008 Pfannenberg
7,380,586 B2 6/2008 Gawthrop
7,425,034 B2 9/2008 Bajic et al.
7,426,835 B2 9/2008 Bell et al.
7,462,028 B2 12/2008 Cherala et al.
7,475,464 B2 1/2009 Lofy et al.
7,475,938 B2 1/2009 Stoewe et al.
7,480,950 B2 1/2009 Feher
7,506,924 B2 3/2009 Bargheer et al.
7,506,938 B2 3/2009 Brennan et al.
7,513,273 B2 4/2009 Bivin
7,581,785 B2 9/2009 Heckmann et al.
7,587,901 B2 9/2009 Petrovski
7,591,507 B2 9/2009 Giffin et al.
7,608,777 B2 10/2009 Bell et al.
7,621,594 B2 11/2009 Hartmann et al.
7,640,754 B2 1/2010 Wolas
7,665,803 B2 2/2010 Wolas
7,708,338 B2 5/2010 Wolas
RE41,765 E 9/2010 Gregory et al.
7,827,620 B2 11/2010 Feher
7,827,805 B2 11/2010 Comiskey et al.
7,862,113 B2 1/2011 Knoll
7,866,017 B2 1/2011 Knoll
7,877,827 B2 2/2011 Marquette et al.
7,937,789 B2 5/2011 Feher
7,963,594 B2 6/2011 Wolas
7,966,835 B2 6/2011 Petrovski
7,969,738 B2 6/2011 Koo
7,996,936 B2 8/2011 Marquette et al.
8,065,763 B2 11/2011 Brykalski et al.
8,104,295 B2 1/2012 Lofy
8,143,554 B2 3/2012 Lofy
8,181,290 B2 5/2012 Brykalski et al.
8,191,187 B2 6/2012 Brykalski et al.
8,222,511 B2 7/2012 Lofy
8,256,236 B2 9/2012 Lofy
8,332,975 B2 12/2012 Brykalski et al.
8,402,579 B2 3/2013 Marquette et al.
8,418,286 B2 4/2013 Brykalski et al.
8,434,314 B2 5/2013 Comiskey et al.
8,438,863 B2 5/2013 Lofy
RE44,272 E 6/2013 Bell
8,505,320 B2 8/2013 Lofy
8,516,842 B2 8/2013 Petrovski
8,539,624 B2 9/2013 Terech et al.
8,575,518 B2 11/2013 Walsh
8,621,687 B2 1/2014 Brykalski et al.
8,732,874 B2 5/2014 Brykalski et al.
8,782,830 B2 7/2014 Brykalski et al.
2001/0014212 A1 8/2001 Rutherford
2001/0028185 A1 10/2001 Stowe et al.
2002/0017102 A1 2/2002 Bell
2002/0062854 A1 5/2002 Sharp
2002/0092308 A1 7/2002 Bell
2002/0108380 A1 8/2002 Nelsen et al.
2003/0039298 A1 2/2003 Eriksson et al.
2003/0133492 A1 7/2003 Watanabe
2004/0090093 A1 5/2004 Kamiya et al.
2004/0098991 A1 5/2004 Heyes
2004/0113549 A1 6/2004 Roberts et al.
2004/0164594 A1 8/2004 Stoewe et al.
2004/0195870 A1 10/2004 Bohlender
2005/0076944 A1 4/2005 Kanatzidis et al.
2005/0078451 A1 4/2005 Sauciuc et al.
2005/0145285 A1 7/2005 Extrand
2005/0200166 A1 9/2005 Noh
2005/0220167 A1 10/2005 Kanai et al.
2005/0285438 A1 12/2005 Ishima et al.
2006/0005548 A1 1/2006 Ruckstuhl
2006/0078319 A1 4/2006 Maran
2006/0087160 A1 4/2006 Dong et al.
2006/0130490 A1 6/2006 Petrovski
2006/0137099 A1 6/2006 Feher
2006/0200398 A1 9/2006 Botton et al.
2006/0201161 A1 9/2006 Hirai et al.
2006/0201162 A1 9/2006 Hsieh

(56) References Cited

U.S. PATENT DOCUMENTS

| | | | |
|---|---|---|---|
| 2006/0214480 | A1 | 9/2006 | Terech |
| 2006/0219699 | A1 | 10/2006 | Geisel et al. |
| 2006/0225441 | A1 | 10/2006 | Goenka et al. |
| 2006/0244289 | A1 | 11/2006 | Bedro |
| 2006/0273646 | A1 | 12/2006 | Comiskey et al. |
| 2007/0017666 | A1 | 1/2007 | Goenka et al. |
| 2007/0069554 | A1 | 3/2007 | Comiskey et al. |
| 2007/0101602 | A1 | 5/2007 | Bae et al. |
| 2007/0145808 | A1 | 6/2007 | Minuth et al. |
| 2007/0157630 | A1 | 7/2007 | Kadle et al. |
| 2007/0190712 | A1 | 8/2007 | Lin et al. |
| 2007/0193279 | A1 | 8/2007 | Yoneno et al. |
| 2007/0200398 | A1 | 8/2007 | Wolas et al. |
| 2007/0204629 | A1 | 9/2007 | Lofy |
| 2007/0214956 | A1 | 9/2007 | Carlson et al. |
| 2007/0227158 | A1 | 10/2007 | Kuchimachi |
| 2007/0241592 | A1 | 10/2007 | Giffin et al. |
| 2007/0251016 | A1 | 11/2007 | Feher |
| 2007/0261412 | A1 | 11/2007 | Heine |
| 2007/0261413 | A1 | 11/2007 | Hatamian et al. |
| 2007/0262621 | A1 | 11/2007 | Dong et al. |
| 2007/0277313 | A1 | 12/2007 | Terech |
| 2008/0000025 | A1 | 1/2008 | Feher |
| 2008/0022694 | A1 | 1/2008 | Anderson et al. |
| 2008/0028768 | A1 | 2/2008 | Goenka |
| 2008/0028769 | A1 | 2/2008 | Goenka |
| 2008/0047598 | A1 | 2/2008 | Lofy |
| 2008/0084095 | A1 | 4/2008 | Wolas |
| 2008/0087316 | A1 | 4/2008 | Inaba et al. |
| 2008/0124234 | A1* | 5/2008 | Echazarreta ..... 417/423.14 |
| 2008/0148481 | A1 | 6/2008 | Brykalski et al. |
| 2008/0154518 | A1 | 6/2008 | Manaka et al. |
| 2008/0164733 | A1 | 7/2008 | Giffin |
| 2008/0166224 | A1 | 7/2008 | Giffin |
| 2008/0173022 | A1 | 7/2008 | Petrovski |
| 2008/0223841 | A1 | 9/2008 | Lofy |
| 2008/0245092 | A1 | 10/2008 | Forsberg et al. |
| 2008/0289677 | A1 | 11/2008 | Bell et al. |
| 2008/0307796 | A1 | 12/2008 | Bell et al. |
| 2009/0000031 | A1 | 1/2009 | Feher |
| 2009/0000310 | A1 | 1/2009 | Bell et al. |
| 2009/0025770 | A1 | 1/2009 | Lofy |
| 2009/0026813 | A1 | 1/2009 | Lofy |
| 2009/0033130 | A1 | 2/2009 | Marquette et al. |
| 2009/0178700 | A1 | 7/2009 | Heremans et al. |
| 2009/0193814 | A1 | 8/2009 | Lofy |
| 2009/0211619 | A1 | 8/2009 | Sharp et al. |
| 2009/0218855 | A1 | 9/2009 | Wolas |
| 2009/0235969 | A1 | 9/2009 | Heremans et al. |
| 2009/0269584 | A1 | 10/2009 | Bell et al. |
| 2009/0293488 | A1 | 12/2009 | Coughlan, III et al. |
| 2010/0001558 | A1 | 1/2010 | Petrovski |
| 2010/0011502 | A1 | 1/2010 | Brykalski et al. |
| 2010/0154911 | A1 | 6/2010 | Yoskowitz |
| 2010/0193498 | A1 | 8/2010 | Walsh |
| 2011/0048033 | A1 | 3/2011 | Comiskey et al. |
| 2011/0115635 | A1 | 5/2011 | Petrovski et al. |
| 2011/0253340 | A1 | 10/2011 | Petrovski |
| 2011/0271994 | A1 | 11/2011 | Gilley |
| 2011/0296611 | A1 | 12/2011 | Marquette et al. |
| 2012/0080911 | A1 | 4/2012 | Brykalski et al. |
| 2012/0104000 | A1 | 5/2012 | Lofy |
| 2012/0131748 | A1 | 5/2012 | Brykalski et al. |
| 2012/0261399 | A1 | 10/2012 | Lofy |
| 2013/0086923 | A1 | 4/2013 | Petrovski et al. |
| 2013/0097776 | A1 | 4/2013 | Brykalski et al. |
| 2013/0097777 | A1 | 4/2013 | Marquette et al. |
| 2013/0198954 | A1 | 8/2013 | Brykalski et al. |
| 2013/0206852 | A1 | 8/2013 | Brykalski et al. |
| 2013/0227783 | A1 | 9/2013 | Brykalski et al. |
| 2013/0239592 | A1 | 9/2013 | Lofy |
| 2013/0269106 | A1 | 10/2013 | Brykalski et al. |
| 2014/0007594 | A1 | 1/2014 | Lofy |
| 2014/0026320 | A1 | 1/2014 | Marquette et al. |
| 2014/0062392 | A1 | 3/2014 | Lofy et al. |
| 2014/0090829 | A1 | 4/2014 | Petrovski |
| 2014/0130516 | A1 | 5/2014 | Lofy |
| 2014/0131343 | A1 | 5/2014 | Walsh |
| 2014/0305625 | A1 | 10/2014 | Petrovski |

FOREIGN PATENT DOCUMENTS

| | | | |
|---|---|---|---|
| DE | 19912764 | | 9/2000 |
| DE | 29911519 | U1 | 11/2000 |
| DE | 10238552 | | 8/2001 |
| DE | 10115242 | | 10/2002 |
| DE | 20120516 | U1 | 4/2003 |
| EP | 0 411 375 | B1 | 5/1994 |
| EP | 0 834 421 | | 4/1998 |
| JP | 60-080044 | | 5/1985 |
| JP | 60-85297 | | 5/1985 |
| JP | 01-281344 | | 11/1989 |
| JP | 04-165234 | | 6/1992 |
| JP | 05-026762 | | 2/1993 |
| JP | 05-277020 | | 10/1993 |
| JP | 09-505497 | | 6/1997 |
| JP | 10-504977 | | 5/1998 |
| JP | 10-297243 | | 11/1998 |
| JP | 2001-174028 | | 6/2001 |
| JP | 2001-208405 | | 8/2001 |
| JP | 2002-227798 | | 8/2002 |
| JP | 2006-001392 | | 1/2006 |
| JP | 2006-076398 | | 3/2006 |
| KR | 10-20010060500 | | 7/2001 |
| LU | 66619 | | 2/1973 |
| WO | WO 94/20801 | | 9/1994 |
| WO | WO 95/14899 | | 6/1995 |
| WO | WO 95/31688 | | 11/1995 |
| WO | WO 96/05475 | | 2/1996 |
| WO | WO 99/58907 | A1 | 11/1999 |
| WO | WO 02/11968 | | 2/2002 |
| WO | WO 02/053400 | A2 | 7/2002 |
| WO | WO 03/014634 | | 2/2003 |
| WO | WO 03/051666 | | 6/2003 |
| WO | WO 2004/011861 | A1 | 2/2004 |
| WO | WO 2005/115794 | A2 | 12/2005 |
| WO | WO 2006/078394 | A1 | 7/2006 |
| WO | WO 2008/045964 | A2 | 4/2008 |
| WO | WO 2008/076588 | A2 | 6/2008 |
| WO | WO 2008/115831 | A1 | 9/2008 |
| WO | WO 2009/015235 | A1 | 1/2009 |
| WO | WO 2009/097572 | A1 | 8/2009 |
| WO | WO 2010/009422 | A1 | 1/2010 |
| WO | WO 2010/088405 | A1 | 8/2010 |
| WO | WO 2012/061777 | A2 | 5/2012 |
| WO | WO 2013/052823 | A1 | 4/2013 |

OTHER PUBLICATIONS

Lofy, J. et al., Thermoelectrics for Environmental Control in Automobiles, Proceeding of Twenty-First International Conference on Thermoelectrics (ICT 2002), published 2002, pp. 471-476.

Photographs and a description of two different components of a climate control seat assembly system sold prior to Dec. 20, 2003.

Photographs and a description of a component of a climate control seat assembly system sold prior to Dec. 20, 2003.

May 24, 2010 W.E.T.'s Answer, Affirmative Defenses, and Counterclaims to Amerigon's Complaint for Patent Infringement.

Jun. 17, 2010 Amerigon's Inc.'s Answer to W.E.T. Automotive Systems Limited's counterclaims.

Jun. 17, 2010 Defendant Amerigon's Motion to Dismiss Count VII of Plaintiff W.E.T. Automotive Systems, Ltd.'s Counterclaims.

Jul. 8, 2010 W.E.T.'s Answer, Affirmative Defenses, and Counterclaims to Amerigon's (Corrected) Amended Answer and Counterclaims for Patent Infringement.

Jul. 16, 2010 W.E.T.'s Answer, Affirmative Defenses, and First Amended Counterclaims (Count VII) to Amerigon's (Corrected) Amended Answer and Counterclaims for Patent Infringement at D/E 19.

Jul. 16, 2010 W.E.T.'s Opposition to Amerigon's Motion to Dismiss W.E.T.'s Inequitable Conduct Counterclaim.

(56) References Cited

OTHER PUBLICATIONS

Aug. 2, 2010 Amerigon's Inc.'s Answer to W.E.T. Automotive Systems Limited's Amended Counterclaims.
Aug. 2, 2010 Defendant Amerigon Inc.'s Motion to Dismiss Amended Count VII of Plaintiff W.E.T. Automotive Systems Ltd.'s Amended Counterclaims.
Aug. 16, 2010 Plaintiff W.E.T.'s Responses to Defendant Amerigon Inc.'s First Set of Interrogatories (Nos. 1-5).
Aug. 24, 2010 W.E.T.'s Opposition to Amerigon's Motion to Dismiss Amended Count VII of Plaintiff W.E.T. Automotive Systems Ltd.'s Amended Counterclaims.
Aug. 27, 2010 Counterclaimant Amerigon Inc.'s Supplemental Answers to Counterclaim Defendant W.E.T.'s First Set of Interrogatories (Nos. 14-15).
Aug. 31, 2010 Defendant Amerigon Inc.'s Reply Brief in Support of Motion to Dismiss Amended Count VII of Plaintiff W.E.T. Automotive Systems' Amended Counterclaims.
Sep. 24, 2010 Amerigon Inc. and Feher Design, Inc.'s Preliminary Proposed Claim Constructions.
Sep. 24, 2010 W.E.T.'s Proposed Definitions.
Oct. 8, 2010 Plaintiff W.E.T.'s Supplemental Responses to Defendant Amerigon Inc.'s Interrogatories Nos. 1-5.
Oct. 8, 2010 Amerigon Inc.'s Supplemental Answers to Interrogatory Nos. 1-5, 9-13, 15 of W.E.T.'s First Set of Interrogatories (Nos. 1-17).
Nov. 11, 2010 W.E.T.'s Motion to Bifurcate and Stay.
Nov. 12, 2010 W.E.T.'s Motion for Summary Judgment of Inequitable Conduct.
Dec. 16, 2010 Amerigon Inc.'s Notice of Conditional Withdrawal of Motion to Dismiss Amended Count VII of W.E.T. Automotive Systems Ltd.'s Amended Counterclaims.
International Search Report in related International Application No. PCT/US2011/059450, mailed May 10, 2012, in 29 pages.
International Preliminary Report on Patentability in related International Application No. PCT/US2011/059450, issued May 8, 2013, in 14 pages.
Photographs and accompanying description of climate control seat assembly system components publicly disclosed as early as Jan. 1998.

* cited by examiner

LOW-PROFILE BLOWERS AND METHODS

CROSS-REFERENCE TO RELATED APPLICATIONS

This application claims the priority benefit under 35 U.S.C. §119(e) of U.S. Provisional Application No. 61/410,823, filed Nov. 5, 2010, and U.S. Provisional Application No. 61/483,590, filed May 6, 2011, the entirety of each of which is hereby incorporated by reference.

BACKGROUND

1. Field

The present application relates generally to ventilation devices. More particularly, some embodiments relate to a blower that is particularly useful for providing a flow of temperature-controlled air in confined spaces, such as seats (e.g., vehicle seats, wheelchair seats, and other seating assemblies), beds, and other occupant support assemblies.

2. Description of the Related Art

Certain modern seats, such as some automobile seats, are equipped with ventilation systems that supply air to, or receive air from, a portion of the seat. Some such seats also include temperature control systems that allow the occupant to vary the temperature of the seat by flowing temperature-controlled air through the seat covering. One such system comprises a seat having a fan unit and a thermoelectric element mounted therein. The thermoelectric element is configured to heat or cool air that is moved over the element by the fan unit, which is also mounted within the seat. The conditioned air is distributed to the occupant by passing the air through the seat surface via a series of air ducts within the seat. In another system, air is fed into the ventilation and/or temperature control system via the ducts within the seat.

In many instances, the amount of space available within, below, and around the seat for such ventilation and/or temperature control systems is severely limited. For example, in some cars, to save weight or increase passenger room, the seats are only a few inches thick and abut the adjacent structure of the car, such as the floorboard or the back of the car. Further, automobile manufacturers are increasingly mounting various devices, such as electronic components or variable lumbar supports, within, below, and around the seat. Additionally, the size of the seat, particularly the seat back, needs to be as small as possible to reduce the amount of cabin space consumed by the seat.

Certain conventional ventilation and/or temperature control systems are too large to be mounted within, below, or around vehicle seats. For example, some systems may have a housing containing a squirrel-cage fan five or six inches in diameter and over two inches thick. The fan generates an air flow that passes through a duct to reach a heat exchanger that is several inches wide and long and at least an inch or so thick. From the heat exchanger, the air is transported through ducts to the bottom of the seat cushion and to the seat cushion back. Such systems are bulky and difficult to fit underneath or inside car seats. Furthermore, such a large fan to can generate more noise, which is generally undesirable, and is especially undesirable inside the closed space of a motor vehicle.

In light of at least these drawbacks, there is a need for a more compact ventilation blower for automobile seats, wheelchair seats, other vehicle seats, beds, and other occupant support assemblies.

SUMMARY

Several variations and/or combinations of an improved blower are disclosed. In various embodiments, the blower has a low-profile (e.g., reduced axial thickness) configuration. Some embodiments have an integrated filter configured to inhibit contaminants from entering the blower. In certain embodiments, the blower has impeller blades having a reduced thickness, which can reduce noise and/or turbulence. Moreover, certain embodiments have a wire channel configured to route wires therethough, which can reduce the axial thickness of the blower. In some embodiments, the blower has an exposed backplate, thereby enhancing the heat transfer between the blower and the surrounding environment. The blower can include a circuit board on which the electronic components are arranged at least partly on their height. In some embodiments, the blower has a motor base configured to reduce the axial thickness of the blower. Certain embodiments include vanes configured to direct a fluid flow to enhance the operation of a thermoelectric device. Furthermore, the blower can have a circuit board that is snap-fit into the blower. In certain embodiments, the blower has a sweeping impeller, which is configured to reduce noise and/or turbulence. In some embodiments, the blower has a humidity sensor. Moreover, some embodiments include one or more vanes that are configured to provide a substantially uniform flow velocity distribution at a blower outlet. Certain embodiments have a protection member that is configured to inhibit wires from contacting the impeller. In certain embodiments, the blower includes a shroud which covers portions of the impeller, thereby reducing friction between fluid entering the blower and the impeller. Furthermore, the blower can include a connector joined or integrated with a blower housing.

In some embodiments, a low-profile blower includes a housing defining an interior space. The housing can include an inlet and an outlet. The housing can have a first side and a second side joined by a sidewall. An electric motor assembly can be disposed within the interior space. The motor assembly can comprise a backplate, which can be coupled to the housing. An impeller having a plurality of blades can be coupled with the motor assembly. The motor assembly can be configured to selectively rotate the impeller. The impeller can be configured to draw a fluid into the interior space of the housing via the inlet and to discharge the fluid from the interior space via the outlet. The blower can be configured such that the fluid proceeds through a portion of the interior space with a non-uniform velocity. The portion can be in communication with the outlet. A filter can be disposed at least partly in the inlet such that at least some of the fluid passes through the filter. A circuit board can be positioned in the interior space and below the impeller. The circuit board can have an outer periphery and a plurality of electronic components coupled to the circuit board. The blades can be axially disposed generally (e.g., completely, substantially, a majority, or partially) above the circuit board by an axial distance (e.g., spaced apart from the circuit board by the axial distance). The blades can be disposed at least partly within the outer periphery by a radial distance. At least one conductor (e.g., wire, trace, cable, or otherwise) can be configured to supply electric power to the electric motor assembly. The least one conductor can extend from outside the housing into the interior space. At least one channel can be formed in the housing. The at least one channel can extend at least partly between the sidewall and the circuit board. Further, the at least one channel can be configured to at least partly receive the at least one conductor. Additionally, the channel can be configured to axially fully receive the conductor. In some embodiments, the at least one wire does not axially protrude into the interior space. For example, in some embodiments the at least one conductor does not axially project into the interior space beyond an inner surface of the housing.

In some embodiments, the filter comprises a mesh. In some embodiments, the filter generally inhibits or prevents the passage of contaminants that are at least about 0.1 mm, 0.5 mm, 1 mm, 3 mm, 5 mm, and/or greater than 5 mm in size (e.g., diameter, cross-sectional dimension, etc.). In certain embodiments, the filter has a mesh size of about 0.05-3.0 mm (e.g., 0.05 mm, 0.1 mm, 0.5 mm, 1.0 mm, 1.5 mm, 2.0 mm, 2.5 mm, 3.0 mm, values between such ranges, etc.), less than 0.05 mm (0.01 mm, 0.02 mm, 0.03 mm, 0.04 mm, etc.), or greater than 3 mm, as desired or required. In certain embodiments, the filter is integrated (e.g., unitarily formed with, permanently joined with, molded as a part of, or otherwise configured so as not to be separated during normal use) with the housing. In some instances, the filter is formed of the same material as the housing. In some embodiments, some of the housing is located in voids in the filter. For example, in certain embodiments, at least a portion of the housing material is disposed in the filter (e.g., flowed into voids in the mesh during forming). In certain configurations, the filter is axially thinner than the housing. In some arrangements, an exterior surface of the filter is substantially flush with an exterior surface of the housing. In other arrangements, an exterior surface of the filter is axially recessed from an exterior surface of the housing. In some variants, at least one rib at least partly spans the inlet. The at least one rib can be configured to support the filter. In some embodiments, the filter is molded with the housing. In some embodiments, the blower also includes a humidity sensor or a moisture sensor. In certain such embodiments, the sensor is positioned at or near the inlet.

In some embodiments, the channel comprises a void in the housing. In some instances, at least a portion of the channel is covered with a cover member. In some such arrangements, an exterior surface of the housing comprises a recess. The recess can be configured to receive the cover member such that a surface of the cover member is generally flush with the exterior surface of the housing.

In some embodiments, the backplate of the motor assembly is connected with the housing via a snap fit, and the backplate forms a part of an exterior of the blower. In certain variants, the housing further comprises an aperture configured to at least partly receive the backplate. In some arrangements, the backplate is fastened to the housing with one or more fasteners (e.g., screws, rivets, or the like).

In certain configurations, during operation, the motor assembly produces heat, and at least a portion of the heat is dissipated to the surrounding environment via the backplate. In some such instances, the backplate is coupled to the circuit board. In certain embodiments, at least a portion of the back plate is open to the surrounding environment. In some such instances, during operation, the circuit board produces heat, and at least a portion of the heat is dissipated to the surrounding environment via the backplate.

Typically, some or all of the electronic components of the circuit board has an axial height above the circuit board. In some instances, impeller also has a central hub having a radial extent. In certain such cases, at least one of the electronic components has an axial height above the circuit board of at least 1.0 mm (e.g., 0.25 mm, 0.5 mm, 0.75 mm, 1.0 mm, values between such ranges, etc.). The at least one of the electronic components can be positioned within the radial extent of the impeller hub. In some variants, the electronic components with an axial height above the circuit board of at least 1.0 mm (e.g., 0.25 mm, 0.5 mm, 0.75 mm, 1.0 mm, values between such ranges, etc.) are positioned radially outward of the blades of the impeller. In some embodiments, at least one of the electrical components is a humidity sensor or a moisture sensor.

In certain embodiments, the fluid proceeds through a portion of the interior space with a non-uniform velocity, the portion being in communication with the outlet. The blower can also include a vane or vanes positioned in the portion. The vane or vanes can be configured to direct at least a portion of the fluid, thereby promoting a substantially uniform fluid velocity across the length (e.g., laterally) of the outlet. In some embodiments, the vane comprises a plurality of pins. In certain instances, the pins together form an overall shape similar to a continuous vane. In some embodiments, the pins axially extend from one side of the housing to the other, thereby providing support against collapse of the housing.

In some embodiments, a low noise blower includes a housing, which defines an interior space and includes an inlet and an outlet. The housing can also include a first side and a second side joined a sidewall. An electric motor assembly can be located within the interior space. An impeller can have a central hub portion and a plurality of blades. The impeller can be coupled with the motor assembly. The motor assembly can be configured to selectively rotate the impeller. The impeller can be configured to draw a fluid into the interior space of the housing via the inlet and to discharge the fluid from the interior space via the outlet. The blower can be configured such that the fluid proceeds through a portion of the interior space with a non-uniform velocity. The portion can be in communication with the outlet. A filter can be disposed at least partly in the inlet such that at least some of the fluid passes through the filter. A circuit board can be positioned in the interior space and below the impeller. The circuit board can include a plurality of electronic components. The blower can also include at least one wire, which can be configured to supply electric power to the electric motor assembly. The least one wire can extend from outside the housing into the interior space. Furthermore, when the fluid is air, the blower can be capable of discharging an airflow of at least 15 standard cubic feet per minute via the outlet. Moreover, in some embodiments, at an airflow rate of about 5 standard cubic feet per minute, the noise generated by the low noise blower is no more than about 47 dBA. In certain embodiments, the noise generated by the low noise blower is measured at a distance of about 200 mm from the inlet. In some embodiments, the outlet of the blower is generally open to the surrounding environment (e.g., not connected to any downstream conduits). In other embodiments, the outlet of the blower is connected with a conduit in communication with a TED. In certain embodiments, at an airflow rate of about 10 standard cubic feet per minute, the noise generated by the low noise blower is no more than about 64 dBA. In some embodiments, the noise generated by the low noise blower is at least about 8% (e.g., 8.0%, 8.5%, 9.0%, 9.5% 10%, 11%, 12%, values between such ranges, etc.) quieter than prior art blowers.

In certain embodiments, the filter is integrated with the housing. For example, the filter can be molded with the housing (e.g., formed during the same molding operation). In some embodiments, the impeller has an axial centerline (e.g., the axis of rotation of the impeller) and the filter has an axial centerline as well. In certain configurations, the filter is disposed such that the axial centerline of the filter is offset from the axial centerline of the impeller. In some cases, the axial centerline of the filter is not collinear with the axial centerline of the impeller. In some embodiments, the blower includes a backplate. The backplate can be coupled to the circuit board and/or the motor. In some configurations, the backplate is open to the surrounding environment. Such a configuration can, for example, facilitate heat transfer from the blower to the surrounding environment via the backplate, which in turn can allow the blower to be run at a greater speed, higher power level, or the like, while maintaining the blower at or below an acceptable temperature limit. In some embodiments, the additional heat transfer via the backplate can allow the blower to operate at a cooler temperature, which can, for example, increase life expectancy for the blower. In some embodiments, the blower includes a plurality of outlets. In certain embodiments, the blower includes a plurality of inlets. In certain instances, the blower comprises layers or a coating of material. For example, in some embodiments, the blower includes polypropylene layered or otherwise deposited on polycarbonate. Such layered configurations can, for example, reduce resonance of the blower, which in turn can reduce noise and/or vibration. Certain embodiments of the blower include layers (e.g., polypropylene layered or otherwise deposited on polycarbonate) to shift or modify the natural frequency of the blower (e.g., so that the blower does not substantially generate vibrations at its own natural frequency).

In certain embodiments, the blower includes a channel formed in the housing. The channel can be configured to receive the at least one wire, thereby positioning the at least one wire outside of the airflow. Such a configuration can, for example, reduce backpressure and/or turbulence in the airflow, and thus reduce noise. In some variants, the channel comprises a void in the housing. In some embodiments, the circuit board further comprises an outer periphery. In some such instances, the electronic components having an axial height above the circuit board of at least 1.0 mm (e.g., 0.25 mm, 0.5 mm, 0.75 mm, 1.0 mm, values between such ranges, etc.) are positioned within the central hub portion of the impeller. Such a configuration can, for example, reduce backpressure and/or turbulence in the airflow, and thus reduce noise.

In certain embodiments, the blower includes a vane. The vane can be positioned to direct at least a portion of the airflow. In certain such instances, the vane thus promotes a substantially uniform air velocity across the length of the outlet. Such a configuration can, for example, decrease the level of noise generated by the blower. In certain instances, the vane comprises pins configured to direct the airflow yet allow a portion of the airflow to pass between the pins.

In some embodiments, a blower includes a housing having a first side and a second side and defining an interior space. In some arrangements, the housing also has an inlet and an outlet. The inlet can define a periphery. The blower can also include a motor positioned within the interior space of the housing. Further, the blower can have an impeller positioned within the interior space. The impeller can have an axial centerline and a plurality of blades and can be configured to rotate about the axial centerline by the motor. When in use, the impeller can draw a fluid into the interior space via the inlet and encourage the fluid out of the interior space via the outlet. Additionally, the blower can include a filter at least partially covering the inlet. The filter can be configured to inhibit at least some contaminants from passing into the interior space. Also, the filter can be integrated into the housing at least at a portion of the periphery of the inlet.

In some embodiments, the blower also includes at least one rib. In some variants, the rib fully spans the inlet. In other variants, the rib only partially spans the inlet. In some arrangements, the rib provides support and/or reinforcement for the filter. For example, the filter can be integrated with the rib. In some embodiments, the ribs are about equally spaced apart from each other at the periphery of the inlet. In other embodiments, the ribs are unequally radially spaced apart from each other at the periphery of the inlet.

In certain embodiments, an axial centerline of the impeller is collinear with an axial centerline of the filter. In some arrangements, the filter is made of a mesh. For example, the mesh can have a size (e.g., the distance between adjacent parallel strands of the mesh) of about 1 mm. In other embodiments, the filter is adapted to generally inhibit or prevent the passage of contaminants that are at least about 0.1 mm, 0.5 mm, 1 mm, 3 mm, 5 mm, and/or greater than 5 mm in size (e.g., diameter, cross-sectional dimension, etc.). In some embodiments, the filter is plastic. In other instances, the filter is metal, a natural material, synthetic material, foam, fiberglass, ceramic, or otherwise. In certain variants, the filter is made of the same material as the housing. In some embodiments, the filter and the housing are integrated, such as being molded together (e.g., formed during the same molding operation). In other embodiments, the filter and the housing are integrated by glue. In some embodiments, the first side and the second side cooperate to form the outlet.

In certain embodiments, a low-profile blower has a housing defining an interior space, which can include an inlet and an outlet. The housing can also include a first side and a second side joined by a sidewall. The blower can also have an electric motor disposed in the interior space and an impeller with a plurality of blades. The impeller can be coupled with the motor so as to be rotated by the motor. Also, the impeller can be configured to draw a fluid into the housing via the inlet and to discharge the fluid from the housing via the outlet. Some variants of the blower further include at least one conductor (e.g. wire). The conductor can be configured to supply electric power to the motor. Additionally, the blower can have a channel formed in the housing. The channel can be disposed between the sidewall and the motor in a radial direction. Also, the channel can be configured to at least partly receive the at least one conductor. Some embodiments of the blower further include a first retaining member and a second retaining member. The first and second retaining members can be configured to direct the at least one conductor at least partly in an axial direction, thereby maintaining the at least one conductor an axial distance apart from the impeller.

In some embodiments, the channel comprises a gap in the housing. In some arrangements, the gap extends fully through housing in an axial direction, e.g., the gap can be a void in the housing. In certain variants, the channel is formed fully through one of the first and second sides of the housing. In other embodiments, the gap extends only partially through the housing.

In certain embodiments, the first retaining member is a bridge and the second retaining member is an arm. The second retaining member can be positioned, for example, outside or inside the housing (e.g., across or otherwise spanning the channel). In some embodiments, at least one of the first and second retaining members further comprises one or more separation members. The separation members can be configured to, for example, separate elongate conductors from each other. In certain variants, at least a portion of the channel is covered with a cover member along an exterior of the housing. Indeed, in some embodiments, the exterior of the housing at the location of the channel further comprises a recess configured to receive the cover member so that the exterior of the cover member is generally flush with the exterior of the housing.

In some embodiments, a low-profile blower includes a housing, which defines an inlet and an outlet. The housing can also have a mounting aperture and an outer face. The blower can further include a shaft rotated about an axis by a motor. An impeller can be coupled with the shaft such that rotation of the shaft by the motor in turn rotates the impeller, thereby drawing a fluid into the housing through the inlet and discharging the fluid through the outlet. Also, the blower can include a backplate having an inside face and an outside face. The backplate can be positioned at least partially in the mounting aperture. Furthermore, the blower can have a containment system including a hollow member and a cap. Certain instances of the hollow member penetrate the backplate and are coupled with the backplate. Certain instances of the cap are coupled with the hollow member and recessed from a topmost side of the hollow member. In some arrangements, the topmost side of the hollow member is about coplanar with the outer face of the housing. Moreover, in certain embodiments, the containment system inhibits the shaft from moving along the axis in at least one direction. Furthermore, in some embodiments, the motor is at least partially positioned within the housing. In certain variants, at least part of the hollow member is brass. In some cases, the containment system also includes a retaining ring.

In certain embodiments, a blower apparatus includes a housing having a first side and a second side, and an inlet and an outlet. The blower apparatus can also include an impeller positioned in the housing. The impeller can be rotatable by a motor so as to draw a fluid into the housing via the inlet and to discharge the fluid from the housing via the outlet. The blower apparatus can further have a circuit board positioned below the impeller. The circuit board can include a plurality of electronic components disposed within a board periphery. Each electronic component can have an axial height above the circuit board. Additionally, the impeller can include a central yoke and a plurality of blades. The blades can be axially disposed above the printed circuit board by an axial distance and can be radially disposed at least partly within the board periphery. Further, the electronic components can be arranged on the circuit board based on height. For example, the electronic components having a height greater than the axial distance that the blades are disposed above the printed circuit board can be disposed under the central yoke. In other embodiments, the electronic components having a height greater than about 1.0 mm are disposed radially outward of the impeller blades.

In some embodiments, a blower with increased heat transfer includes a housing having an upper surface and a lower surface. The upper and lower surfaces can be joined by a sidewall. The housing can also have at least one inlet and at least one outlet and can define an interior space. Further, the blower can include an impeller positioned within the interior space to facilitate a fluid flow through the at least one outlet. A motor can be positioned within the interior space. The motor can have a backplate positioned adjacent to the lower surface of the housing. Moreover, the blower can include an aperture along the lower surface of the housing. The aperture can expose at least a portion of the backplate to the surrounding environment. Further, at least a portion of the heat produced by the motor can be convected from the backplate to the surrounding environment.

In certain embodiments, the aperture comprises a plurality of apertures. For example, the blower can have one, two, three, four, five, or more apertures. In some embodiments, the backplate spans substantially the entire aperture. For example, substantially no area of the aperture can be left uncovered by the backplate. In some instances, the backplate is aluminum or steel. In some variants, the backplate is about 0.03-0.30 mm thick. Some embodiments of the backplate are coupled to a printed circuit board.

In some embodiments, a blower with a snap-fit motor assembly includes a housing with an inlet and an outlet. The housing can also have a first side and a second side joined by a sidewall. The second side can include a first mounting member and a second mounting member. A mounting aperture can be defined in the housing. A motor assembly can be configured to mount at least partly within the mounting aperture. Further, the blower can include an impeller rotated by the motor assembly. The impeller can be configured to draw a fluid into the housing via the inlet and to discharge the fluid from the housing via the outlet. During mounting of the motor assembly in the mounting aperture, the motor assembly can abut against the first mounting member. Also, during mounting of the motor assembly in the mounting aperture, the motor assembly can deflect the second mounting member toward the sidewall. Furthermore, at least one of the first and second mounting members can inhibit removal of the motor assembly from the mounting aperture.

In some embodiments, the first mounting member comprises a ledge. In certain embodiments, the second mounting member comprises a strut and a hook. The motor assembly comprises a motor and a circuit board. In some arrangements, the mounting aperture further defines a centerline passing through the second mounting member, and the axial dimension of the second mounting member is greater than the radial dimension of the second mounting member at the centerline. In certain such arrangements, the axial dimension of the second mounting member decreases and the radial dimension of the second mounting member increases as a function of distance from the centerline. In certain variants, the housing also has one or more guide features and the motor assembly also has one or more corresponding recesses to receive the guide features.

In certain embodiments, a blower for transferring heat to or from a seating surface has a housing that defines an interior space and includes a first side and a second side. The housing can also include an inlet duct and an outlet duct. Some instances of the housing are blow-molded. Also, a motor can be positioned within the interior space. An impeller can be positioned within the interior space of the housing as well. The impeller can have a plurality of blades and can be rotatable by the motor to encourage fluid flow through the outlet. A thermoelectric device can be positioned within the fluid flow. Furthermore, one or more vanes can be disposed in the outlet duct of the housing. In some arrangements, one or more of the vanes can facilitate a substantially equal distribution of fluid across the thermoelectric device.

In some embodiments, a blower housing includes a housing that defines an interior space and has an inlet, an outlet, a first side, and a second side. A motor can be positioned within the interior space of the housing. Also, an impeller can be positioned within the interior space. The impeller can have an axial centerline and a plurality of blades. The impeller can be configured to rotate about the axial centerline by the motor to draw a fluid flow through the inlet and encourage the fluid flow out of the outlet. The first side can have a first sidewall, and the second side can have a second sidewall. The first sidewall and the second sidewall can be coupled to form the housing. At least one of the sidewalls can be made of a first and a second substrate. In some embodiments, the first substrate is harder, denser, and/or less subject to plastic deformation than the second substrate. In certain arrangements, the second substrate is deformed when the first sidewall and the second sidewall are coupled, thereby inhibiting the fluid flow from escaping between the first sidewall and the second sidewall.

In certain embodiments, a method of manufacturing a blower housing includes injecting a first substrate into an injection mold and molding the first substrate into a first side having a sidewall. The method can also include injecting a second substrate into the injection mold. Furthermore, the method can include molding the second substrate onto the sidewall. In some embodiments, the first substrate has a higher hardness than the second substrate. Moreover, the method can include coupling the first side to a second side to form the housing. In some such cases, the coupling deforms the second substrate.

In some embodiments, a blower includes a housing defining an inner space and having a base and a sidewall. The housing can also define an inlet and an outlet. The sidewall can define a transition portion with a first longitudinal axis. A motor can be disposed in the inner space. Further, an impeller can be rotatable by the motor, thereby encouraging a fluid flow through the inlet and the outlet of the housing. The impeller can have an arm portion and a plurality of blades. The arm portion can define an end and a second longitudinal axis. The arm portion and the sidewall can be separated by a gap. In some variants, the first longitudinal axis and the second longitudinal axis are generally aligned with one another across the gap. Additionally, a slope of the first axis can be substantially similar to a slope of the second axis near a location where the arm portion is near the housing. In certain embodiments, the angles of the first longitudinal axis and the second longitudinal axis are within 0-10° of each other. In some variants, the arm portion is curved or straight. In some instances, the distance between the end and the transition portion is less than about 5.0 mm.

In some embodiments, a blower includes a housing defining an inner space and including a first surface and a second surface. The first surface can at least partly define an inlet and the second surface can at least partly define an outlet. The first and second surfaces can be joined by a sidewall. A motor can be disposed in the inner space. An impeller can be rotatable by the motor. The impeller can be configured to draw a fluid into the housing via the inlet, encourage the fluid into a space in communication with the outlet, and discharge the fluid from the housing via the outlet. The fluid can include a first portion and a second portion. In certain arrangements, the second portion of the fluid is closer to the sidewall than the first portion of the fluid. Likewise, in certain arrangements, the second portion of the fluid can have a greater velocity than the first portion of the fluid. The blower can also include a vane disposed in the inner space. The vane can be configured to direct some of the second portion of the fluid toward the first portion of the fluid, thereby promoting a substantially uniform velocity of the first and second flows at the outlet. In some embodiments, the blower includes a plurality of vanes. In certain variants, in the direction of the flow of the fluid, the vane is curved away from the sidewall. Also, in some arrangements, the vane comprises a plurality of pins. For example, the pins can be spaced-apart elongate members.

In some embodiments, a blower includes a housing defining a cavity, the housing having a first side and a second side, and an inlet and an outlet. A motor can be disposed in the cavity. An impeller can be connected with the motor such that the motor can rotate the impeller. The impeller can be configured to draw a fluid into the housing via the inlet and to discharge the fluid via the outlet. The impeller can comprise an upper portion in proximity (e.g., near, adjacent to, immediately adjacent to, or otherwise) to the inlet and a plurality of blades. A shroud can be connected with the housing. The shroud can substantially cover the upper portion of the impeller. The shroud can be configured to inhibit the fluid from contacting the upper portion of the impeller, thereby reducing friction between the fluid and the impeller. In some embodiments, an exterior surface of the shroud is substantially flush with an exterior surface of the housing. In other arrangements, an exterior surface of the shroud is axially recessed from an exterior surface of the housing. In certain embodiments, the shroud is integrated with the one or more ribs. In some embodiments, the shroud is located axially external of a filter.

In certain arrangements, the impeller further comprises an annular side portion. In some such instances, the shroud substantially covers the side portion and is configured to inhibit the fluid from contacting the side portion. In some embodiments, the impeller also has a lower disk shaped portion. In some such instances, the shroud substantially covers the lower portion and is configured to inhibit the fluid from contacting the lower portion.

In some embodiments, a blower includes a body defining a cavity, the body having a first side, a second side, an inlet, and an outlet. A motor can be disposed in the cavity. The motor can have a shaft. An impeller can be disposed in the cavity. The impeller can have a plurality of blades. The impeller can be coupled with the shaft such that rotation of the shaft rotates the impeller. Furthermore, the impeller can be configured to draw a fluid into the housing via the inlet and to discharge the fluid via the outlet. A plurality of conductors can be in electrical communication with the motor. A cover can be joined with the first side. A connector can be joined with the second side. The connector can include an open top configured to receive the cover. The connector can at least partly enclose at least a portion of the conductors.

In certain embodiments, the connector is unitarily formed with the second side. In some embodiments, the conductors are received in grooves in the body. In certain embodiments, at least one of the conductors comprises a tab and the connector comprises at least one recess. The at least one recess can be configured to receive the tab and inhibit movement of the conductors when the connector is mated with another connector.

In some embodiments, a blower includes a housing defining an inner chamber, comprising a first side, a second side, an inlet, and an outlet. The second side can have an axial thickness. A motor can be disposed in the inner chamber. An impeller can be coupled with the motor such that the motor can rotate the impeller within the housing. The impeller can be configured to encourage a flow of fluid into the housing via the inlet and out of the housing via the outlet. A conductor can be configured to transmit electrical power to the motor. The conductor can be configured to connect with a mating conductor. A groove can extend in a radial direction and be substantially continuous. The groove can at least partly penetrate the axial thickness of the second side of the housing. Furthermore, the groove can be configured to receive the conductor and to inhibit removal of the conductor from the groove.

In certain embodiments, the groove fully penetrates the axial thickness of the second side. In some embodiments, the conductor has a tab and the second side has a channel and a recess. The channel can extend in a radial direction and be configured to receive at least a portion of the conductor. In some arrangements the recess intersects the channel and is configured to receive the tab. In some embodiments, the conductor is coupled with a printed circuit board.

In certain variants, the blower includes a plurality of conductors and a plurality of grooves. In some such instances, the number of grooves is the same as the number of conductors. In some embodiments, the groove is configured to fully receive the conductor. In certain variants, the groove also includes a projection that is configured to facilitate holding the conductor in the groove. The housing can further include a protection member, which is configured to inhibit the conductor from contacting the impeller.

BRIEF DESCRIPTION OF THE DRAWINGS

These and other features, aspects and advantages of the disclosure are described herein in connection with certain preferred embodiments, in reference to the accompanying drawings. The illustrated embodiments, however, are merely examples and are not intended to be limiting. The drawings include the following figures.

FIGS. 23, 24A, 24B and 25 illustrate an embodiment of a blower comprising one or more vanes or other flow distribution members within its interior housing, according to.

DETAILED DESCRIPTION

Several embodiments of a low-profile blower are introduced herein, using particular examples for descriptive purposes. A variety of examples described herein illustrate various configurations that may be employed to achieve the desired improvements. The particular embodiments and examples are only illustrative and not intended in any way to restrict the general inventions presented and the various aspects and features of these inventions. For example, although certain embodiments and examples are provided herein in connection with vehicle seats, the inventions are not confined or in any way limited or restricted to such uses. Furthermore, the phraseology and terminology used herein is for the purpose of description and should not be regarded as limiting. No features, structure, or step disclosed herein is essential or indispensable.

Figure 1:
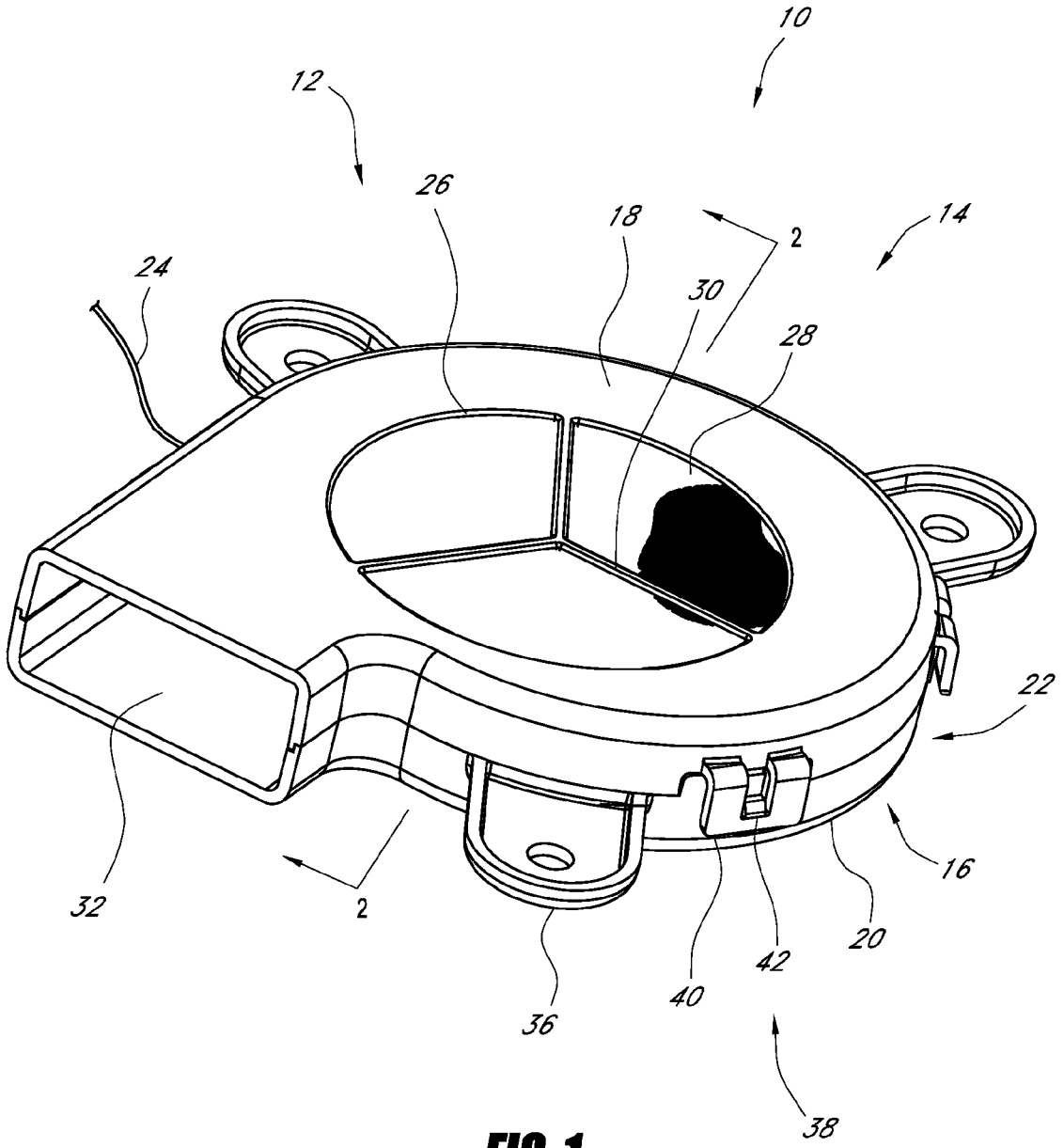
FIG. 1 illustrates a perspective view of some embodiments of a low-profile blower.
Figure 2A:
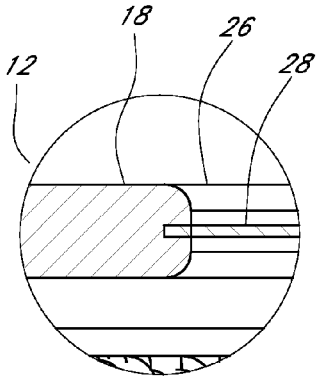
FIG. 2A illustrates a focused view of the interface of the housing and the filter of the embodiment of FIG. 2.
Figure 2B:
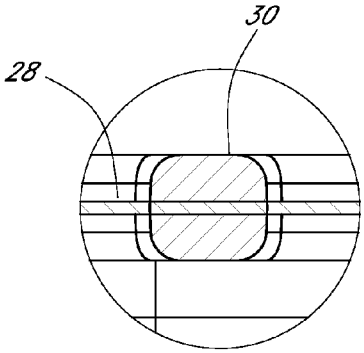
FIG. 2B illustrates a focused view of the interface of the one or more ribs and the filter of the embodiment of FIG. 2.
Figure 2:
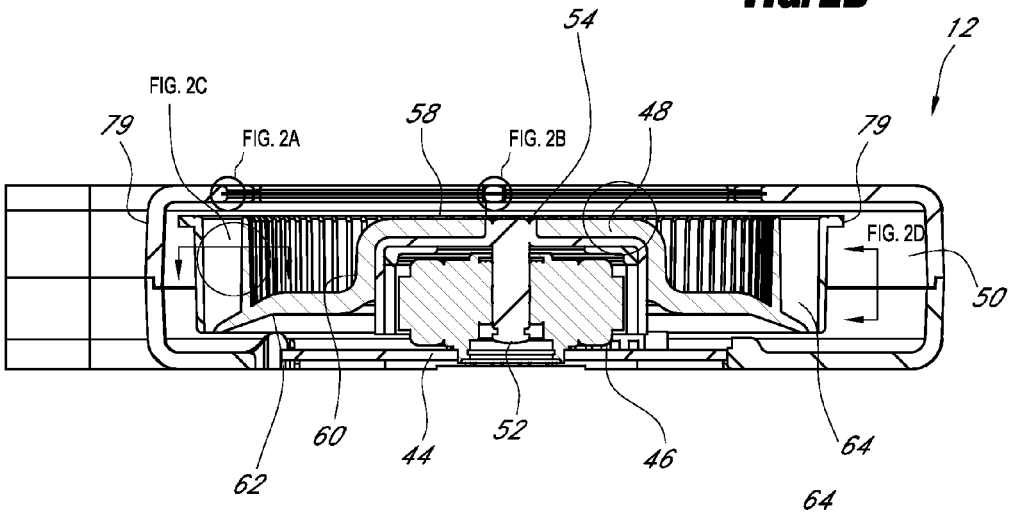
FIG. 2 illustrates a cross-sectional view along line 2-2 of the embodiment of FIG. 1.

With regard to FIGS. 1 and 2, a blower 10 can include a housing 12 that defines a cavity 50 (e.g., inner or interior space, chamber, hollow, etc.) in which an impeller 48 can be selectively rotated to produce fluid flow into and out of the housing 12. The impeller 48 can be rotated by an adjacent motor 46. Although other shapes are suitable, the illustrated housing 12 comprises a generally flat disc with a first side 14 having a first surface 18 and a second side 16 having a second surface 20. In some embodiments, the generally circular peripheries of the walls or sides 14, 16 are joined by one or more sidewalls 22 to form an enclosure. One or more electrical wires 24 may protrude from the sidewall 22.

In some embodiments, the first surface 18 corresponds to a lower or bottom surface if the housing 12 is placed in a seat bottom generally parallel to the ground. As used herein, the terms "up" or "upper" will refer to a direction away from the ground; the terms "down," "lower," or "bottom" will refer to a direction toward the ground. The relative direction of parts would alter if the entire orientation of housing 12 were changed, as may occur in actual use. According to some embodiments, the second surface 20, corresponds to an upper surface, is generally opposite and faces away from the first surface 18.

In certain embodiments, an aperture can be included along the first surface 18 of the housing 12 to form an inlet 26 that is in fluid communication with the cavity 50. A filter 28 can be positioned on or within the inlet 26 such that at least a portion of the airflow entering the cavity 50 passes through the filter 28. As shown, the inlet 26 and/or the filter 28 can be spanned by one or more ribs 30 or other members. In the depicted embodiment, the inlet 26 comprises a total of three ribs 30 that are oriented at approximately 120 degrees relative to each other and meet at or near the center of the inlet 26. However, in other arrangements, the quantity, spacing, orientation and/or other details regarding the ribs 30 or similar members can vary.

According to some embodiments, an outlet 32 extends radially outwardly from the sidewall 22. The outlet 32 can extend generally tangentially from the periphery of the housing 12. In some embodiments, a thermoelectric device (TED) 34 is located within or near the outlet 32 and/or the connecting ductwork (not shown) in order to selectively condition (e.g., heat, cool, etc.) the air or other fluid passing therethrough. Further details concerning TEDs are discussed below. In some embodiments, the wires 24 extend from the housing 12 and are configured to provide electrical power to the motor 46 or TED 34. One or more legs 36 and/or other members or features can also extend from the housing 12. Such legs 36 can, for example, facilitate mounting the blower 10 (e.g., within the vehicle seat, bed, etc.) and/or be provided for any other reason or purpose.

In certain embodiments, the first side 14 and the second side 16 are secured to each other to form the housing 12. In such arrangements, a locking tab or other feature 38 can retain the sides 14, 16 in the mated configuration. In addition, such a locking tab or member 38 can permit the two sides or portions 14, 16 of the housing 12 to be easily separated or otherwise disassembled, as desired or required. The depicted locking feature 38 includes a clip 40 coupled to the first side 14 or portion that mates with a hook 42 coupled to the second side 16 or portion using one or more temporary or permanent attachment devices or methods (e.g., snap fittings, clips, rivets, screws or other fasteners, glues, epoxies, other adhesives, welds, hot melt connections, and/or the like). In yet other embodiments, the housing 12 is monolithic or otherwise formed as a single unitary structure.

As shown in FIG. 2, the printed circuit board (PCB) 44, motor 46, impeller 48 and/or any other device or feature can be positioned in the cavity 50 of the housing 12, as desired or required. In some embodiments, the axial centerline of the motor 46, the impeller 48 and/or the filter 28 are approximately collinear with the axial centerline of the inlet 26. In other embodiments, the axial centerline of the motor 46, the impeller 48 and/or the filter 28 are positioned a distance apart from the axial centerline of the inlet 26. Thus, the centerlines of motor 46, impeller 48, and/or filter 28 can be offset (e.g., radially), either from each other and/or from the axial centerline of the inlet 26. In some embodiments, such an offset is about 1-15 mm, such as, between about 1 mm and 5 mm, between about 5 mm and 10 mm, or between about 10 mm and 15 mm. However, in other arrangements, the offset is less than 1 mm or greater than 15 mm, as desired or required for a particular application or use. In other embodiments, the axial centerline of the motor 46 and/or the impeller 48 is aligned or substantially aligned with the axial centerline of the filter 28. In yet other embodiments, the axial centerline of the motor 46 and/or the impeller 48 is offset from the axial centerline of the filter 28.

The PCB 44 can be mounted to, along or near the second side or surface 16, as is discussed in additional detail herein. The PCB 44 can contain various electronic control components, such as, for example, microprocessors, transistors and/or the like. In some embodiments, the PCB 44 connects to one or more electrical wires that provide electrical power or potential to the PCB 44 and/or are configured to permit the PCB 44 to be in data communication with one or more electrical components. The PCB 44 can be configured to provide power to and/or to help control the motor 46. In the illustrated embodiments, the motor 46 is coupled directly to the PCB 44. However, the relationship between the motor and the PCB can vary, as desired or required.

According to some embodiments, as illustrated herein, the motor 46 includes a central axis aligned with an axle or shaft 52. The motor 46 can be directly or indirectly (e.g., via a gear assembly, another device or feature, etc.) coupled to the shaft 52. The shaft 52 can be rotatably supported within the housing 12, such as, for example, by one or more bearings, bushings, and/or the like. In certain arrangements, the shaft 52 is mechanically coupled to the impeller 48 through a central aperture 54 or other opening in the impeller 48. Other embodiments of the impeller 48 do not include a central aperture 54. In some embodiments, the shaft 52 includes a flange or other protrusion, and the impeller 48 includes a corresponding recess or other feature with which the flange can mate.

In the embodiment shown in FIG. 2, the impeller assembly includes an upper disc-shaped portion 58, an annular portion 60, a lower disc-shaped portion 62 and a plurality of blades 64 at the periphery. The upper disc-shaped portion 58, which in some embodiments is located at or near the center of the impeller assembly, can couple or otherwise be attached to the annular portion 60. Likewise, the lower disc-shaped portion 62, the plurality of blades 64 and/or any other member or feature can extend (e.g., radially outwardly) from the upper portion 58 and the annular portion 60.

As discussed above, the shaft 52 can be mechanically coupled with the impeller 48, such as through the central aperture 54 in the upper disc-shaped portion 58. Thus, in operation, the motor 46 can rotate the shaft 52, which in turn rotates the impeller 48. According to some embodiments, movement of the blades 64 of the impeller 48 helps to draw air or other fluid through the inlet 26 and/or filter 28 to the interior cavity 50. As discussed in greater detail below, the air drawn into the interior cavity 50 can then be transferred to or through the TED 34, whereby it can be selectively thermally conditioned (e.g., heated, cooled, etc.) before exiting the outlet 32 of the housing 12.

Certain embodiments of the blower 10 are configured to reduce fluid loss that occurs along the interface of the first and second sides 14, 16 of the housing 12 and/or to encourage the fluid to pass only through the inlet 26 and outlet 32. Such a configuration can, for example, increase the efficiency of the blower 10. Accordingly, in some embodiments, the blower 10 comprises one or more elements, designs, or features that reduce or otherwise mitigate undesirable fluid-loss. For example, some embodiments include a gasket, seal, filler, or the like configured to inhibit fluid from passing through the intersection of the first and second sides 14, 16.

In some embodiments, the sidewall 22 includes a first substrate having a first hardness and a second substrate having a second hardness, the substrates being configured to form a gasket or seal. For example, in some embodiments, some or all of the housing 12 is formed by injecting a first substrate into an injection mold, molding the first substrate into the sidewall 22 (e.g., of the first side 14 or of the second side 16), injecting a second substrate into the injection mold, and molding the second substrate onto the sidewall 22. In some such arrangements, the first substrate has a higher hardness than the second substrate. Thus, the harder first substrate can provide support to the softer second substrate, which can deform to provide a gasket or seal when the first and second sides 14, 16 of the housing 12 are joined.

In certain embodiments, the first and second sides 14, 16 include features to inhibit fluid from passing therebetween. For example, the first side 14 can include a first substrate and the second side 16 can include a second substrate, the substrates being configured to matingly engage, thereby inhibiting fluid flow therebetween when the first and second sides 14, 16 are joined. In some embodiments, the first and second sides 14, 16 each include fins, the fins being configured to cooperate (e.g., to form a seal therebetween and/or to form a tortuous path therebetween) to inhibit passage of fluid between the first and second sides 14, 16. In other arrangements, one of the first and second sides 14, 16 has a fin and the other of the and second sides 14, 16 has a recess configured to receive the fin, the mated fin and recess configured to inhibit passage of fluid between the first and second sides 14, 16.

Various embodiments of the blower 10 are configured with different sizes. In some embodiments, the blower 10 has an overall axial thickness (e.g. height) of about 5-10 mm (e.g., 5 mm, 6 mm, 7 mm, 8 mm, 9 mm, 10 mm, values between such ranges, etc.). In other embodiments, the blower 10 has an overall axial thickness of about 10-15 mm (e.g., 10 mm, 11 mm, 12 mm, 13 mm, 14 mm, 15 mm, values between such ranges, etc.). In yet further embodiments, the blower 10 has an overall axial thickness of about 15-20 mm (e.g., 15 mm, 16 mm, 17 mm, 18 mm, 19 mm, 20 mm, values between such ranges, etc.). In some embodiments, the blower 10 is axially thinner than the duct to which the blower 10 immediately connects. In some embodiments, the blower 10 has an axial thickness that is no more than about 10 mm. In certain embodiments, the axial thickness of the blower 10 is no more than about 13 mm. In some embodiments, the blower 10 has an axial thickness that is no more than about 15 mm.

Furthermore, various embodiments of the blower 10 provide a variety fluid flow rates out of the outlet 32 during standard operating conditions. In certain embodiments, the blower 10 provides an airflow of about 1-10 SCFM (standard cubic feet per minute) or more (e.g., 1 SCFM, 2 SCFM, 3 SCFM, 4 SCFM, 5 SCFM, 6 SCFM, 7 SCFM, 8 SCFM, 9 SCFM, 10 SCFM, values between such ranges, or more). In other embodiments, the blower 10 provides an airflow of about 10-20 SCFM (e.g., 10 SCFM, 11 SCFM, 12 SCFM, 13 SCFM, 14 SCFM, 15 SCFM, 16 SCFM, 17 SCFM, 18 SCFM, 19 SCFM, 20 SCFM, values between such ranges, etc.). Yet further embodiments of the blower 10 provide about 25 SCFM or less. Certain embodiments of the blower 10 have a fluid flow rate of about 12-23 SCFM. Other embodiments have a fluid flow rate of about 2-17 SCFM.

Moreover, various embodiments of the blower 10 produce a variety of amounts of noise. For example, some embodiments of the blower 10 produce no more than about 20 dBA of noise. Certain other embodiments of the blower 10 produce no more than about 25 dBA of noise. Yet other embodiments of the blower 10 produce no more than about 30 dBA of noise. Further embodiments of the blower 10 produce no more than about 35 dBA of noise. In some embodiments, the blower 10 produces no more than about 40 dBA of noise. In other embodiments, the blower 10 produces no more than about 44 dBA of noise. In certain other embodiments, the blower 10 produces no more than about 50 dBA of noise. Other embodiments of the blower 10 produce no more than about 55 dBA of noise. Yet other embodiments of the blower 10 produce no more than about 60 dBA of noise.

In some embodiments, the blower 10 generates a limited amount of noise beyond the ambient noise of the environment in which the seat, bed, or other occupant support surface is located. For example, in some cases in which the blower 10 is positioned in, near, or under an automobile seat, the blower 10 produces less than or equal to about 15 dBA of noise beyond the ambient noise of the environment within the passenger compartment automobile (e.g., with the automobile stationary, with the engine operating and in idle, with other ventilation systems not operating, and with the doors and windows closed). In some embodiments, the blower 10 produces less than or equal to about 10 dBA of noise more than the noise of the ambient environment.

Integrated Filter

With reference to FIG. 1, some embodiments of the blower 10 include a filter 28, which can span at least a portion of the inlet 26. Among other benefits, such a filter 28 can trap and remove at least some of the undesirable contaminants and other materials that would otherwise enter into the blower 10 via the inlet 26, such as dust, pollen, mold, bacteria, insects and/or the like. In some embodiments the filter 28 serves as a guard to inhibit foreign objects, such as human fingers, portions of a seating assembly and/or the like, from penetrating the inlet 26 (and thus becoming exposed to the rotating impeller 48). Accordingly, in some embodiments, the filter 28 fully covers the inlet aperture or opening 26. In other embodiments, the filter is sized, shaped and/or otherwise configured to cover only a portion of the inlet 26.

In some embodiments, the filter 28 comprises a screen, mesh or other structural configuration that is adapted to trap and prevent contaminants from passing therethrough. In other embodiments, the filter 28 is chemical or catalytic in nature. For example, the filter can include one or more substances that generally absorb volatile organic compounds. In yet other embodiments, the filter 28 is electronic in nature. For instance, the filter can comprise an ionization or electrostatic filter. The filter 28 can comprise one or more materials, such as plastics (e.g., polypropylene, polyester, and the like), metals, natural materials (paper-based or wood-based material, fiber-laden materials, cotton, wool, etc.), other synthetic materials, foams, fiberglass, ceramics and/or the like. In some embodiments, the filter 28 is made of one or more fire-resistant or fire-retardant materials to prevent or reduce the likelihood of a fire hazard to the blower 10.

The filter 28 can comprise a plurality of interconnected strands that form a mesh-like structure and that define a plurality of voids. In some embodiments, such voids comprise a polygonal shape (e.g., square, rectangle, triangle, etc.), a circular or elliptical shape, an irregular shape, any other shape, and/or combinations thereof.

In some embodiments, the filter 28 is configured to generally inhibit or prevent the passage of contaminants, such as dust, pollen, soot, metals, particulates, and/or other materials. In some embodiments, the filter 28 is configured to inhibit passage of contaminants having a diameter or cross-sectional diameter of at least about 2 mm or greater. However, the voids or other openings of the filter 28 can have a different diameter or other cross-sectional shape or size, as desired or required. For example, the filter 28 can be adapted to generally inhibit or prevent the passage of contaminants that are at least about 0.1 mm, 0.5 mm, 1 mm, 3 mm, 5 mm, and/or greater than 5 mm in size (e.g., diameter, cross-sectional dimension, etc.). In certain embodiments, the filter 28 is configured to inhibit the passage of microbes. In some variants, the filter 28 is configured to purify, sterilize, and/or disinfect at least a portion of the fluid passing through the filter 28. For example, the filter 28 be configured to eradicate or disable pathogens (e.g., bacteria, viruses, algae, and/or fungi), such as with radiation and/or ultraviolet light. In some embodiments, the filter 28 comprises a HEPA (high efficiency particulate air) filter.

In arrangements in which the filter 28 comprises a mesh or a similar retaining structure, the mesh can be any size sufficient to permit adequate airflow into the housing 12. For example, the filter 28 can include a mesh size of about 0.05-3.0 mm (e.g., 0.05 mm, 0.1 mm, 0.5 mm, 1.0 mm, 1.5 mm, 2.0 mm, 2.5 mm, 3.0 mm, values between such ranges, etc.), less than 0.05 mm (0.01 mm, 0.02 mm, 0.03 mm, 0.04 mm, etc.), or greater than 3 mm, as desired or required.

In certain arrangements, the filter 28 has a peripheral shape that is similar to that of the inlet 26. For instance, both the inlet 26 and the filter 28 can be substantially circular, elliptical, polygonal (e.g., rectangular, hexagonal, octagonal, etc.), irregular and/or the like. In other embodiments, the shape of the filter 28 is generally dissimilar to that of the inlet 26. For example, the blower 10 can include an elliptical filter 28 and a circular inlet 26, a hexagonal filter 28 and a pentagonal inlet 26 or any other combination. In certain embodiments, the diameter (e.g., in the case of a circular filter 28), distance between opposite sides (e.g., in the case of a polygonal filter 28) or any other spanning dimension is equal to or greater than the corresponding diameter, distance or other dimension of the inlet 26 (e.g., diameter of the inlet, distance separating opposite sides of the inlet, etc.). For instance, in some embodiments, the inlet 26 is generally circular and comprises a diameter of about 60 mm, whereas the filter 28 is also generally circular and comprises a diameter of about 70 mm. The size of the inlet can vary, however, so that its diameter is greater or less than 60 mm (e.g., 30-40 mm, 40-50 mm, 50-60 mm, 60-70 mm, 70-80 mm, less than 30 mm, greater than 80 mm, etc.). In another embodiment, the inlet 26 is generally circular with a diameter of about 65 mm, while the filter 28 is generally elliptical with a major diameter of about 75 mm and a minor diameter of about 70 mm. Alternatively, both the inlet aperture 26 and the filter 28 are generally rectangular (e.g., square). For example, in some embodiments, the inlet 26 comprises a generally square shape having with the distance between opposite corners being about 70 mm. However, as noted above, the shape, diameter, other dimension and/or other details regarding the inlet 26 and/or the filter 28 can vary, as desired or required by a particular application or use.

In some embodiments, the blower 10 includes one or more ribs or other reinforcing members 30. The ribs 30 can provide support and rigidity to the filter 28. In certain arrangements, the ribs 30 inhibit the filter 28 from being pushed or drawn through the inlet 26 and into the interior cavity 50 of the housing 12. As shown, the ribs 30 can extend either completely or partially the length or other dimension of the filter 28 and the inlet 26. The illustrated embodiment has three ribs 30 that are generally equally spaced at the inlet 26 periphery and radially converge at about the center of the inlet 26. However, other embodiments include different numbers and configurations of ribs 30. For example, some embodiments of the blower 10 comprise a total of four or more ribs 30 arranged in a grid-like pattern. Another embodiment includes a single rib 30 that approximately bisects the inlet 26 and/or the filter 28 into two halves. In yet other embodiments, the blower has no ribs 30 across the inlet 26 and/or the filter 28.

The ribs 30 illustrated in FIG. 1 are straight and comprise a generally rectangular cross section. However, in other embodiments, the ribs 30 include a different shape. For example, one or more of the ribs 30 can have a cross-sectional shape that is elliptical, circular, polygonal (e.g., square, hexagonal, octagonal, etc.), irregular or otherwise. In certain embodiments, the ribs 30 or other reinforcement members can be curved or angled with respect to each other. In some embodiments, the ribs 30 are parallel or non-parallel to each other. For instance, the blower 10 can include a plurality of "S," "V," or "W" shaped ribs 30. In some such cases, the ribs 30 intersect at about the center of the inlet 26. In certain arrangements, the ribs 30 intersect each other at an angle of about 90-150°.

In some embodiments, one or more of the ribs 30 is angled or skewed with respect to the blades 64. For example, one or more of the ribs 30 can be configured such that as one of the blades 64 passes beneath one of the ribs 30, the blade 64 and the rib 30 are not aligned (e.g., parallel). Such a configuration can, for example, reduce the amount of noise generated by the blower 10 as the blades 64 pass by the ribs 30.

In certain embodiments, the cross-sectional shape of the ribs 30 and/or blades 64 is configured to reduce the noise of the blower 10 by dampening or otherwise scattering the pressure wave generated by the blades 64 as the blades 64 passes below the ribs 30. For example, the ribs 30 can have an elliptical profile, with the minor axis of the ellipse substantially parallel to the axis of rotation of the impeller 48. In some such cases, the pressure wave encounters the curved face of the ellipse rather than, for example, encountering a flat face, such as would be the case should the rib 30 have, for example, a square cross-section. In certain such arrangements, such a curved face can scatter or otherwise reduce the effect (e.g., noise) of the pressure wave as it impacts the rib 30.

In some embodiments, the number of blades 64 of the impeller 48 is not evenly divisible by the number of ribs 30. For example, in some embodiments, the blower 10 has five ribs 30 and fifty-eight, fifty-nine, sixty-one, or sixty-two blades 64 (instead of, for instance, sixty blades, which would be evenly divisible by the number of ribs). Such a configuration can, for example, reduce the likelihood of resonance, and/or the generation of noise, due to each of the ribs 30 being simultaneously passed by one of the blades 64.

As illustrated in the embodiment of FIG. 2A, the filter 28 can be integrally formed with the housing 12. As used herein, "integral" or "integrated with" shall be given their ordinary meaning and include, without limitation, forming a generally unitary or monolithic structure, being generally inseparable, or being non-removable during the course of ordinary use. Thus, a filter 28 that is integrally formed with the housing 12 is generally monolithic with such housing 12 or is irremovable from the housing 12 in the ordinary use of the blower 10. As illustrated herein, the periphery of the filter 28 can be physically contained within the peripheral portion of the housing 12 that defines the inlet 26. In some such arrangements, removal of the filter 28 from the blower 10 is substantially inhibited. In various embodiments, integrating the filter 28 with the housing 12 can, for example, reduce the axial height of the blower 10 and/or reduce intake airflow back pressure.

In some embodiments, the filter 28 is integrally formed with the housing when the housing 12 is being manufactured or assembled. The filter 28 can be formed from the same material and during the same process as the housing 12 and/or a component thereof. For example, a single molding process (e.g., injection molding, compression molding, thermoforming, etc.) and/or other manufacturing process can be used to produce a housing having an integrated filter 28 (e.g., as a unitary piece). In another embodiment, a pre-formed filter 28 is introduced into the manufacturing process and is permanently or removably secured to the housing 12 (e.g., using a press, other molding apparatus and/or the like).

During molding and/or other manufacturing processes in which the filter is integrally formed with the housing 12, at least a portion of the housing material can be configured to flow through and into voids of the filter 28 (e.g., along the filter periphery or other possible connection points or locations) in order to more securely attach the filter 28 to the housing 12. Designs in which a filter 28 is integrally formed with the housing 12 can provide one or more benefits and advantages. For example, such configurations can help reduce the number of portions or components of the blower 10. Further, such designs can help simplify the manufacture, maintenance and/or other aspects associated with making and using the blower 10. For example, in some embodiments, the integral filter 28 eliminates the need for fasteners or the like for securing the filter 28 to the housing 12. In another embodiment, the rate of assembling the blower 10 can be advantageously increased, because the steps associated with assembling the filter 28 into the housing 12 can be simplified or even eliminated.

In some embodiments, the filter 28 is integrated with the housing 12 after the filter 28 and housing 12 have been separately manufactured. The filter 28 can be secured to the housing 12 using ultrasonic welding or any other welding procedure or technique. Further, the filter 28 can be attached to the housing 12, using any other connection method or device, such as, for example, glues, epoxies, other adhesives, screws, rivets, snap connections, other fasteners, force fit, friction fit or interference fit connections and/or the like. In some arrangements, the periphery of the filter 28 defines one or more tabs that can be received into corresponding slots in the housing 12 in order to provide a permanent attachment between the components.

In certain embodiments, the integrated filter 28 can help to decrease the overall axial thickness of the blower 10, regardless the exact configuration of the filter 28. Such a decrease can be achieved because, for example, the filter is recessed within the inlet 26, rather than being installed on top of the inlet 26. In certain cases, the axial thickness of the blower 10 can be further improved when the filter 28 is insert-molded or otherwise molded with the housing or other adjacent portions of the blower 10.

As illustrated in FIG. 2B, the filter 28 can be integrally formed with the ribs 30. Such a configuration can be advantageous because, among other things, it provides support on the input and output side of the filter 28. Integrating the filter 28 with the ribs 30 can also prevent removal or separation of the filter 28. In some embodiments, the filter 28 and ribs 30 are attached to or integrally formed with each another in the manufacturing process, such as, for example, an injection molding process, another type of molding process and/or the like. In other embodiments, the ribs 30 and filter 28 are separate items that are attached to each other during a subsequent assembly process.

Some embodiments of the blower 10 have two or more filters 28. In such embodiments, one, some, or all of the filters 28 can be removably and/or permanently attached to the housing 12. For example, the blower 10 can comprise an integrally formed, permanent filter 28, while also being configured to receive a removable filter 28. The filters 28 can be sized, shaped and otherwise configured to stack on each other (e.g., along the same or approximately the same area of the housing). Alternatively, the various filters 28 can be configured to attach (either permanently or removably) to different sides of the housing 12 and/or other portions of the blower 10. For example, a first filter can be positioned at the inlet along the exterior side of the housing and a second filter can be positioned along the interior side of the housing.

Impeller and Blades

In various embodiments, the impeller 48 includes a variety of sizes and configurations. For example, in some embodiments the impeller 48 has an axial thickness (e.g. height) of about 3-8 mm (e.g., 3 mm, 4 mm, 5 mm, 6 mm, 7 mm, 8 mm, values between such ranges, etc.). In other embodiments, the impeller 48 has an overall axial thickness of about 8-13 mm (e.g., 8 mm, 9 mm, 10 mm, 11 mm, 12 mm, 13 mm, values between such ranges, etc.). In yet further embodiments, the impeller 48 has an overall axial thickness of about 13-20 mm (e.g., 13 mm, 14 mm, 15 mm, 16 mm, 17 mm, 18 mm, 19 mm, 20 mm, values between such ranges, etc.). In some embodiments, the impeller 48 has an axial thickness that is about 65-70% (e.g., 65%, 66%, 67%, 68%, 69%, 70%, values between such ranges, etc.) of the overall axial thickness of the blower 10. In other embodiments, the impeller 48 has an axial thickness that is about 70%-75% (e.g., 70%, 71%, 72%, 73%, 74%, 75%, values between such ranges, etc.) of the overall axial thickness of the blower 10. In further embodiments, the impeller 48 has an axial thickness that is about 75%-80% (e.g., 75%, 76%, 77%, 78%, 79%, 80%, values between such ranges, etc.) of the overall axial thickness of the blower 10. In still further embodiments, the impeller 48 has an axial thickness that is about 60%-80% of the overall axial thickness of the blower 10.

In certain embodiments, the impeller 48 has an outside diameter of less than about 50 mm. In other embodiments, the impeller 48 has an outside diameter of about 50-60 mm (e.g., 50 mm, 51 mm, 52 mm, 53 mm, 54 mm, 55 mm, 56 mm, 57 mm, 58 mm, 59 mm, 60 mm, values between such ranges, etc.). In other embodiments, the impeller 48 has an outside diameter of about 60-70 mm (e.g., 60 mm, 61 mm, 62 mm, 63 mm, 64 mm, 65 mm, 66 mm, 67 mm, 68 mm, 69 mm, 70 mm, values between such ranges, etc.). In yet other embodiments, the impeller 48 has an outside diameter of about 70-80 mm (e.g., 70 mm, 71 mm, 72 mm, 73 mm, 74 mm, 75 mm, 76 mm, 77 mm, 78 mm, 79 mm, 80 mm, values between such ranges, etc.). In further embodiments, the impeller 48 has an outside diameter of more than about 80 mm.

Figure 2C:
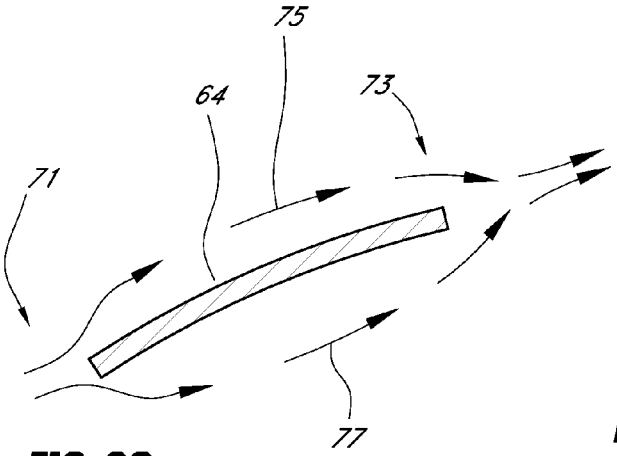
FIG. 2C illustrates a focused cross-sectional view in an axial direction of an impeller blade of the embodiment of FIG. 2.

In some embodiments, the blades 64 of the impeller 48 have a thin or reduced thickness. Such a configuration can, for example, reduce noise and/or increase the efficiency of the impeller 48 by reducing the effect of a separation zone 71 and a reattachment zone 73. As shown in FIG. 2C, the separation zone 71 is the zone in which flow of air or other fluid encounters the blade 64 and separates to pass around the blade 64. For example, a first flow portion 75 can pass on one side of the blade 64 and a second flow portion 77 can pass on the other side of the blade 64. In some arrangements, separation zone 71 is located on the radially inward portion of the blades 64. The reattachment zone 73 is the zone in which the first and second flow portions 75, 77 of air or fluid meet again, after having passed along the blade 64. In some arrangements, the reattachment zone is located on the radially outward portion of the blades 64.

As preciously discussed, the impeller 48 can include blades 64. Various configurations of the blades 64 are contemplated. For example, in some cases the blades are curved. In other instances, the blades 64 are substantially straight. In certain arrangements, the blades 64 are shaped as airfoils.

In some embodiments, the blades 64 have a reduced thickness compared to typical conventional impeller blades. As discussed herein, the "thickness" of the blades 64 refers to the width of the blades 64 along a portion of a circumference of the impeller 48 (e.g., measured substantially perpendicular to the axis of rotation of the impeller 48 and substantially perpendicular to the radius of the impeller 48). In certain embodiments, the thickness of one or more of the blades 64 is at least 0.7 mm and/or equal to or greater than 3.0 mm. In some embodiments, the thickest width of one or more of the blades 64 is between about 0.5 mm and about 2.5 mm. In some embodiments, the thickest width of one or more of the blades 64 between about 0.8 mm and about 1.5 mm. In certain embodiments, one or more of the blades 64 have a thickness between about 0.1 mm and about 0.5 mm. Indeed, in some such arrangements, each of the blades 64 has a thickness between about 0.1 mm and about 0.5 mm.

In some embodiments, the benefit of the thin blades 64 is more pronounced as the diameter of the impeller 48 decreases and/or the total number of blades 64 increases. This is because, for example, the blockage ratio increases as the diameter of the impeller 48 decreases and/or the total number of blades 64 increases. The blockage ratio is ratio of the total combined thickness of the blades 64 compared to the circumference of the blades 64 at or near the separation zone 71. As the blockage ratio increases, the air or fluid passing along the blades 64 has less area to move into in order to pass along the blades 64, which can result in noise and decreased efficiency of the impeller 48. On the other hand, the thin or reduced thickness profile of the blades 64 can provide a reduced blockage ratio, thereby reducing or avoiding such problems and/or increasing the volume of flow output from the impeller 48.

Generally, noise and/or turbulence (which in turn can reduce the efficiency of the blower 10) can be generated at the separation zone and the reattachment zone. However, in certain relatively thin configurations, the blade 64 can reduce such turbulence and/or noise. This is because, for example, the first and second flow portions 75, 77 need not make a sharp turn in order to pass around the blade 64. Rather, in such instances, the direction of movement (before, along, and after the blade 64) of the first and second flow portions 75, 77 is relatively unchanged.

Various materials for the blades 64 can be employed. For example, in certain embodiments, the blades 64 are plastic or metal. In some embodiments, one or more of the blades 64 can be formed of nylon, acetals, polyesters, polypropylenes, liquid crystal polymers, combinations thereof, or otherwise. In some cases, one or more of the blades 64 has a thickness of about 0.7 mm or greater and comprises unfilled nylon. In some cases, one or more of the blades 64 has a thickness of less than about 0.7 mm and comprises liquid crystal polymer and another plastic. In other cases, one or more of the blades 64 has a thickness of about 0.1 mm or greater and comprises liquid crystal polymer. In still other cases, one or more of the blades 64 has a thickness of about 0.2 mm or greater and comprises liquid crystal polymer.

In certain embodiments, one or more of the blades 64 are formed of a material that is readily flowable (e.g., having flow characteristics similar to water), which can facilitate, for example, the ability to manufacture the relatively thin blades 64. For instance, in some cases, one or more of the blades 64 are molded (e.g., injection molded) with a readily flowable plastic. In some arrangements, the blades 64 are made of a material having a relatively high melt index, such as polypropylene or liquid crystal polymer.

In some embodiments, as the blades 64 are rotating, they can be subjected to a substantial centrifugal force. Thus, in certain embodiments, the impeller 48 includes a support ring 79 or other such feature, which can provide structural support to the blades 64, thereby reducing the likelihood of failure of the blades 64. In the embodiment illustrated in FIG. 2, the support ring 79 is located at about the upper portion of the blades 64 and at about the outside diameter of the impeller 48. However, other locations and configuration of the support ring 79 are contemplated.

In other embodiments, the impeller 48 does not include the support ring 79. In such cases, the blades 64 are configured with sufficient strength so as to withstand the effects of rotation of the impeller 48. For example, the blades 64 can have a tapered shape (e.g., thicker near the lower disc-shaped portion 62 and thinner at the axially opposite end of the blade), include a reinforcement material (e.g., glass fibers or beads, metal flakes, mica, carbon fibers, combinations thereof, and the like), or have an increased radial and/or circumferential thickness. In certain embodiments, the blades 64 have a radially-outwardly angled or curved shape, which can provide strength to the blades 64. In certain such cases, the blades 64 are at least partly radially cantilevered beyond the outside diameter of the lower disc-shaped portion 62. Configurations without the support ring 79 can, for example, reduce noise and increase efficiency of the impeller 48 because the air or other fluid flowing out from the blades 64 is not blocked by the support ring 79.

Figure 2D:
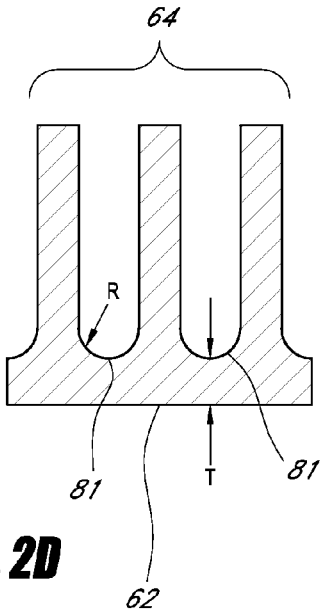
FIG. 2D illustrates a focused cross-sectional view in a radial direction of an impeller blade of the embodiment of FIG. 2.

In some embodiments, blades 64 that are adjacent are joined via a curved notch 81. For example, the embodiment illustrated in FIG. 2D illustrates three blades 64 with the curved notch 81 between each of the two sets of adjacent blades. Such a smooth transition between adjacent blades can, for example, reduce turbulence at the base of the blades 64, which in turn can reduce noise and increase efficiency. In some configurations, the ratio of the radius R of the curved notch 81 compared to the axial thickness T of the base of the blades 64 (e.g., at or near the lower disc-shaped portion 62), is about 0.5 to about 1.0. In other configurations, the ratio of the radius R to the axial thickness T is about 1.0 to about 2.0.

Wire Channel

In some embodiments, one or more electrical wires 24 can pass from outside the housing 12 to the PCB 44, located at least partially in the interior cavity 50, to electrically couple to the PCB 44, motor 46, TED 34 and/or any other component or device. For example, such wires 24 can supply electrical power to the interior of the housing, can place one or more internal components in data communication with a device located outside the housing, and/or the like.

In certain existing blowers, a shield or similar member physically separates the wires from the impeller in order to prevent the spinning impeller from damaging the wires. However, such a shield can increase the total axial blower thickness (e.g., due, at least in part, to the thickness of the shield). As discussed in greater detail herein, a strategically sized, shaped, positioned, and/or otherwise configured channel 66 in the housing 12 can allow for elimination of a shield or other protective member. Thus, such a channel 66, which can be configured to provide the requisite protection to the wires entering and exiting the interior of the housing, can help reduce the overall thickness of the blower 10.

Figure 3:
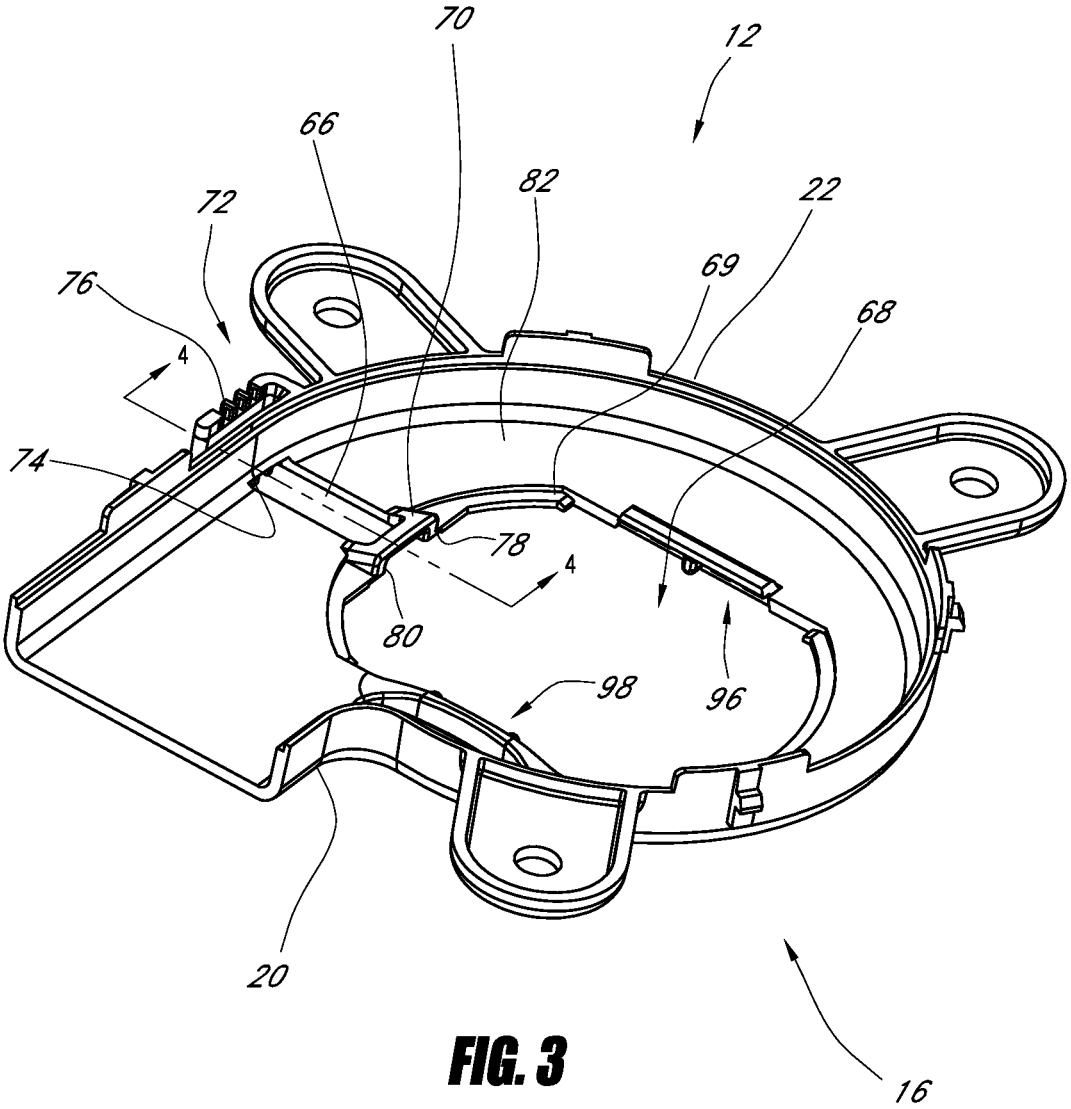
FIG. 3 illustrates a perspective view of a second side of the housing of the embodiment of FIG. 1.
Figure 4:
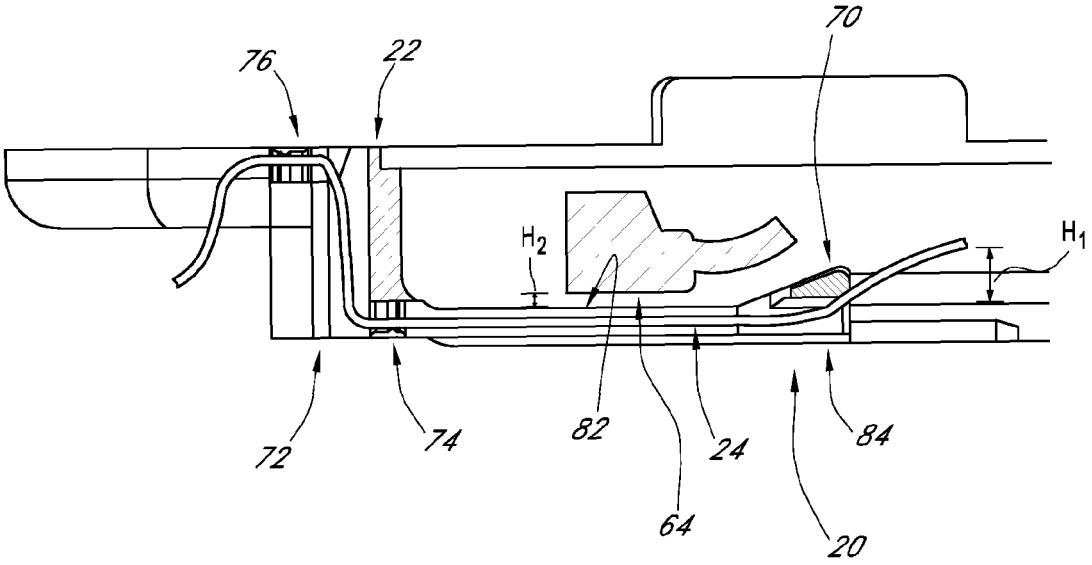
FIG. 4 illustrates a cross-sectional view along the line 4-4 of the embodiment of FIG. 3.

With reference to FIGS. 3 and 4, the second side 16 of the housing 12 can comprise a sidewall 22, a channel 66, and a mounting aperture 68. Certain embodiments also include one or both of a first retaining member 70 and a second retaining member 72. In some embodiments, one or more wires 24 pass through the housing of the blower 10 and are routed past the first retaining member 70. The first retaining member 70 can urge the wires away from the impeller 48 (e.g., in a downward direction, toward the mounting aperture 68), thereby reducing the likelihood of the wires 24 being cut or otherwise damaged by the impeller 48. In some embodiments, the wires 24 route through the channel 66 and continue beyond the periphery of the impeller 48. In certain embodiments, the wires are routed outside the blower 10 via an aperture, opening, or other feature in the sidewall 22. Some embodiments of the blower 10 include a plurality of channels 66.

In some embodiments, the first retaining member 70 is a bridge-like member that generally spans the width of the channel 66 and that is fixed at both ends 78, 80. Alternate configurations of the first retaining 70 member include, for example, one or more clips, clamps, clasps, staples, straps, latches, bars, posts, other fasteners, glues, epoxies, other adhesives, ties, hook and loop fasteners and/or the like. Generally, the first retaining member 70 is smoothed, rounded, and/or or chamfered to inhibit or reduce the likelihood of wear on the wires 24.

In certain embodiments, the first retaining member 70 is positioned adjacent to the mounting aperture 68 for the PCB 44. In other embodiments, the first retaining member 70 is located at another location relative to the mounting aperture. For example, the first retaining member 70 can be radially spaced apart from the mounting aperture 68. In some arrangements, the first retaining 70 member is positioned closer to the center of the impeller 48 than the blades 64.

The second retaining member 72 that can, for example, provide a desired amount of tension to the wires 24, provide strain relief to the wires 24, and/or generally prevent the wires 24 from becoming slack. In some embodiments, the second retaining member 72 is configured to ensure that the wires 24 do not contact the rotating impeller 48 while the blower 10 is activated (e.g., energized so as to rotate the impeller 48).

In some embodiments, the blower 10 includes one or more separators 74, 76 or other members or features. The separators 74, 76 can be configured to space the wires 24 apart from each other. For example, the separators 74, 76 can be configured to maintain a desired distance between the wires 24 for at least a portion of the distance over which the wires are adjacent to one another. In certain embodiments, the separators 74, 76 are configured to space the wires 24 apart from each other through some or all of the length of the channel 66. In some embodiments, the distance between adjacent separators 74, 76 is smaller than the outer diameter of one of the wires 24 configured to be positioned therein. Thus, in such arrangements, at least one of the separators 74, 76 can pinch, grip, or otherwise secure at least one of the wires 24.

In the illustrated embodiment, the separators 74, 76 are disposed at or near the second retaining member 72. However, the separators 74, 76, can be positioned along any portion of the housing 12 and/or other part of the blower 10. For example, in certain arrangements, at least some of the separators 74, 76 are positioned on the first retaining member 70.

According to some embodiments, the channel 66 comprises a recess, depression, gap, opening, or other such feature in the housing 12. For example, the channel 66 can comprise an opening that extends fully through the second side 16. In other embodiments, the channel 66 extends only partly through the second side 16. In some embodiments, the channel 66 comprises an axial thickness configured to accommodate the diameter of the largest wire 24 that passes therethrough. For example, in an embodiment in which the wires 24 have an outside diameter of, for example, about 0.8 mm, about 1.0 mm, and 1.3 mm, then the channel 66 can be configured to have an axial thickness of at least about 1.3 mm.

In various embodiments, the channel 66 extends at least partially along the radial width of the second side 16. For example, the channel 66 can extend from about the mounting aperture 68 to about the sidewall 22. The illustrated channel 66 is generally straight. However, in other embodiments, the channel 66 is curved or angled, such as having a zigzagged, sinusoidal, or undulating shape. Also, although the illustrated channel 66 defines a generally rectangular shape, in other embodiments the channel 66 defines other shapes, such as trapezoidal.

In some embodiments, the channel 66 includes a plurality of individual grooves or subchannels through which a wire (or grouping of two or more wires) may pass. Such a configuration can, for example, allow for a unique groove or subchannel for each wire. In some embodiments, the grooves or subchannels are parallel or substantially parallel with one another.

With continued reference to FIG. 3, the sidewall 22 can comprise one or more apertures or similar features to allow one or more wires 24 to pass therethrough, and thus, exit the housing 12. For example, in the depicted embodiment, the sidewall 22 includes one or more first separation members 74 along the exterior of the second side 16. In some arrangements, the first separation members 74 comprise one or more downward projections or other protruding members. Such projections can extend from the sidewall 22 into the channel 66. The illustrated first separation members 74 are spaced and otherwise oriented so that the wires 24 may be passed therebetween (e.g., while routed into/out of the housing 12).

In some embodiments, the first separation members 74 are configured to separate the wires 24 from each other, inhibit the wires 24 from crossing over each other, prevent or reduce slack in the wires, prevent or reduce undesirable movement of the wires (e.g., along their longitudinal axis) and/or the like. As noted above, the opening of a separation member 74 can be generally narrower or smaller than the outer diameter or other dimension of the wire configured to be secured therein. Thus, the wires can be gripped or otherwise positively retained within corresponding separation members 74.

The second retaining member 72 can comprise an arm or similar member positioned on, along or near the exterior of the housing 12. Alternatively, the second retaining member 72 can be positioned in the interior cavity 50 of the housing 12. In other embodiments, the second retaining 72 member includes one or more bridges, clips, clamps, clasps, staples, straps, latches, bars, posts, other fasteners, glues, epoxies, other adhesives ties, hook and loop fasteners and/or the like. Further, the second retaining member 72 can additionally include one or more second separation members 76, as desired or required. As discussed in additional detail below, the second retaining member 72 can be configured to encourage the one or more wires 24 to undergo a change in direction.

An example of the routing of wires 24 into the housing is illustrated in FIG. 4. As shown, a wire 24 (e.g., a conductor) connects to the PCB 44 at height H1 above an interior surface 82 of the second side 16 of the housing 12. In some embodiments, the lowest portion of the impeller 48 is positioned at height H2 above the interior surface 82 of the second side 16, wherein H1 is greater than H2. Thus, if the wire 24 is routed out of the housing 12 without such a change in height, the wire 24 could interfere with, and/or be damaged by, the moving impeller 48.

As previously noted, the first retaining member 70 can be configured to direct the wires 24 away from the impeller 48 and into the channel 66. In some such embodiments, the portion of the wires 24 that are within the channel 66 and nearest the impeller 48 are approximately at or below the interior surface 82 of the second side 16. Accordingly, in such cases, the wires 24 can pass beneath the impeller 48 without interference or damage. The wire 24 can be routed through the channel 66 in a radially outward direction to the sidewall 22.

As shown in FIG. 4, in some embodiments, the wires 24 pass through the sidewall 22 and the first separation members 74. In some such arrangements, the wire 24 are turned (e.g., at an angle of about 90°) and routed between the second retaining member 72 and the exterior side of the sidewall 22. In certain arrangements, the wires 24 are turned again and passed between the second separation members 76 before extending outside the blower 10 (e.g., to be routed to an electrical power source, a controller or other device, etc.).

In some embodiments, such a curved or otherwise tortuous routing of the wires 24 inhibits or prevents damage to the wire 24. For example, such a routing can provide strain relief to the wires 24. Furthermore, such a routing can maintain a desired level of tension in the wires 24, thereby inhibiting or preventing slack or kink in the wires 24. Moreover, such routing configurations can reduce the possibility of one or more of the wires 24 being pulled out of the blower 10. Nonetheless, any other designs, configuration, features, devices, methods, and/or the like can be used to provide the necessary or desired protection to the wires 24. For example, in some embodiments, the second retaining member 72 comprises an adhesive that retains the wire 24 in a desired position relative to the channel 66 and/or maintains tension in the wire 24.

In certain embodiments, the second surface 20 of the second side 16 of the housing 12 can define a recess 84 or other opening. As shown, the recess 84 can be positioned axially below the channel 66. In some embodiments, the recess 84 is configured to receive a removable or permanent cover member 86. The cover member 86 can be adapted to prevent or reduce the likelihood of air or other fluid from exiting the housing 12 (e.g., by passing through the channel 66). Further, the cover member 86 can be configured to reduce the amount of noise emitted or generated by the blower 10. In some embodiments, such a reduction in noise can be attributed to a reduction of fluid loss through the channel 66 and/or improved fluid transfer through the channel 66. For example, in some embodiments, there is substantially no fluid flow through the channel 66. In some instances, substantially no fluid exits the housing 12 via the channel 66.

Figure 5:
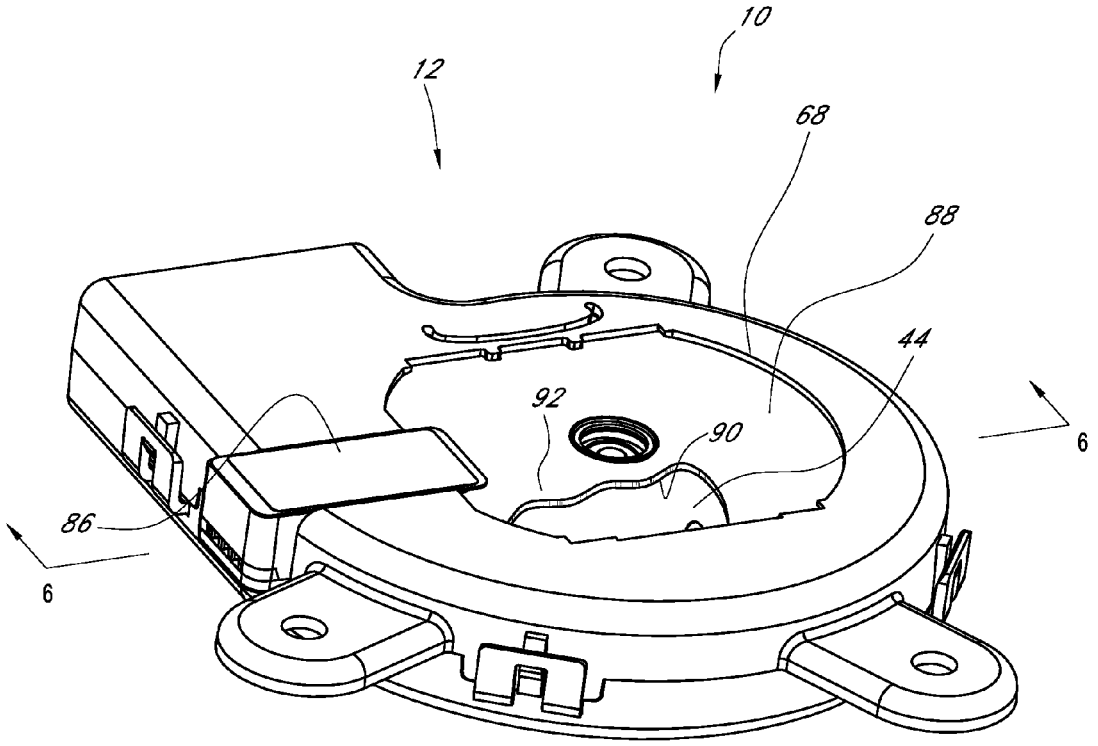
FIG. 5 illustrates a perspective view of the embodiment of the blower of FIG. 1.

According to some embodiments, the cover member 86 is substantially planar, having a relatively small thickness. As shown in FIG. 5, the thickness of the recess 84 can be about the thickness of the cover member 86, so that when the cover member 86 is received in the recess 84 the cover member 86 does not protrude from the second surface 20 of the housing 12. As noted above, the cover member 86 can be irremovably attached to the second side 16 of the housing during ordinary use. For example, the cover member can be permanently attached to and/or integrally or monolithically formed with the housing. However, in alternative embodiments, the cover member 86 is a separate component that can be selectively attached to and removed from the housing 12. In some arrangements, such a separate cover is secured to the housing 12 using one or more welds, rivets, clips, screws, other fasteners, welds, hot melt connections, adhesives and/or any other attachment method or device.

In some embodiments, the cover member 86 is coupled to the housing 12 with a pressure sensitive or peel-away adhesive sticker or other member. Such stickers or other removable cover members 86 can comprise one or more materials, such as, for example, metal, plastic, elastomers, paper and/or the like. In some embodiments, the cover member 86 includes identifying indicia, such as, for example, the model number and/or serial number of the blower 10, a date and/or place of manufacture, the manufacturer name and/or the like. In some embodiments, such configurations, including routing wires through channels 66 and the use of cover members 86, can provide an axially thinner design of the blower 10.

Exposed Backplate

As shown in FIG. 5, the blower 10 can include an exposed backplate 88. As used herein, the term "exposed" is a broad term and includes, without limitation, fully or partially open (e.g., to the outside of the housing). In some embodiments, at least a portion of the backplate 88 is exposed or open to the surroundings via an opening in at least one of the sides 14, 16 of the housing 12. As discussed in greater detail herein, the exposed backplate 88 can provide one or more advantages to the blower 10.

Many conventional blower designs endeavor to largely or completely enclose the blower components, for example to provide protection to such components. However, such a generally closed design can result in heat from the motor increasing the temperature of the blower components, which in turn can affect the accuracy, reliability, longevity, and/or other factors of the blower. Relatedly, excess heat generated and maintained within the housing 12 can be transferred to the air or other fluid passing through the blower, which can, for example, require additional energy consumption by conditioning devices (e.g., a TED) and/or lead to occupant discomfort.

In contrast, the exposed backplate 88 can provide a pathway for the enhanced dissipation of heat generated by the blower 10. For example, in some embodiments, heat generated by the motor 46 (and/or other internal components of the blower 10) can be transferred to the surroundings more efficiently via the exposed backplate 88, such as by more effective conduction, convection, radiation and/or other heat transfer methods. Thus, the blower 10 may be maintained at a reduced temperature, thereby increasing accuracy, reliability, longevity, and/or other factors of the blower 10, as well as reducing the need for further conditioning by conditioning devices (e.g., TED 34), and enhancing occupant comfort. Nevertheless, given the generally closed design of many conventional blower designs, exposing the backplate 88 of the blower 10 is a counterintuitive design approach.

As illustrated in FIG. 5, the backplate 88 can be positioned in, along or near the mounting aperture 68 of the housing 12. The mounting aperture 68 can include a recess or depressed region in the second side 16. In other instances, such as in the embodiment illustrated, the mounting aperture 68 comprises an opening passing fully through the second side 16.

In some embodiments, a bottom face or surface 90 of the backplate 88 can be sized, shaped and otherwise configured to mate with the PCB 44. Accordingly, heat can be transferred from the motor 46 to the backplate 88, from the motor 46 through the PCB 44 to the backplate 88 and/or through any other pathway. A top surface 92 of the backplate 88 can be exposed to the surroundings (e.g., ambient air) through the mounting aperture 68. In some embodiments, approximately 20-100% of the area of the top surface 92 of the backplate 88 is exposed. For example, in some embodiments, about 20-30%, 30-40%, 40-50%, 50-60%, 60-70%, 70-80%, 80-90% or 90-100% of the top surface 92 is exposed. In some embodiments, about 65-95% (e.g., 65%, 70%, 75%, 80%, 85%, 90%, 95%, etc.) of the area of the top surface 92 of the backplate 88 is exposed. In other arrangements, however, less than 20% of the surface is exposed, as desired or required.

In some embodiments, the mounting aperture 68 includes a periphery having a recess feature 69, such as a step, curve, chamfer, or otherwise. For example, as shown in FIG. 3, the recess feature 69 can include a step disposed about halfway through the axial thickness of the second side 16. In certain configurations, the recess feature 69 extends into the mounting aperture 68. In some embodiments, the recess feature 69 is configured to receive the backplate 88 and/or the PCB 44. Such a configuration can, for example, reduce the dimension that the backplate 88 and/or PCB 44 extend above the second side 16 (e.g., toward the first side 14), thereby allowing for the overall axial thickness of the blower 10 to be reduced.

In certain embodiments, the mounting aperture 68 and backplate 88 comprise, at least in part, a circular, curved or elliptical shape. However, the shape of the aperture 68 and/or the backplate 88 can be different, such as, for example, square, rectangular, triangular, other polygonal, irregular and/or the like. In addition, in the depicted arrangement, the backplate 88 fully or substantially fully spans or extends across the mounting aperture 68. However, in other embodiments, the backplate 88 is smaller than the mounting aperture 68 so as to allow for a space between at least a portion of the periphery of the backplate 88 and the mounting aperture 68.

According to some embodiments, an elliptical mounting aperture 68 has a major diameter of about 57 mm and a minor diameter of about 51 mm, while an elliptical backplate 88 has a major diameter of about 60 mm and a minor diameter of about 53 mm. In another embodiment, a circular mounting aperture 68 has a diameter of about 45 mm and the backplate 88 has a diameter of about 50 mm. In other arrangements, the shape of the mounting aperture 68 and the backplate 88 are generally rectangular. For instance, the dimension of the mounting aperture can be about 40 mm by 75 mm, while those of the backplate 88 can be about a 36 mm by 73 mm. In other embodiments, the shape, size and/or other characteristics of the mounting aperture 68, backplate 88 and/or other components of the blower 10 can be different than disclosed herein.

The backplate 88 can comprise one or more materials that provide sufficient strength to support and/or protect the PCB 44, motor 46 and/or any other components of the blower 10. In some embodiments, the backplate 88 comprises a material or a material mix having a thermal conductivity greater than the heat conductivity of air. The backplate 88 can comprise one or more metals and/or alloys, such as, for example, steel, iron, lead, copper, brass, silver, aluminum and/or the like. The specific materials can be selected based on target design values for heat conductivity, strength, durability and/or other factors.

According to some embodiments, the backplate 88 comprises one or more insulating materials or features. Such configurations can help inhibit or reduce the transfer of heat to or from selected areas of the blower 10. For example, in a fluid module configured to provide only heated air to a seating assembly, the blower 10 can comprise an insulating backplate 88 that promotes and enhances heat transfer to air passing through the blower 10. Thus, in such arrangements, it may not be advantageous to increase the dissipation or transfer of heat through the backplate 88.

As noted herein, the backplate can have any shape, size (e.g., dimensions, thickness, etc.) and/or other characteristics or properties in accordance with a specific design. By way of example, in some embodiments, the backplate 88 is approximately 0.2-5.0 mm thick (e.g., 0.2-0.3 mm, 0.2-1.0 mm, 0.2-2.0 mm, 1.0-3.0 mm, 3.0-5.0 mm, values between such ranges, etc.). In other embodiments, the thickness of the backplate 88 is greater than 5.0 mm or smaller than 0.2 mm, as desired or required.

According to some arrangements, increased heat transfer can allow the motor 46, PCB 44, and/or any other components within the blower 10 to operate at a lower temperature. As noted above, such configurations improve the operation of the blower 10, improve its reliability, increase its durability and/or provide other benefits and advantages. Increased heat transfer away from the blower 10 (e.g., out of the housing 12) can allow the motor 46 to be operated at a higher power level. In some embodiments, such increased heat transfer can allow the blower 10 to use a more powerful motor 46. For any of the embodiments disclosed herein, the PCB 44 can form a unitary or monolithic structure with the backplate. Alternatively, however, the PCB 44 and backplate 88 can be separate items that are secured to one another using one or more attachment methods or devices.

PCB Component Arrangement

Figure 6:
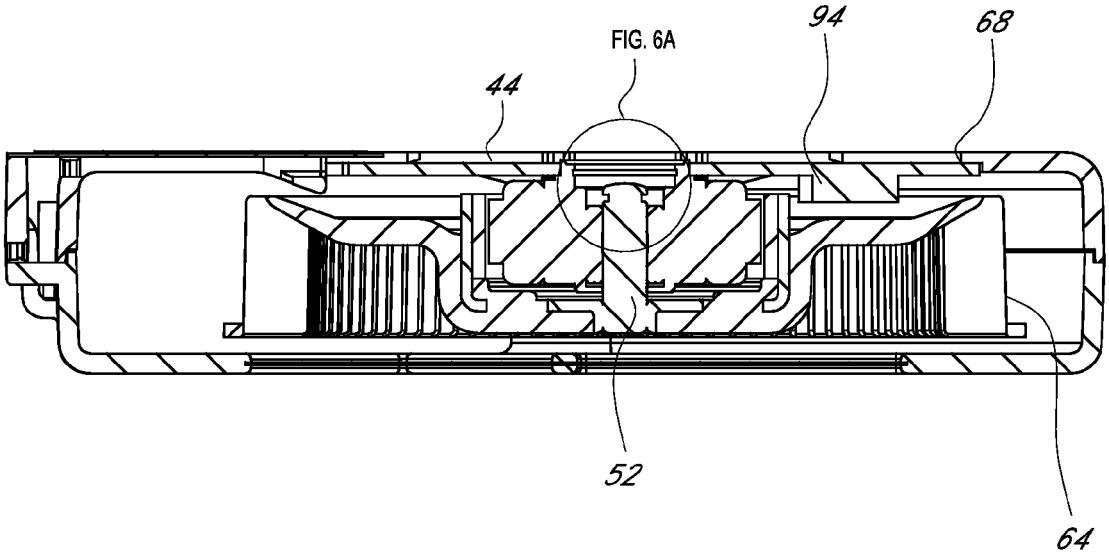
FIG. 6 illustrates a cross-sectional view along the line 6-6 of the embodiment of FIG. 5, including a containment system.

In order to increase the capacity or fluid flow output of a blower 10, it may be desirable to make certain modifications to the design of an impeller 48. For example, the size (e.g., axial height, radial width, and/or circumferential thickness) of the blades 64 can be increased as long as the blades and any other portions of the impeller do not interfere with other components of the blower 10, such as, for example, the PCB 44, the housing and/or the like. In some embodiments, as shown in FIG. 6, the periphery of the impeller 48 can angle toward the PCB 44 to generally increase the size of the blades 64. The PCB 44 can comprise a variety of electronic components 94 that extend upwardly from the PCB 44 to increase the overall PCB 44 height.

In certain conventional blowers, the electronic components 94 are arranged on the PCB with limited or no regard for the component's height. In certain such cases, the blades 64 of the impeller 48 are configured to avoid interference with the electronic component 94. For example, the blades 64 can be made smaller (e.g., in the axial direction) to provide axial clearance between the blades 64 and the tallest of the electronic components 94. Thus, in some such instances, the presence of even just a single abnormally "tall" electronic component 94 can limit the size of the blades 64.

Accordingly, in some embodiments, the electronic components 94 are strategically located or otherwise arranged along the PCB 44 in a manner that allows the use of an impeller 48 having relatively larger blades 64. Thus, the blower 10 with such a PCB 44 and impeller design can be adapted for increased fluid flow to one or more downstream components. For example, in some embodiments, the electronic components 94 are arranged such that the taller or tallest electronic components 94 are positioned at or near the axial center of the PCB 44, while the shorter electronic components 94 are arranged at or near the periphery of the PCB 44. In certain such embodiments, the taller electronic components 94 are those electronic components 94 projecting above the PCB 44 about 2.0 mm of more. In some instances, the taller electronic components 94 are those electronic components 94 projecting above the PCB 44 about 1.0 mm or more. In some cases, the taller electronic components 94 are those electronic components 94 projecting above the PCB 44 about 0.5 mm or more. In some arrangements, the distance from the center of the PCB 44 to the nearest point of each of the three tallest electronic components 94 is no more than about 15 mm (e.g., in embodiments where the blower 10 comprises a motor yoke diameter of about 30 mm).

In some embodiments, for motors of larger and smaller yoke diameters, the nearest point of the tallest electronic components scales approximately linearly. For example, for motors of approximately 60 mm diameter, the nearest point of the tallest of the components 94 can be no more than about 30 mm. In some arrangements, the taller or tallest of the electrical components 94 are placed generally underneath the motor yoke (e.g., the area under the upper portion 58 of the impeller 48). In such embodiments, the tallest of the components 94 could be placed even closer to the center of the PCB 44.

In certain embodiments, the taller or tallest of the components 94 are positioned in the air or fluid flow path. For example, certain of the components 94 can be positioned radially outward of the impeller blades 64. Such a configuration can, for example, enhance heat transfer to or from such of the components 94, which in turn can allow the blower 10 to be operated at a higher level (e.g., a high power level) thereby providing additional fluid flow.

Furthermore, unlike some conventional blowers that employ bumps, shoulders, or other discontinuities in the lower portion of the impeller, in some embodiments of the blower 10, the lower disc-shaped portion 62 is substantially planar. Such a configuration can, for example, provide a smoother transition as fluid transitions from the annular portion 60 to the lower disc-shaped portion 62, thereby reducing noise and/or vibration.

Motor Base

Figure 6A:
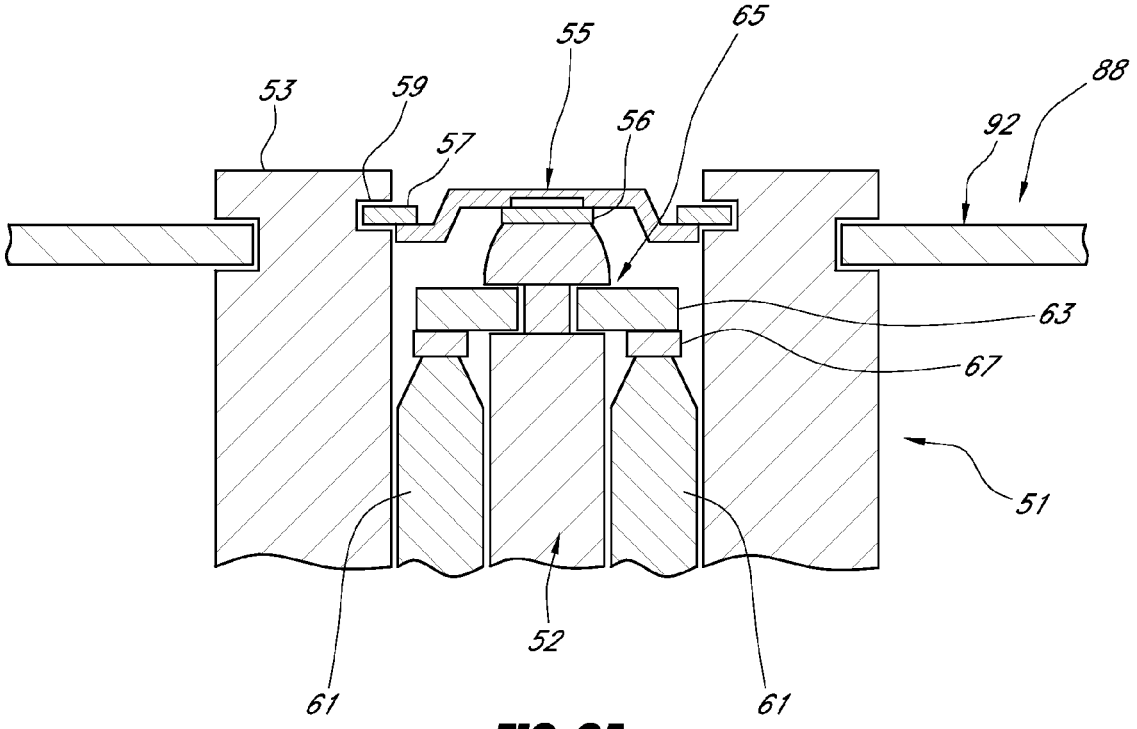
FIG. 6A illustrates a focused view of the containment system of the embodiment of FIG. 6.

With reference to FIG. 6A, a cross section of the motor 46 is illustrated to demonstrate some of the features of a motor base that can provide one or more advantages and benefits. For example, the shaft 52 of the motor 46 can be positioned at least partly within a containment system 51, which penetrates, at least partially, the backplate 88 of the motor 46. Such a configuration can, for example, reduce the axial thickness of the blower 10 by minimizing or reducing the axial distance that the containment system 51 protrudes above the top surface 92 of the backplate 88.

The illustrated embodiment of the containment system 51 comprises a hollow member 53, thrust cover 55, and holding member 57. As shown, the hollow member 53 can be shaped as a cylinder with a groove 59 (e.g., an annular groove) at or near one end. However, the hollow member 53 can have other shapes and/or configurations, such as a cross-section that is square, rectangular, other polygonal, oval, or irregular, or otherwise having a non-cylindrical shape. In some instances, the hollow member 53 is monolithically formed. In other instances, the hollow member 53 includes a plurality of individual members connected together. In some arrangements, the hollow member 53 is only partially hollow (e.g., a portion of the hollow member 53 is not hollow).

The hollow member 53 can comprise one or more materials that provide sufficient strength and rigidity to support the shaft 52, such as, for example, metals, alloys, ceramics, thermoplastics, other natural or synthetic materials, combinations thereof and/or the like. In some embodiments, the hollow member 53 is made of brass. However, the hollow member 53 can include steel, aluminum, copper, another metal or alloy and/or any other material, either in lieu of, or in addition, to brass.

As shown, the hollow member 53 can receive the holding member 57. The holding member 57 can include a retaining ring (e.g., a c-clip, e-clip, spiral retaining ring, or otherwise) or other member or feature configured to maintain the position of the thrust cover 55 relative to the hollow member 53 and/or the shaft 52. In the illustrated embodiment, the thrust cover 55 comprises a metal or plastic, solid or partially solid, member with a raised portion near its center. In other embodiments, the thrust cover 55 is substantially flat. In certain configurations, the thrust cover 55 is recessed within the hollow member 53, such that the thrust cover 55 does not protrude above the hollow member 53. Various ways can be employed to position the thrust cover 55 in the hollow member 53, such as with a slip, press, interference fit, and/or the like. In some embodiments, the thrust cover 55 is separated from the shaft 52 by a thrust distribution member 56. The thrust distribution member 56 can be, for example, a metal or plastic washer.

In certain embodiments, the topmost side of containment system 51 is approximately coplanar with the second surface 20 of the second side 16 of the housing 12. For instance, the topmost side of the hollow member 53 and/or the thrust cover 55 can be approximately coplanar with the second surface 20. In such embodiments, the axial distance that the containment system 51 protrudes above the top surface 92 of the backplate 88 can reduced or minimized. Thus, such a configuration can, for example, reduce the axial thickness of the blower 10.

In some embodiments, the containment system 51 also includes a bearing 61, which can facilitate rotation of the shaft 52. The bearing 61 can have various configuration, such as a roller bearing, sintered bearing, bushing, lubrication, or otherwise. As shown, the bearing 61 can be positioned between the hollow member 53 and the shaft 52. In certain of such instances, the bearing 61 is at least partially restrained by an annular member 63 (e.g., a c-clip, e-clip, spiral retaining ring, or otherwise) or the like, which in turn can be received in an indentation 65 in the shaft 52. In some arrangements, a spacer 67 (e.g., a metal or plastic washer) is positioned between the annular member 63 and the bearing 61.

According to some embodiments of the processes for manufacturing the blower 10, the hollow member 53 is swaged with the backplate 88. In some such instances, the shaft 52 is positioned through the hollow member 53. In certain arrangements, the bearing 61, spacer 67, and annular member 63 are positioned in the hollow member 53 as well. Also, the thrust distribution member 56 can be positioned on the shaft 52. In certain embodiments, the thrust cover 55 is placed and the holding member 57 is inserted into the groove 59. Furthermore, in certain embodiments, glue, epoxy, or other material is introduced into an axial indentation between the thrust cover 55 and the topmost side of the hollow member 53 to provide additional sealing and retention. Other embodiments of the manufacturing processes can include more or fewer steps, which may be the same or different than those discussed above, as desired or required.

As noted above, other configurations of a containment system 51 are contemplated. For example, the containment system 51 can include a hollow rectangular tube, the thrust cover 55 can include a generally frustoconical shape, and the holding member 57 can comprise a weld, fastener (e.g., screw), adhesive (e.g., glue or epoxy), and/or otherwise. In certain embodiments, the hollow member 53 is at least a part of a stator of the motor 46. In the depicted embodiment, the hollow member 53 is swaged with the backplate 88, while the holding member 57 is restrained by the holding member 57. However, other methods of coupling the various components to one another are contemplated, as is desired or required.

Thermoelectric Device

Figure 7:
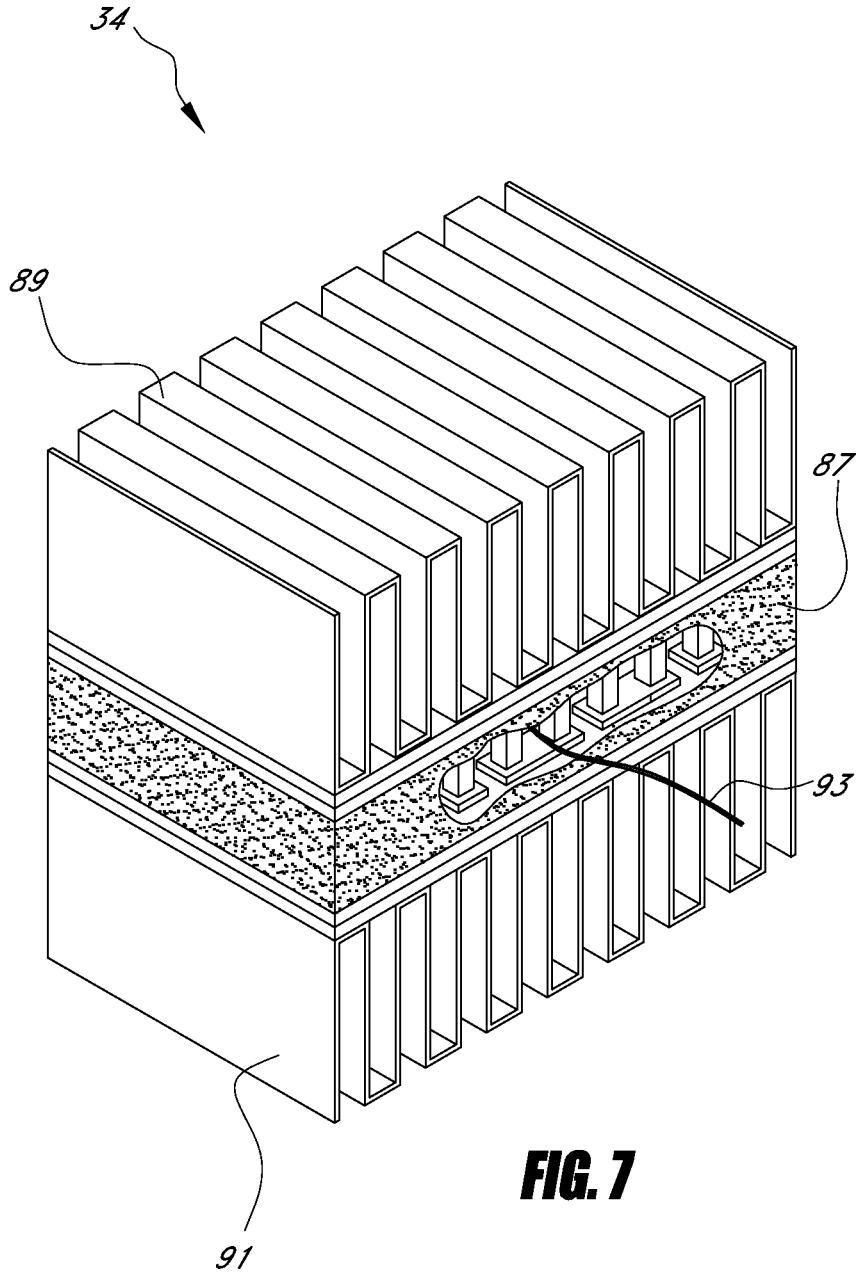
FIG. 7 illustrates a perspective view of an embodiment of a thermoelectric device.

An embodiment of a TED 34 is illustrated in FIG. 7. The TED 34 can comprise a Peltier thermoelectric module 87 that is positioned between a main heat exchanger 89 for transferring or removing thermal energy from the fluid flowing through the module and a waste heat exchanger 91 generally opposite the main heat exchange 89. Accordingly, in one embodiment, the fins or pin arrays on the lower and upper portions of the housing are used to control the flow of air to either the main heat exchanger 89 or the waste heat exchanger 91. In such arrangements, the main and waste heat exchangers 89, 91 are positioned generally on the upper or lower side of the housing opposite each other. In various embodiments, the TED 34 is electrically coupled with a power source (not shown) via a wire 93 or the like. Additional details and disclosure regarding TEDs are provided in, inter alia, U.S. Pat. No. 7,587,901 and U.S. Patent Publication Nos. 2008/0087316, 2008/0047598, 2008/0173022, and 2009/0025770, all of which are hereby incorporated by reference herein.

In some embodiments, the TED 34, or multiple TEDs 34, can be mounted so as to selectively condition (e.g., heat, cool, etc.) and transfer (e.g., to one or more downstream locations) air or other fluids. As used herein, the terms "cooling side," "heating side," "cold side," "hot side", "cooler side" and "hotter side" and the like do not indicate any particular temperature. Rather, such terms are relative terms and are included to facilitate the understanding of the disclosure provided herein. For example, the "hot," "heating" or "hotter" side of a thermoelectric element or array may include an ambient temperature, while the "cold," "cooling" or "cooler" side may include a temperature that is simply colder than ambient. Conversely, the "cold," "cooling" or "cooler" side may include an ambient temperature, while the "hot," "heating" or "hotter" side may include a temperature that is hotter than ambient. Thus, the terms are relative to each other to indicate that one side of the thermoelectric device is at a higher or lower temperature than the opposite side.

The TED 34 can be positioned at or near the outlet 32 of the blower 10 to condition the air or other fluid being passed therethrough and being delivered to a seat, bed, other occupant support assembly, and/or another target device or location in need of selective thermal conditioning. In other embodiments, the TED 34 is located at the inlet 26 of the blower 10. Further, the TED 34 can be positioned at, along, or near the sidewall 22. In some arrangements, a TED 34 is directly or indirectly coupled to the PCB 44.

In some embodiments, the housing 12 comprises one or more vanes for directing the flow of fluid across the TED 34. In some embodiments, the vanes are sized, spaced and otherwise configured to equalize or substantially equalize the distribution of fluid across the inlet of the TED 34. Thus, the efficiency of the heat exchange process can be increased and the durability of TED 34 can be improved. Further details concerning vanes and fluid flow distribution are provided below in connection with FIGS. 19-25.

Snap-Fit PCB

Figure 8:
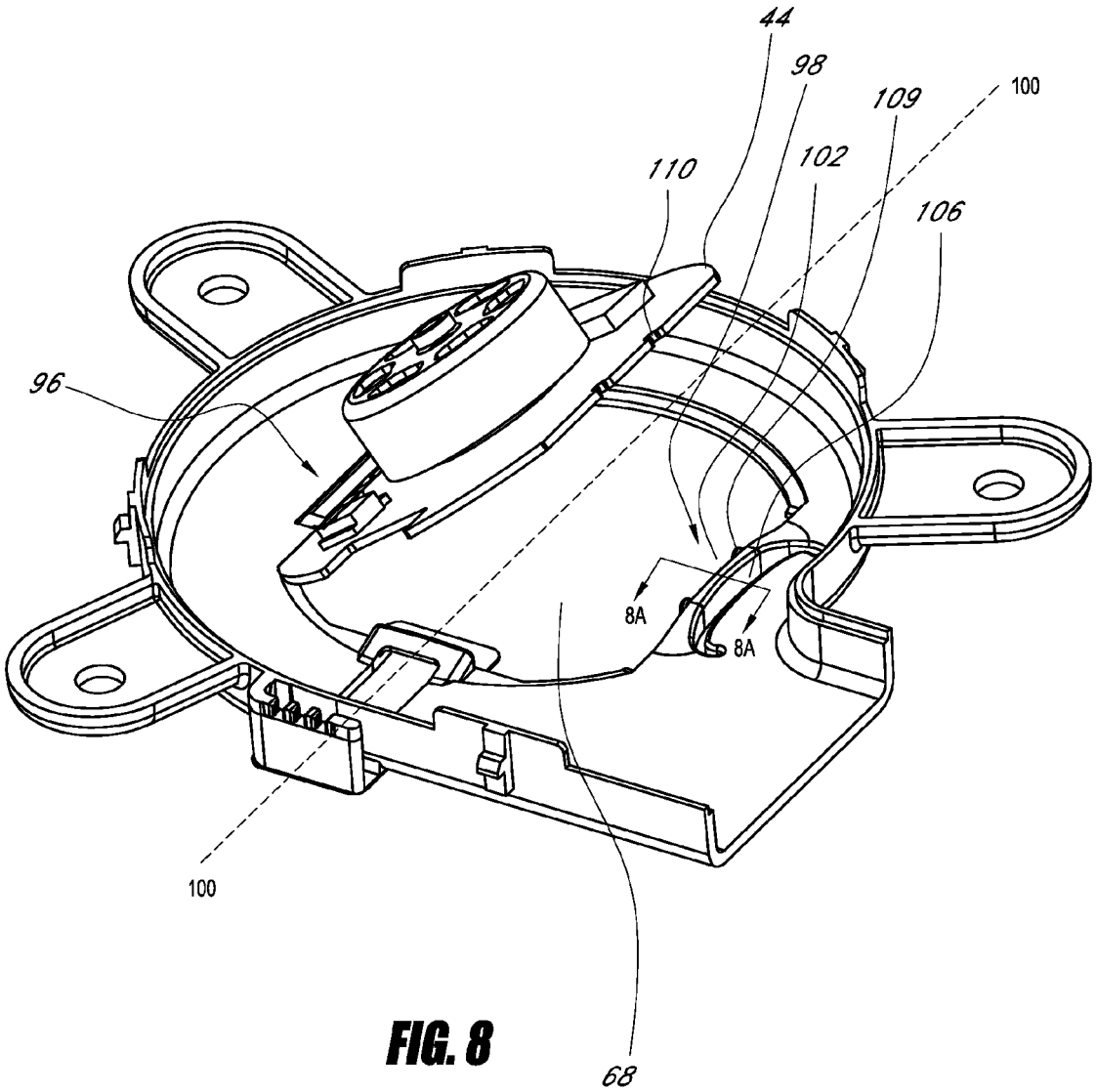
FIG. 8 illustrates a perspective view of an embodiment of the second side of the housing of FIG. 3, wherein the second side is configured to receive a circuit board.

With reference to FIG. 8, an arrangement for coupling the PCB 44 to the housing 12 is illustrated. Among other benefits and advantages, such a configuration can provide a relatively simple method for attaching the PCB 44 to the housing 12, without the need for additional components or fasteners. In addition, the illustrated configuration can provide an audible confirmation or recognition of attachment (e.g., using a click or other sound). Thus, improper attachment of the PCB 44 with the housing 12 can be recognized and detachment of the PCB 44 from the housing 12 can be avoided.

In some embodiments, the PCB 44 is coupled with the second side 16 of the housing 12. In some such embodiments, the second side 16 includes the mounting aperture 68 having a centerline 100. As previously noted, the mounting aperture 68 can comprise a recess or depressed region in the second side 16 or can comprise an opening passing fully through the second side 16.

In some embodiments, the second side 16 of the housing 12 includes a first mounting member 96 and a second mounting member 98. In some embodiments, the first mounting member 96 comprises a hinge, slot, boss, step, shelf, ledge, or the like located at or near the periphery of the mounting aperture 68. As shown, the first mounting member 96 can project into the mounting aperture 68. According to some arrangements, the first mounting member 96 provides a base on which to rest the PCB 44 during assembly and/or to assist in positioning the PCB 44 during coupling the PCB 44 with the second mounting member 98.

In certain embodiments, the second mounting member 98 comprises a strut 102 and a hook 104. The strut 102 and hook 104 can be configured engage the PCB 44. For example, strut 102 and hook 104 can to deflect and snappedly couple with the PCB 44. In some embodiments, the snap-back of the strut 102 from the deflected position produces an audible sound, which can signal that proper or adequate attachment of the PCB 44 to the housing 12 has occurred. In the illustrated embodiment, the second mounting member 98 is positioned on or along the opposite side of the mounting aperture 68 relative to the first mounting member 96. However, in other embodiments, the second mounting member 98 is adjacent to the first mounting member 96. In yet other embodiments, the PCB 44 comprises at least one of the mounting members 96, 98.

In some embodiments, the one or both of the first and second mounting members 96, 98 have a guide member 109. The guide member 109 can be sized, shaped, positioned, and/or otherwise configured to be selectively received within a corresponding notch 110 of the PCB 44. For example, the illustrated guide member 109 includes a radially extending wing and the notch 110 includes a cut-out section at the periphery of the PCB 44. The guide member 109 and corresponding notch 110 can, for example, assist in locating the PCB 44 within the mounting aperture 68 and provide strength and support to the PCB 44.

In various embodiments, the first and second mounting members 96, 98 are configured to engage the PCB 44. Such engagement can, for example, reduce the likelihood of detachment of the PCB 44 from the housing 12. Further, the first and second mounting members 96, 98 can be configured to assist in aligning and positioning the PCB 44 in the mounting aperture 68. For example, in some embodiments, one side of the PCB 44 is initially positioned on the first mounting member 96, then the PCB 44 is rotated about an axis disposed approximately along the first mounting member 96. In such cases, the PCB 44 is rotated toward the second mounting member 98. In certain arrangements, such rotation of the PCB 44 can continue until the PCB 44 and the second mounting member 98 engage, such as with a snap connection. Of course, other embodiments employ engagement methods other than a snap connection, such as a press-fit, adhesive, fasteners (e.g., screws), thermal or sonic staking, welding (e.g., ultrasonic), or otherwise.

Figure 8A:
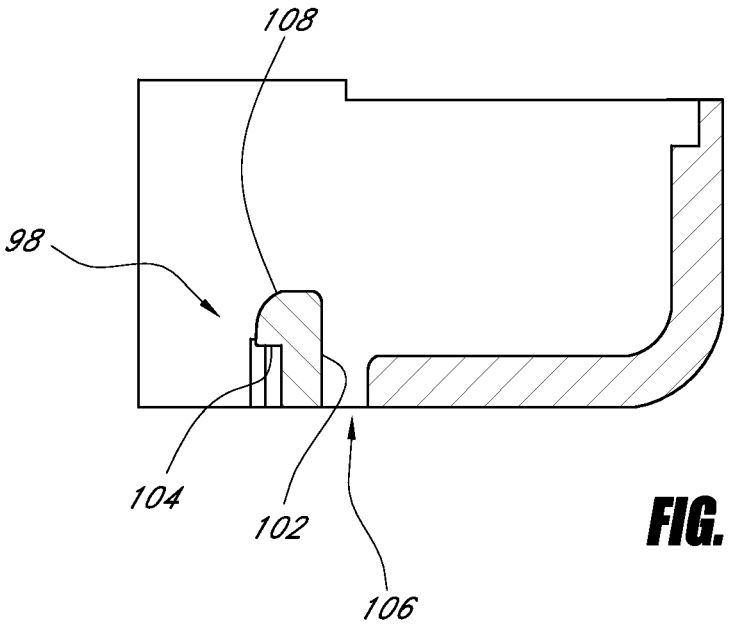
FIG. 8A illustrates a cross-sectional view along the line 8A-8A of the embodiment of FIG. 8, including a strut with a hook.

In some embodiments, the strut 102 is adapted to be more rigid in the axial direction than in the radial direction. Accordingly, in such a configuration, the strut 102 can more easily deflect in the radial direction than in the axial direction. For example, as illustrated in the cross-sectional view of FIG. 8A, the strut 102 can have a greater axial dimension than radial dimension. This can permit the strut 102 to bend more easily in the radial direction than in the axial direction. In some embodiments, the cross-sectional axial dimension of the strut 102 decreases and/or the radial dimension of the strut 102 increases as a function of distance from the centerline 100. Such a varying cross section of the strut 102 can, for example, reduce the likelihood of interference between the strut 102 and the impeller 48.

To facilitate deflection of the strut 102, the second side 16 of the housing 12 can comprise or otherwise define a void 106. For example, the void 106 can be configured to allow at least a portion of the strut 102 to deflect into the void 106 during the coupling of the PCB 44 with the housing 12. The void 106 can include most any size and shape. For example, as illustrated, the void 106 can comprise a bracket-like shape. Indeed, such a shape can be particularly beneficial by reducing stress concentrations. In alternative embodiments, one or more other features facilitate deflection of the strut 102, such as bellows, springs, slots, soft regions in the housing 12, and/or otherwise.

Figure 8B:
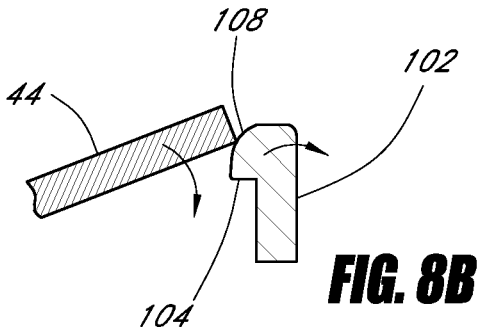
FIGS. 8B and 8C illustrate schematic views of the circuit board of FIG. 8 being snapped into the strut of FIG. 8A.
Figure 8C:
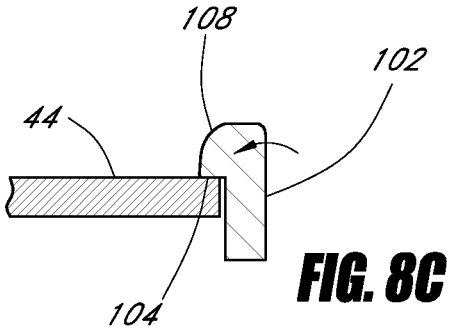

With reference to FIGS. 8B and 8C, the hook 104 can be configured to allow the PCB 44 to slide along a rounded, chambered, or angled face 108 before snapping or otherwise positively engaging into the second member 98. In some embodiments, after the PCB 44 has snapped into or otherwise engaged the second mounting member 98, removal of the PCB 44 can be inhibited or prevented, for example, by the hook 104. In the depicted embodiment, the hook 104 is located on or near the strut 102. This configuration can benefit from the above-described axial rigidity of the strut 102 to discourage removal of the PCB 44. In other embodiments, the hook 104 is separated or positioned apart from the strut 102.

Of course, alternate embodiments employ other strategies for connecting the PCB 44 and/or the backplate 88 with the housing 12. For example, in some arrangements, the backplate 88 is connected to the second side 16 with fasteners (e.g., screws, rivets, or the like), adhesive, press-fit, or otherwise. Furthermore, in certain embodiments, the housing 12 does not include a mounting aperture 68. Nonetheless, in some such embodiments, the PCB 44 and/or the backplate 88 connect with housing 12, such as with a snap connection (e.g., similar to the snap connection described above), fasteners, adhesive, press-fit, or otherwise.

Sweeping Impeller

Certain conventional blowers can include a discontinuity (e.g., in shape) between the periphery of the impeller and the housing. Such conventional designs can cause unwanted turbulence and/or noise as fluids are transferred between the impeller and the housing. In contrast, a blower 210 includes a generally smooth transition between a housing 212 and an impeller 248. In many respects, the blower 210 is identical or similar to (and can include any or all of the features and components of) the blower 10 discussed above, with some of the differences discussed below.

Figure 9:
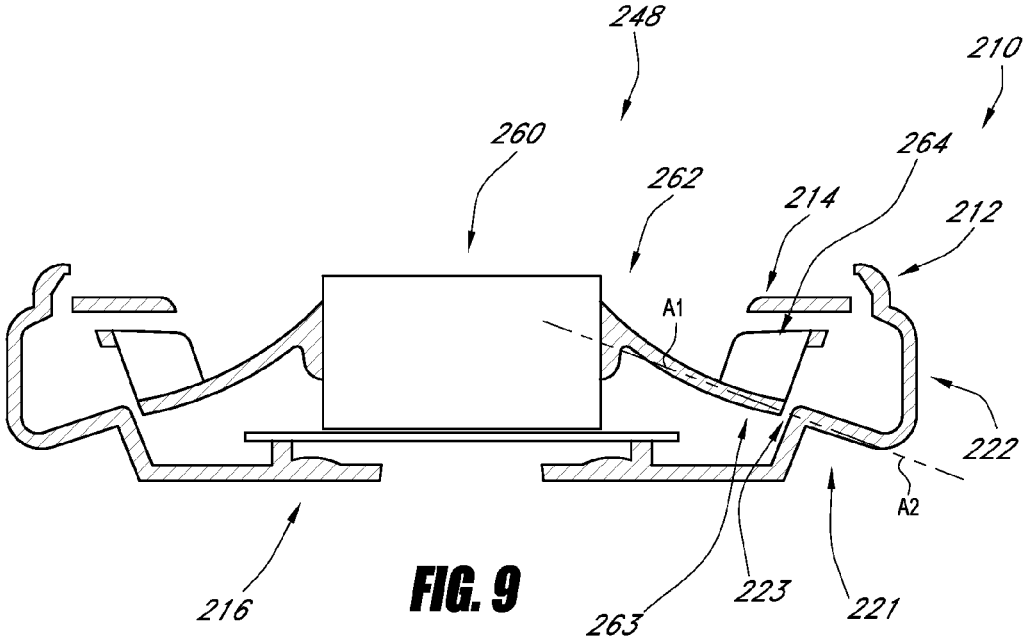
FIG. 9 illustrates a cross-sectional view of an embodiment of a blower with a sweeping impeller.

As illustrated in FIG. 9, in some embodiments, the blower 210 includes a generally smooth transition between an outer periphery of the impeller 248 and an adjacent lower surface of the housing 212. Such a design or configuration is referred to as a "sweeping impeller." The sweeping impeller configuration can, for example, decrease turbulence in the air or fluid that is passed between the impeller 248 and the housing 212. In turn, such a decrease can, for example, increase the efficiency of the blower 210, reduce the amount of noise and vibration generated by the blower 210, and/or provide one or more other benefits.

In some embodiments, the impeller 248 includes a central portion 260, an arm portion 262 that extends radially outward from the central portion 260, and a plurality of blades 264 disposed at or near the periphery of the arm portion 262. In other arrangements, the impeller 248 has one or more other components or features, as desired or required for a particular application or use.

In certain embodiments, at least a portion of the arm portion 262 is generally straight (e.g., linear). In certain instances, at least a portion of the arm portion 262 is curved. The arm portion 262 can be horizontal (e.g., generally parallel with the second side 216, the backplate (not shown), etc.) or non-horizontal (e.g., generally sloped or angled relative to the second side 216, backplate, etc.). In some embodiments, the arm portion 262 forms a generally unitary structure with the central portion 260. Alternatively, the arm portion 262 can be a separate component that is subsequently coupled (e.g., removably or permanently) to the central portion 260. The arm portion 262 can comprise any other form or geometry, as desired or required.

Generally, the arm portion 262 includes a peripheral or radial end 263. In some such embodiments, regardless of the exact configuration and geometry of the arm portion 262, the housing 212 includes a portion having a surface that is immediately adjacent to the peripheral or radial end 263 and generally matches the slope or angle of the arm portion 262 that is at or near the peripheral or radial end 263.

In some embodiments, the housing 212 comprises a first side 214, second side 216, and a sidewall 222. As shown, the sidewall 222, second side 216, and/or other portion of the housing 212 can be shaped such that an adjacent segment 221 of the housing 212 is parallel or substantially parallel with the lower surface of the peripheral portion of the arm portion 262 of the impeller 248. The adjacent segment 221 is radially spaced from the base 216 with a particular clearance in order to help avoid interference between the impeller 248 and the second side 216.

As shown in FIG. 9, in certain embodiments, the peripheral portion of the arm portion 262 is generally oriented along a first axis A1. In some such instances, the adjacent segment 221 of the housing 212 is generally oriented along a second axis A2. In some embodiments, the axes A1, A2 are approximately parallel or substantially parallel to each other. The axes A1, A2 can be generally aligned along a single linear or curved plane, either in addition to or in lieu of being parallel or generally parallel to one another. For example, in certain embodiments, the axes A1, A2 are substantially collinear. Alternatively, the first and second axes A1, A2 can be configured to diverge in relative slope, for example, by about 0-30°. In other embodiments, the angles (with respect to a line parallel with the axis of rotation of the impeller 248) of the first and second axes A1, A2 diverge by about 0-10° (e.g., 0°, 0.1°, 0.2°, 0.3°, 0.4°, 0.5°, 0.6°, 0.7°, 0.8°, 0.9°, 1.0°, 1.5°, 2°, 3°, 4°, 5°, 6°, 7°, 8°, 9°, 10°, values between such ranges, etc.). In other embodiments, the angles of the first and second axes A1, A2, are exactly or nearly identical to each other.

Figure 9A:
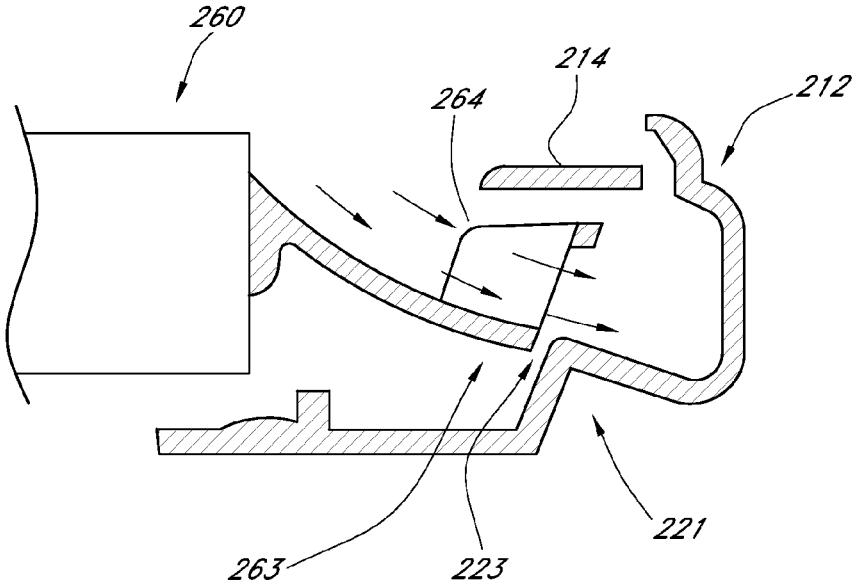
FIG. 9A illustrates a focused view of the blower of FIG. 9.

As illustrated in FIG. 9A, in some embodiments, a gap 223 separates the peripheral or radial end 263 of the arm portion 262 of the impeller 248 from the adjacent segment 221 of the housing 212. Generally, during operation of the blower 10, air or other fluid is transferred across the gap 223 from the impeller 248 to the housing 212. In certain embodiments, the impeller 248 and housing 212 are configured to reduce or minimize the size of the gap 223. Such a configuration can, for example, reduce noise, vibration, and/or frictional losses during operation of the blower 10 and/or offer one or more other benefits or advantages. In some embodiments, the gap 223 is about 0.1 mm to about 5 mm, such as approximately 0.1 mm, 0.2 mm, 0.3 mm, 0.4 mm, 0.5 mm, 0.6 mm, 0.7 mm, 0.8 mm, 0.9 mm, 1.0 mm, 1.5 mm, 2.0 mm, 2.5 mm, 3.0 mm, 3.5 mm, 4.0 mm, 4.5 mm, 5.0 mm, distances greater than 5 mm, values between such ranges, etc. On the other hand, some embodiments have substantially no gap 223. For example, one of the impeller 248 and the housing 212 can include a skirt (e.g., rubber, brushes, or otherwise) that contacts the other of the impeller 248 and the housing 212. Thus, in such cases, the gap 223 is substantially eliminated.

In some embodiments, the peripheral end 263 of the arm portion 262 can have a lower surface that is generally linear or straight or approximately linear or straight. However, the arm portion 262 can include one or more other shapes or geometries, such as concave, convex, pointed, angled, frustoconical and/or the like. Also, in the illustrated embodiment, the portion of the adjacent segment 221 nearest the gap 223 is bent or angled at approximately 90°. However, in other embodiments, the adjacent segment 221 has a different shape or configuration, such as straight, curved, acutely angled, obliquely angled, or otherwise.

According to some embodiments, the blower 210 having a "sweeping impeller" operates as indicated below. The impeller 248 can be rotated by the motor, thereby drawing air or other fluids through one or more inlets that are defined or otherwise included in the housing 212. The air or other fluid can travel along the length of the arm portion 262 toward the blades 264 of the impeller. At least some of the air or fluid can be moved across the gap 223 and toward the sidewall 222. As discussed in greater detail herein, the interface between the impeller 248 and the adjacent portion of the sidewall can be configured to avoid or reduce a discontinuity with the arm portion 262. Thus, at least some of the air or fluid can proceed across the gap 223 and toward the sidewall 222 with a reduced level of turbulence (e.g., in a substantially laminar fashion), thereby increasing the efficiency of the blower 210 and/or reducing the volume of noise. In certain embodiments, the air or fluid proceeding toward the sidewall 222 can create a higher-pressure region between the blades 264 and the sidewall 222. Such higher-pressure air or fluid can be passed to one or more conditioning devices (e.g., a TED 34) and through one or more outlets (not shown) in the housing 212.

Humidity Sensing

Under conditions where the humidity of the ambient air is relatively high, the performance of a fluid module, which in certain arrangements incorporates various embodiments of the blower disclosed herein, can be negatively affected. For example, if the relative humidity (RH) is above a particular level, excess condensation can accumulate between the fins or other heat transfer members that are in thermal communication with one or more thermoelectric devices. Thermoelectric devices can be positioned downstream or upstream of the blower. Such partial or complete blocking of the fin openings by water droplets can lead to poor or diminished heat transfer and/or fluid flow. The blocking of fins or other heat transfer members can be exacerbated when an occupant of a climate controlled seat assembly (e.g., vehicle seat, other type of chair, bed, etc.) permits a constant stream of humid ambient air to enter the environment in which the fluid module is located (e.g., by opening a window to a vehicle, room, etc.).

According to some embodiments, at least some of the negative effects of such relatively high humidity conditions can be mitigated by monitoring one or more inputs or conditions associated with the operation of the thermal module. In other arrangements, mitigation of such negative effects can be accomplished by controlling the duty cycle of the thermoelectric device of the fluid module such that increased or maximum thermal conditioning occurs without achieving dew point conditions, either in lieu of or in addition to monitoring inputs or conditions.

Figure 10A:
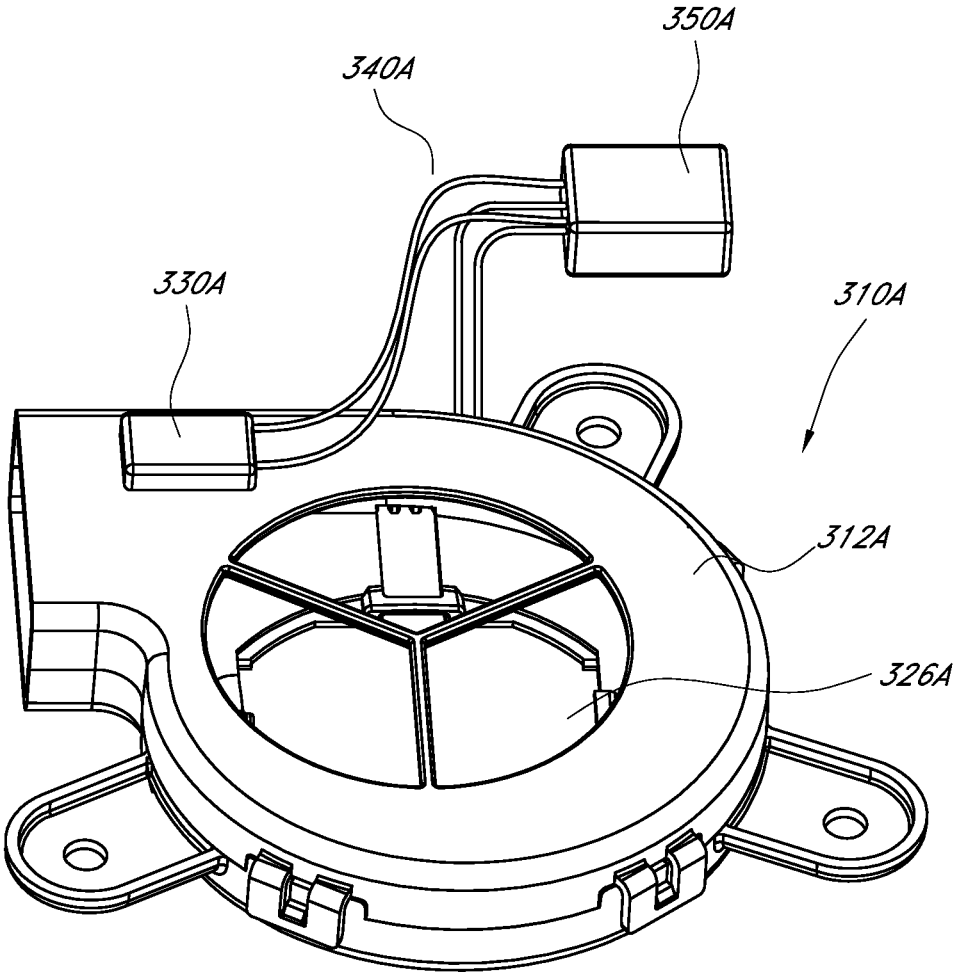
FIGS. 10A-10C illustrate various embodiments of a blower comprising a relative humidity sensor.
Figure 10B:
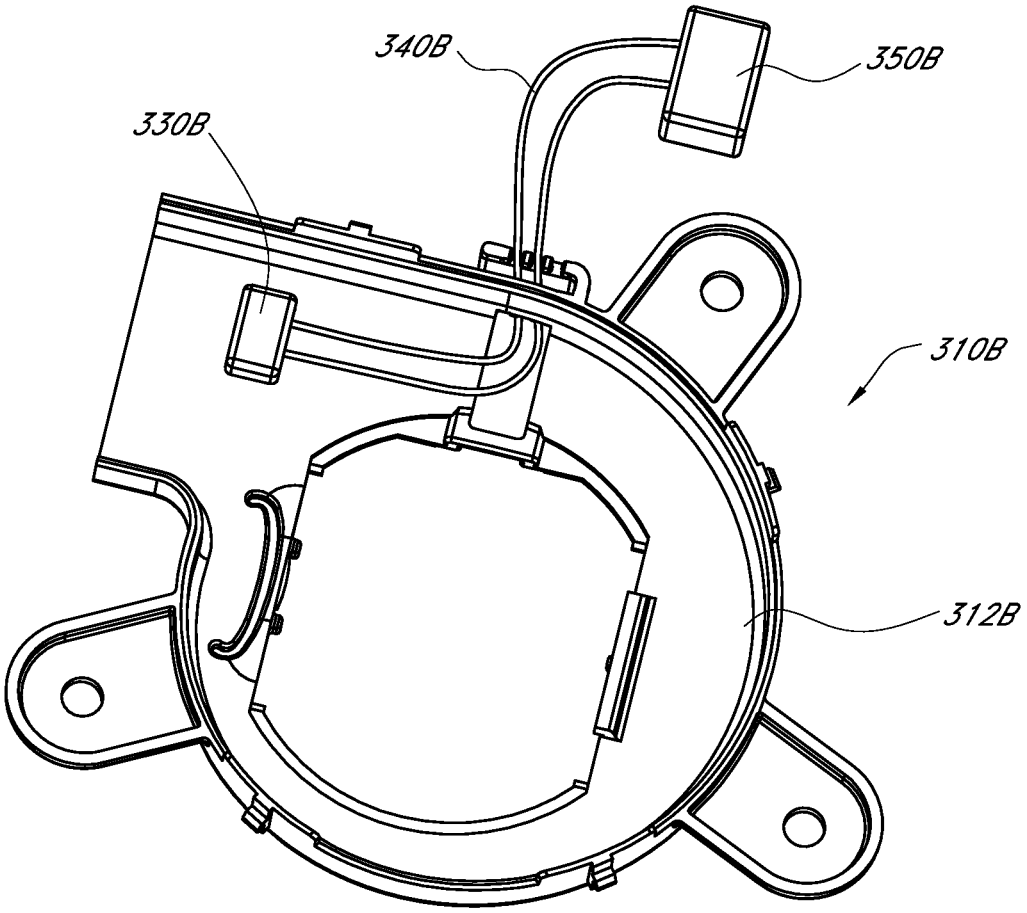
Figure 10C:
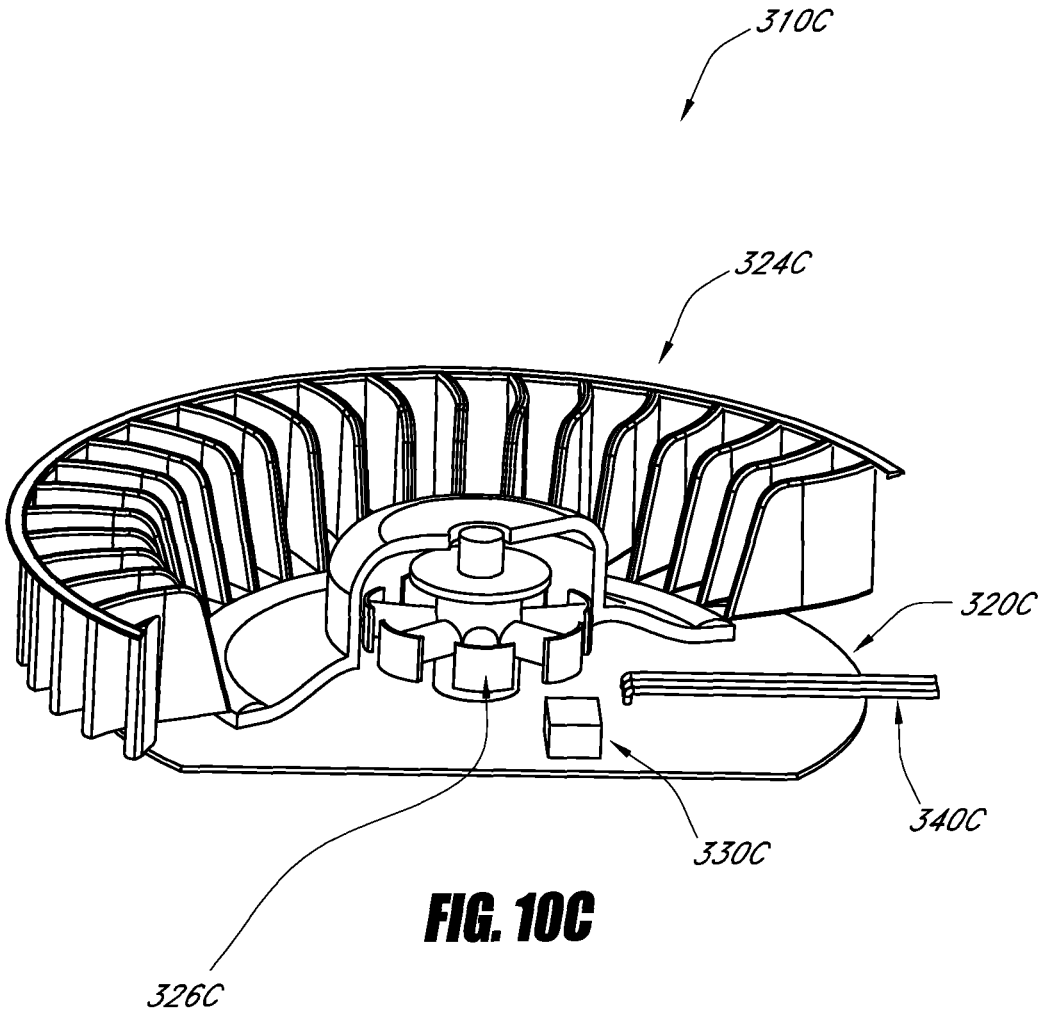

FIGS. 10A through 10C illustrate various embodiments of a relative humidity (RH) sensor 330A, 330B, 330C positioned relative to a corresponding blower 310A, 310B, 310C. In many respects, the blowers 310A, 310B, 310C are identical or similar to (and can include any or all of the features and components of) the blowers discussed above, with some of the differences discussed below.

As shown in FIG. 10A, one or more sensors 330A can be positioned along an exterior of the blower housing 312A. As discussed in greater detail herein (e.g., with reference to the arrangements illustrated in FIGS. 18A-18D), the sensor 330A can be located near the inlet 326A of the blower 310A, so that a representative measurement of the relative humidity of the air entering actually entering the blower can be obtained.

Alternatively, however, a humidity sensor can be positioned along any other portion of the blower, either in lieu of or in addition to an exterior surface of the housing. By way of example, in FIG. 10B, a relative humidity sensor 330B is secured to an interior surface of the blower housing 312B. In some arrangements, as noted above with reference to FIG. 10A, the sensor 330B can be advantageously located at or near the blower inlet 326B in order to more accurately measure the humidity of the air that actually passes through the inlet. In any of the embodiments illustrated and/or described herein, one or more wires 340A-340B attach to the sensor 330A-330B and/or any other electrical component (e.g., printed circuit board) and can terminate in an electrical coupling 350A-350B, facilitating electrical attachment of the blower to one or more devices or systems.

FIG. 10C illustrates an embodiment of a relative humidity sensor 330C positioned on or near a PCB 320C of the blower 310C. As shown, in some arrangements, the sensor 330C is situated generally below the impeller 324C (e.g., near the stator 326C of the impeller). However, in other embodiments, the location of the RH sensor 330C can vary, as desired or required. As shown, one or more wires 340C can be coupled to the sensor 330C. In any of the blower arrangements disclosed herein, the RH sensor can share one or more wires or other connections (e.g., ground) of the blower.

Figure 11:
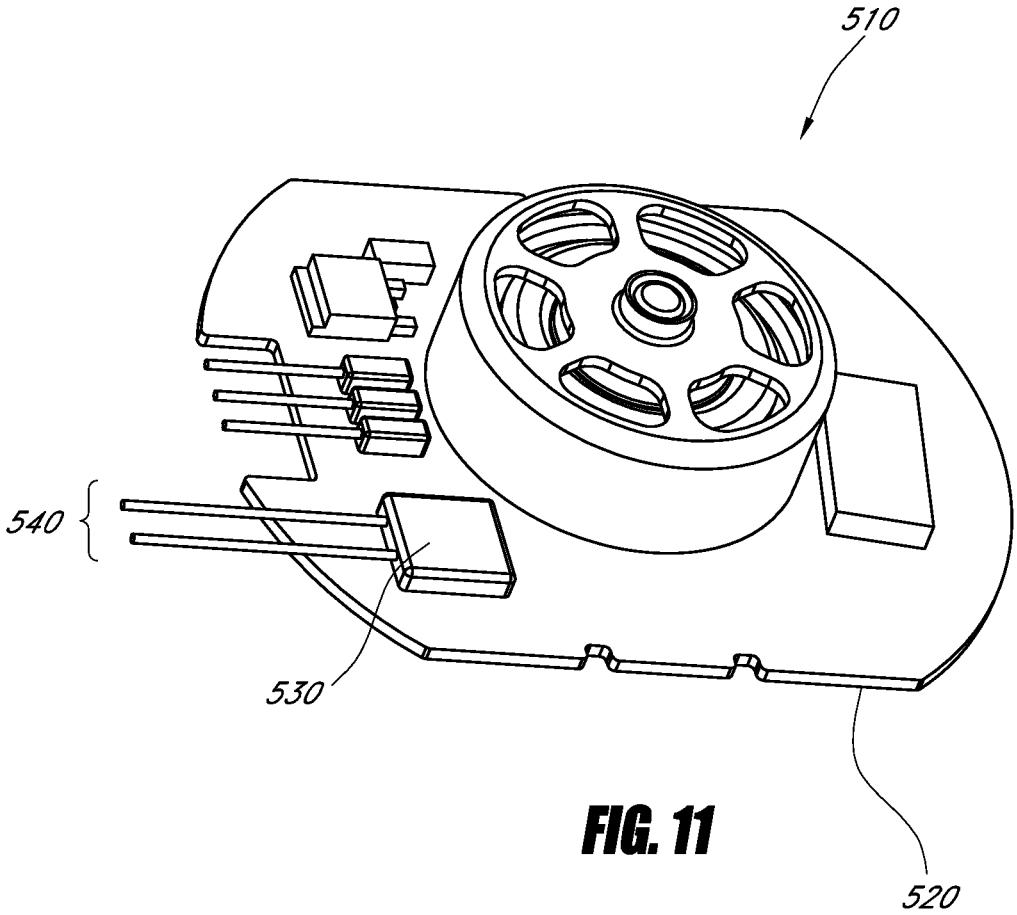
FIGS. 11, 12A, and 12B illustrate embodiments of a humidity sensor positioned adjacent to a PCB within a blower.

FIG. 11 illustrates another embodiment of a PCB 520 that can be employed in any of the blowers discussed herein. As shown, the PCB 520 includes RH sensor 530. As noted above with reference to FIG. 10C, the sensor 530 can be situated generally below the impeller when the PCB 520 is installed in a blower.

According to some configurations, including those where the RH sensor is positioned within the interior of the blower housing (e.g., on or near the PCB), along the outside of the blower housing, etc., the temperature of the blower can increase as the fluid module is operated. For example, the temperature of the PCB can increase as the impeller motor is electrically energized. As a result, such a temperature rise can lead to an inaccurate RH measurement by the RH sensor. For example, the increase in temperature can cause a difference between the true RH condition and the RH value measured by the sensor. Thus, such an erroneous or inaccurate RH measurement can negatively affect the operation of the blower. Such discrepancies can be particularly exacerbated when the RH sensor is located on or near the PCB. However, regardless of the exact location of the RH sensor, an underestimation of the actual RH level of the air entering into and passing through a blower can lead to excessive and undesirable condensation formation and retention between and/or near the fins of an upstream or downstream thermoelectric device. Thus, as discussed in greater detail herein, in some embodiments, a correction factor is applied to the logic controlling the fluid module in order to compensate and correct for the temperature rise of the adjacent PCB.

Figure 12A:
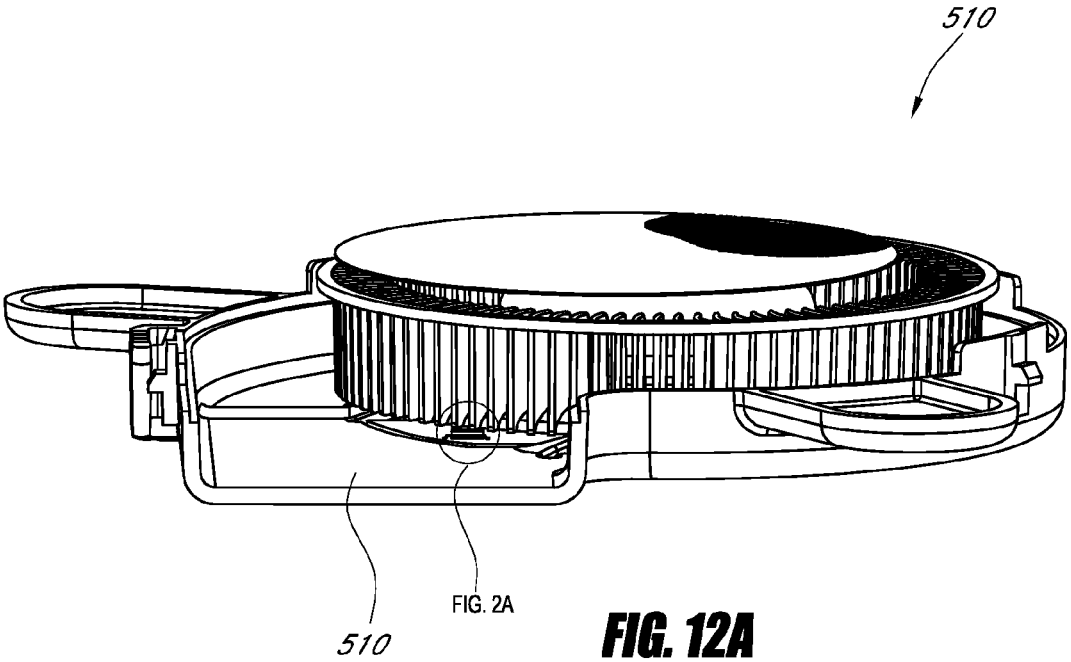
Figure 12B:
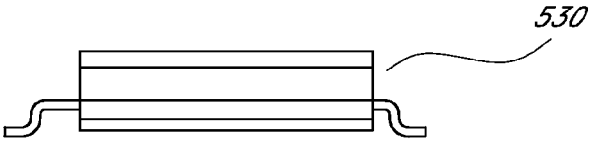

FIG. 12A illustrates a side view of a blower 510 (with its housing partially removed for clarity) comprising a RH sensor 530. In many respects, the blower 510 is identical or similar to (and can include any or all of the features and components of) the blowers discussed above, with some of the differences discussed below. As noted above, the sensor 530 can be positioned on or near the PCB 520, in an area generally below the impeller. FIG. 12B illustrates a detailed side view of an arrangement of a RH sensor 530 configured for placement within a fluid module 510.

Figure 13:
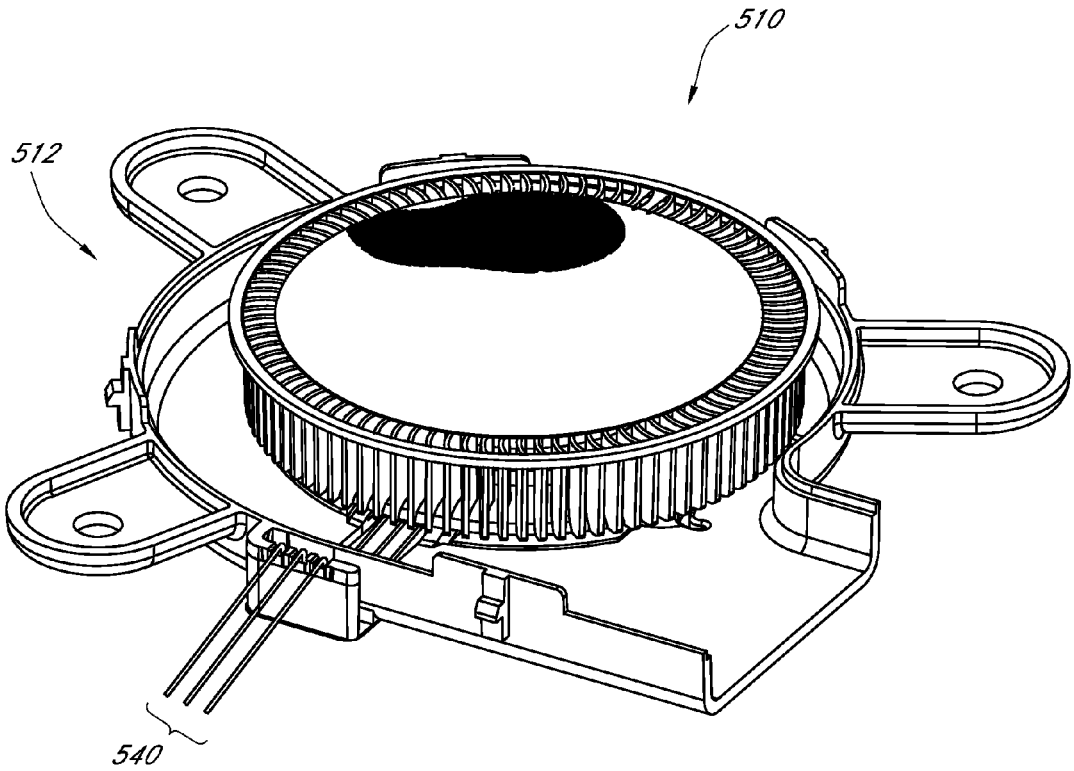
FIG. 13 illustrates a perspective view of wires routed relative to a housing of a blower that comprises a humidity sensor, according to some embodiments.

FIG. 13 illustrates a view of the blower 510 (with an upper portion of the housing 512 removed for clarity) advantageously configured to route one or more wires 540 within a recess formed along the lower portion of the housing. One or more of the wires 540 can be coupled to the RH sensor, the blower motor, the PCB 520, other sensors and/or any other component or portion within the interior of the fluid module housing. As discussed above, one or more wires (e.g., ground) routed into and out of the interior of the blower 510 can be shared, as desired or required.

Figure 14A:
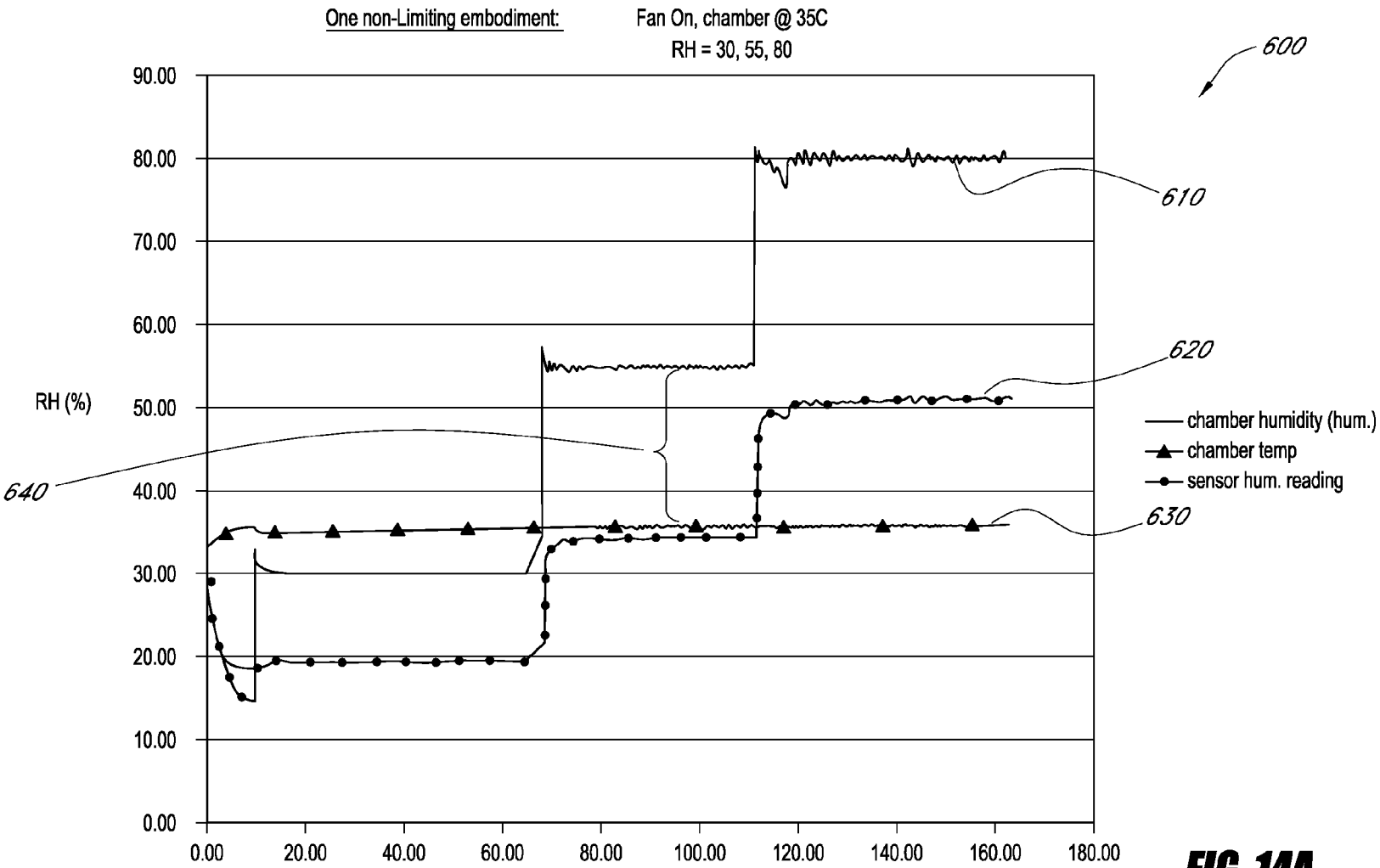
FIGS. 14A and 14B are charts illustrating the effect of internal blower temperature on relative humidity measurements and an embodiment of an appropriate adjustment.
Figure 14B:
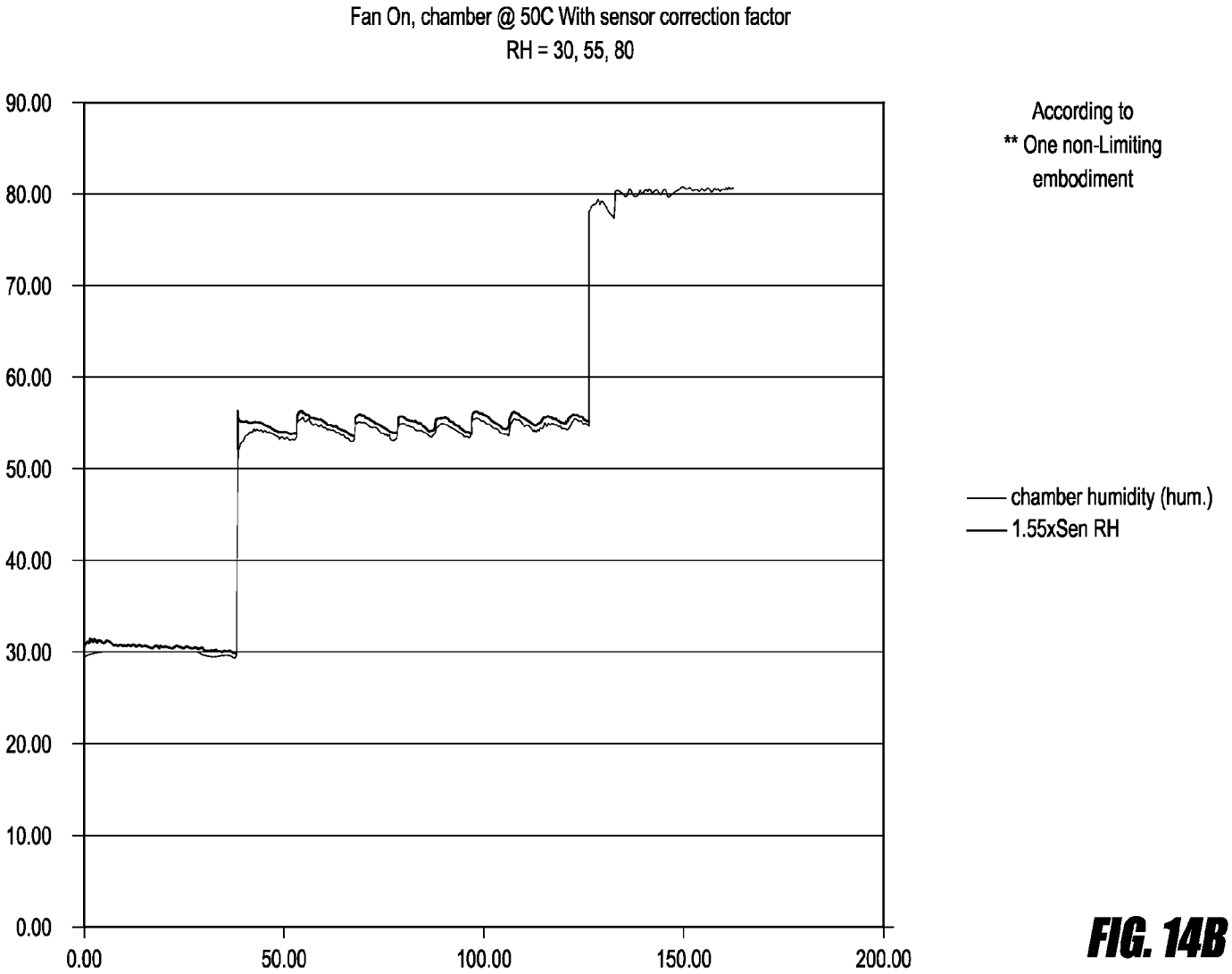

FIG. 14A illustrates a chart 600 showing one non-limiting embodiment of a discrepancy between actual 610 and perceived 620 (e.g., measured) relative humidity values that can result from the increase in PCB temperature. A temperature reading 630 is shown on the chart 600 as well. In the depicted chart 600, the relatively large difference between actual and measured RH values is schematically represented by gap 640. In some arrangements, such a difference can be approximately 10-30% (e.g., about 10%, 15%, 20%, 25%, 30%, etc.). In other embodiments, the difference 640 is greater than about 30% or less than about 10%, depending on one or more factors (e.g., energy supplied to the PCB, size of the fluid module, type of RH sensor used, exact location of the RH sensor, etc.). Accordingly, as noted above, a correction factor can be applied to the logic controlling the fluid module to correct for the discrepancy caused by the temperature rise of the adjacent PCB. In some embodiments, the correction factor is approximately between 1.0 and 2.0 (e.g., approximately 1.0, 1.1, 1.2, 1.3, 1.4, 1.5, 1.6, 1.7, 1.8, 1.9, 2.0, ranges between these values, etc.). By way of example, in some embodiments, the RH correction factor applied to the control logic is approximately 1.55. A schematic embodiment of the effect of applying such a correction factor to the logic is illustrated in FIG. 14B.

As discussed above, the RH sensor can be positioned on or near a PCB within the fluid module housing. Alternatively, however, one or more RH sensors can be placed at any location within, on or outside the blower (see, for example, the embodiments illustrated in FIGS. 10A-10C). For example, the RH sensor can be coupled to, integrated with or otherwise attached to the housing of the blower or fluid module. Thus, in such arrangements, the sensor can be in the vicinity of the blower inlet, allowing the sensor to detect the humidity of the air or other fluid entering the blower. In other embodiments, one or more RH sensors can be positioned along the outside of the blower housing, away from the blower altogether (e.g., within the space or general area that contains the climate control system, such as the interior or a vehicle, room, etc.), within a fluid passage of the climate control system (e.g., either upstream or downstream of the blower or fluid module) and/or any other location.

Figure 15:
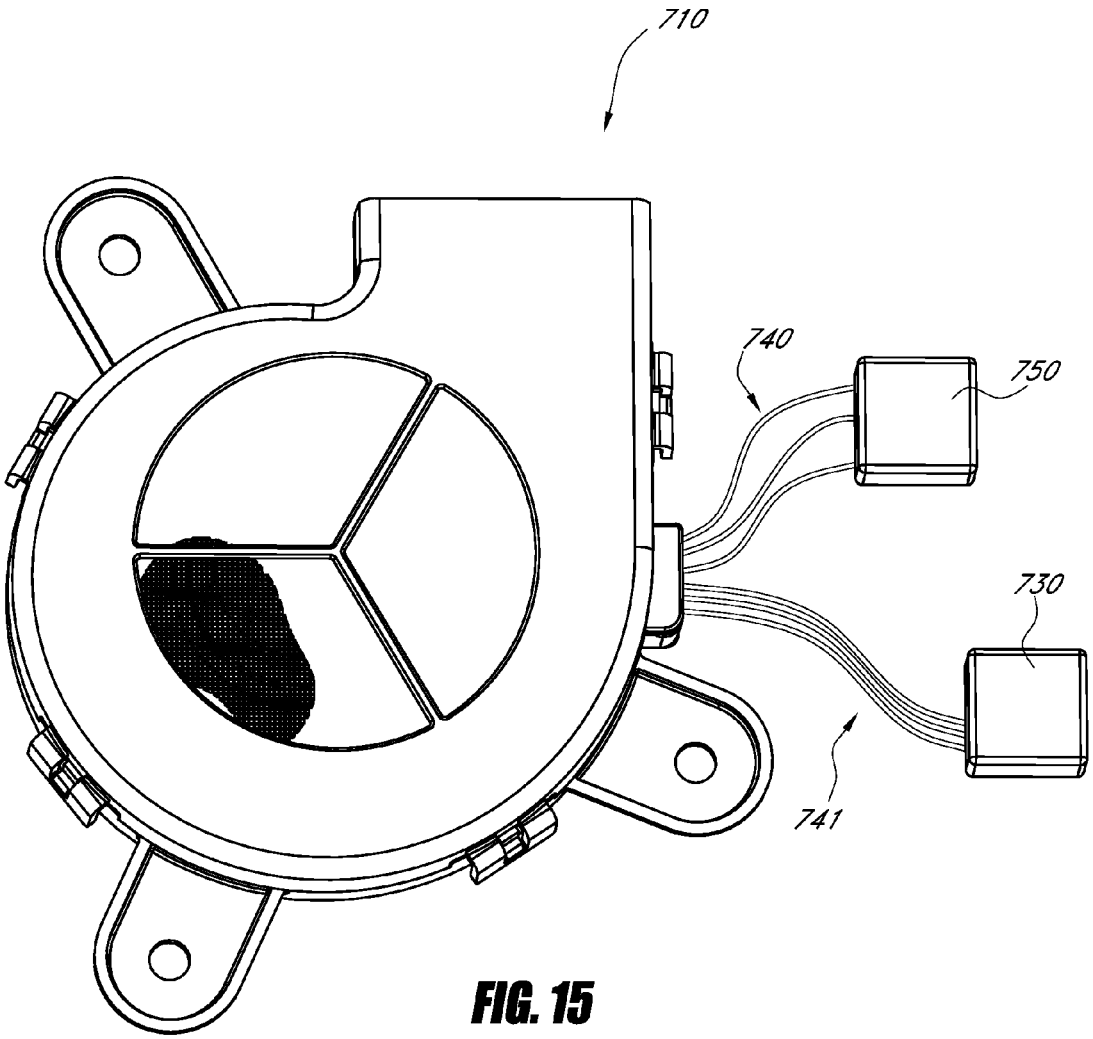
FIG. 15 illustrates an embodiment of a blower comprising a relative humidity sensor.

FIG. 15 illustrates an embodiment of a blower 710 comprising a plurality of wires 740 that exit therefrom. In many respects, the blower 710 is identical or similar to (and can include any or all of the features and components of) the blowers discussed above, with some of the differences discussed below. As shown, the wires 740, which include wires that can connect to the blower motor, PCB, and/or any other electrical component within the blower or fluid module, can terminate at a standard or non-standard electrical connector 750 or other coupling that facilitates connection of the wires to the proper source (e.g., power, ground, sensor, controller, etc.). In some embodiments, one or more wires 741 attach to one or more RH sensors located within, on, or near the blower 710 or fluid module. In some embodiments, the RH sensor wires 741 also terminate in the electrical connector 750. However, the sensor wires 741 and other wires 740 need not be coupled to the same connector. For instance, the sensor wires 741 can terminate in their own separate and distinct connector 730. As depicted in FIG. 15, the RH sensor wires 741 can be attached to and/or passed through the blower housing in the same or approximately the same region where other wires 740 exit from the housing.

Figure 16:
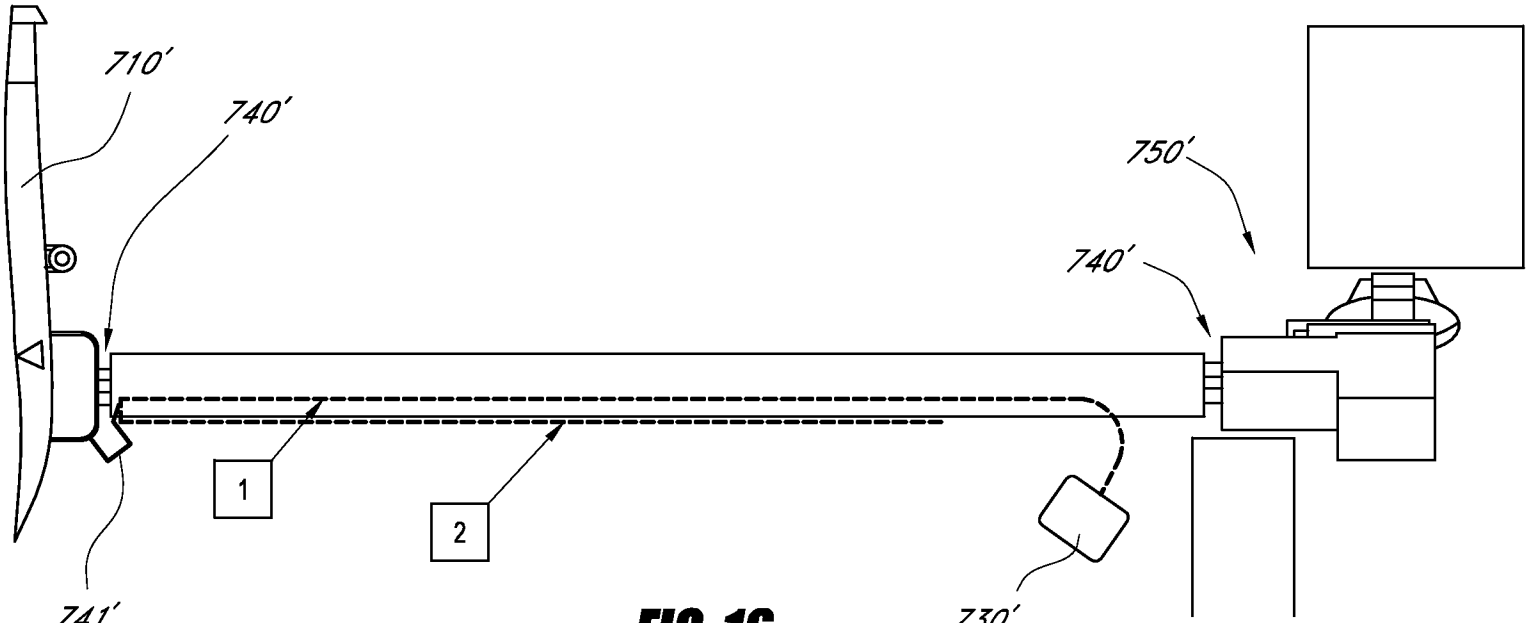
FIG. 16 schematically illustrates an embodiment of a blower comprising a relative humidity sensor.

FIG. 16 schematically illustrates an embodiment of a blower or fluid module that includes a separate electrical connector for the RH sensor wires. As shown, the RH sensor wire or wires 741' can exit the housing of the blower 710' or fluid module at or near the same location as other wires 740' (e.g., main blower wires) exit the housing. In some embodiments, the sensor wires 740' are routed under the blower wire loom, in a manner generally represented by line "1" in FIG. 16. Alternatively, the sensor wires 741' can be tape wrapped or otherwise secured to the blower wire loom in a manner generally represented by line "2" in FIG. 15. Any other method or device of routing the sensor wires 741' relative to other blower wires (e.g., the wire loom for wires 740' attached to the blower motor and/or PCB) can be used, as desired or required. Regardless of the exact manner in which the RH sensor wires 741' are routed or otherwise guided once outside the blower or fluid module housing, the wires 741' can terminate in a standard or non-standard electrical coupling 730' in order to simplify connection to one or more other devices, connectors and/or the like.

Figure 17:
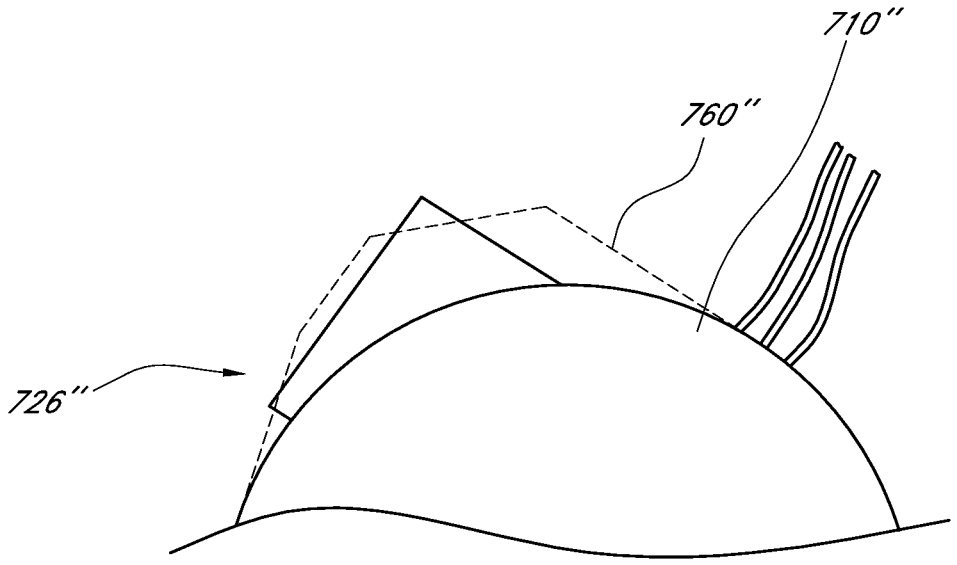
FIG. 17 illustrates an embodiment of a blower configured to receive a relative humidity sensor.

According to some embodiments, the blower is configured such that the RH sensor measures the relative humidity of air or other fluid entering the blower. For example, the shape of the blower or fluid module can be modified to extend or otherwise increase the inlet coverage or area of the blower. In some such embodiments, the inlet enters at the side of the housing (e.g., via the sidewall) and the housing is modified to extend toward the inlet. This can advantageously permit the RH sensor to be accommodated within the blower or fluid module. In some embodiments, such a modification can further enhance the accuracy or dependability of the RH sensor as compared to an identical or similar sensor positioned within an unmodified blower. This can be especially helpful for seat configurations that are adapted for placement within a second row of a vehicle. An embodiment of a proposed extension or modification (e.g., generally represented by dashed line 760") to a blower 710" with an inlet 726" is illustrated in FIG. 17.

Figure 18A:
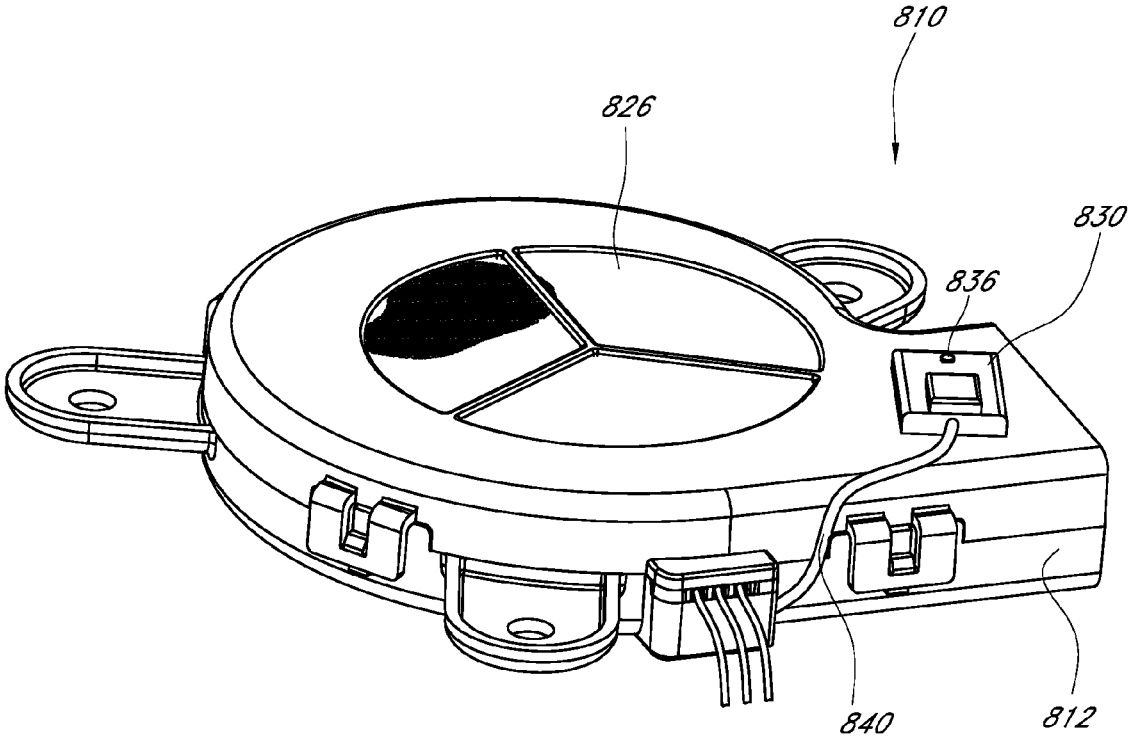
FIGS. 18A-18D illustrate various views of a relative humidity sensor positioned along an exterior portion of the blower housing, according to an embodiment.
Figure 18B:
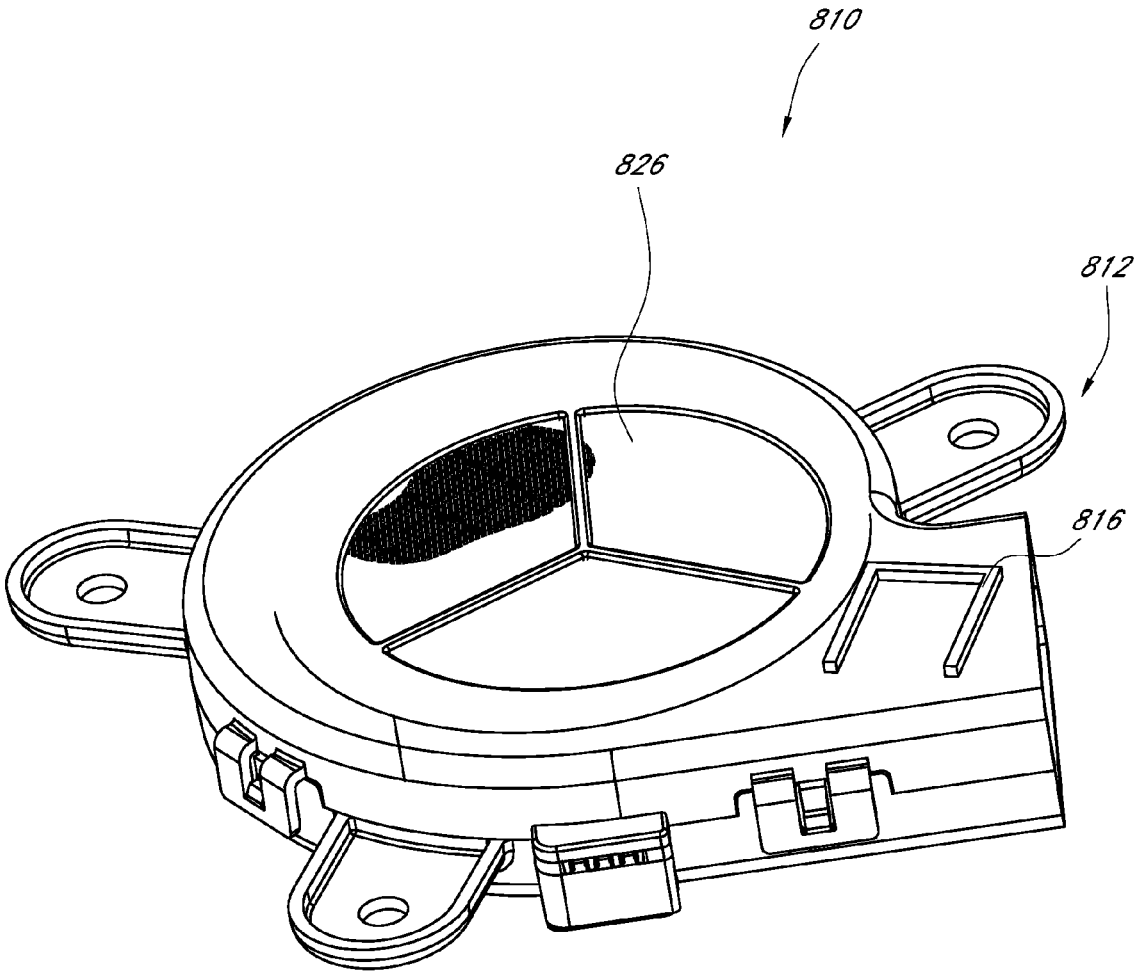
Figure 18C:
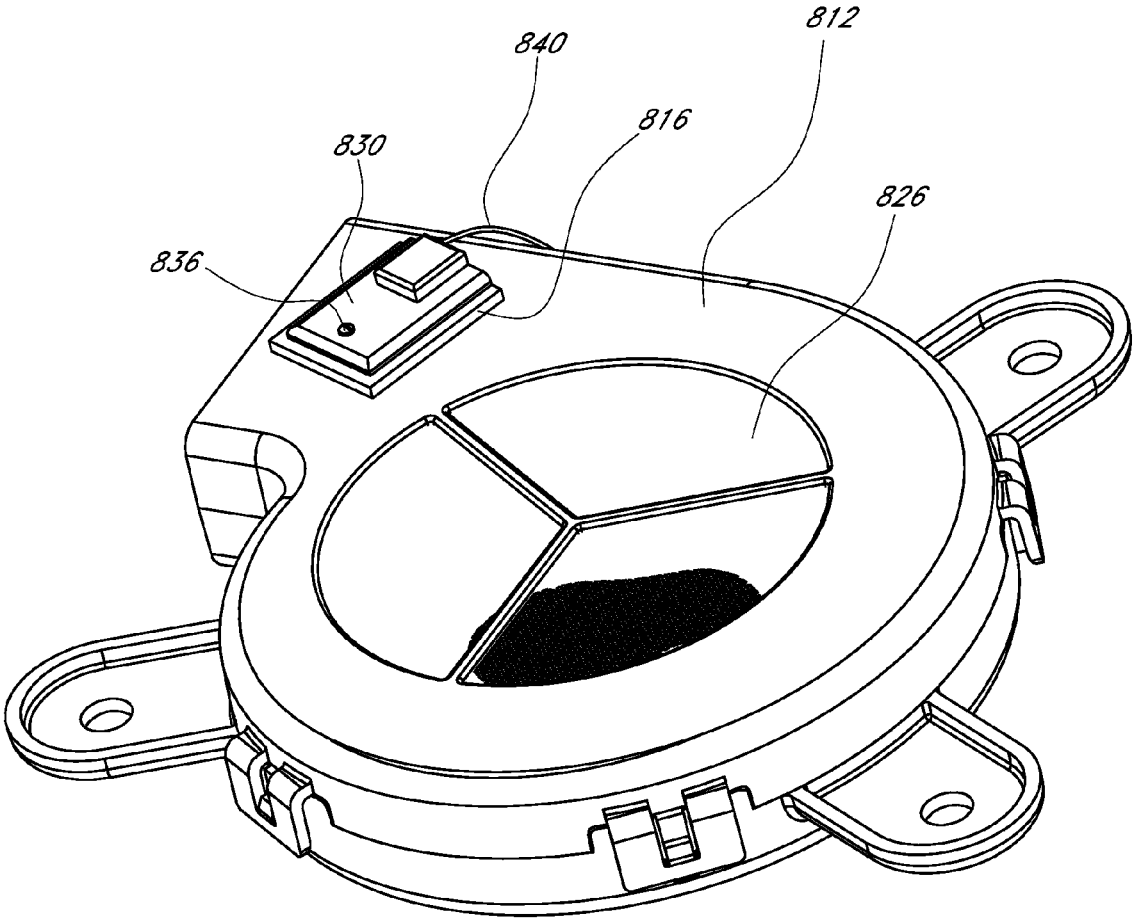
Figure 18D:
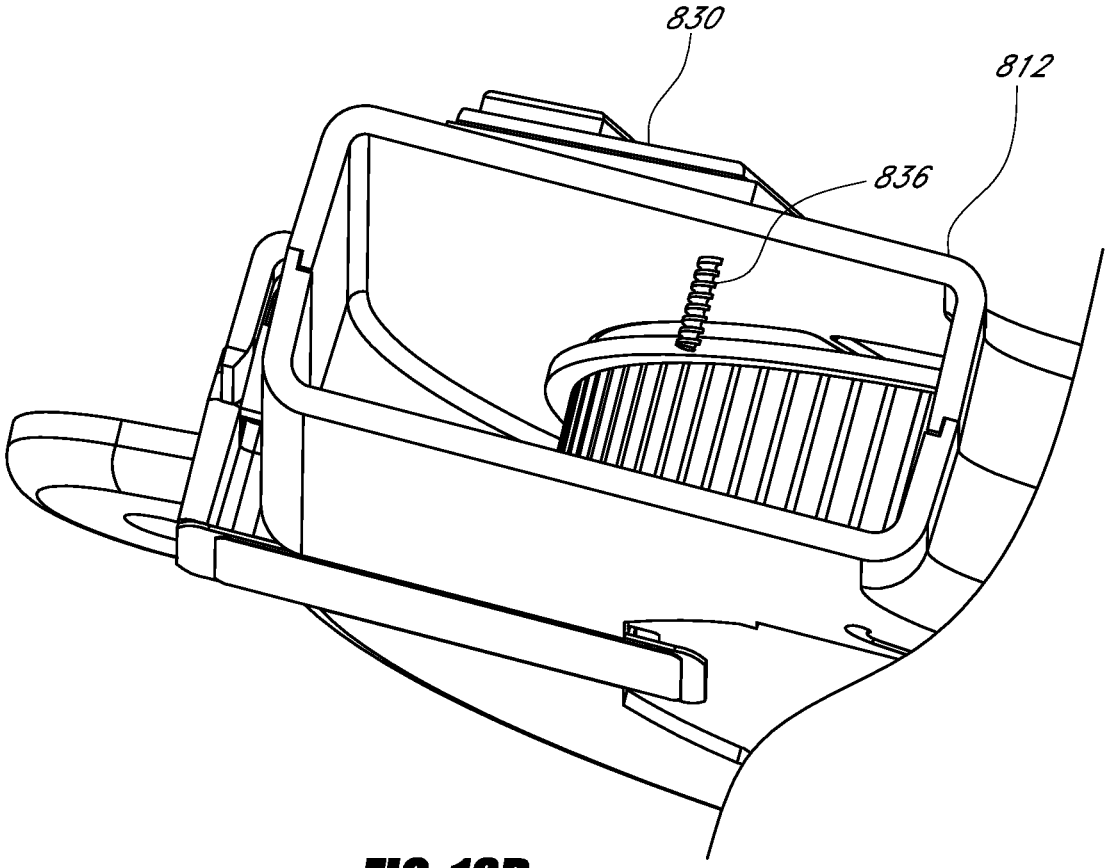

FIGS. 18A through 18D illustrate various views of another embodiment of a blower 810. In many respects, the blower 810 is identical or similar to (and can include any or all of the features and components of) the blowers discussed above, with some of the differences discussed below. As shown, the blower 810 includes RH sensor 830 positioned along an exterior surface of a blower housing 812 and connected with a wire 840. As discussed above with reference to other embodiments, the sensor 830 can be positioned at or near the blower inlet 826 in order to more accurately measure the RH level of air or other fluid entering the blower 810. As best illustrated in FIG. 18B, in some arrangements, the exterior of the blower housing 812 can include a recessed, ridged or other area 816 that is sized, shaped and otherwise adapted to receive a sensor therein. Such a sensor-receiving area 816 can help ensure that the sensor 830 remains securely fastened to the blower housing during the life of the blower 810. However, the sensor 830 can be secured to the blower using one or more other attachment devices or methods, either in addition to or in lieu of a recessed or ridged area 816 of the housing 812. For example, the sensor can be fastened to the blower 810 using a screw 836, adhesive (e.g., between the sensor and the blower housing), welds, rivet, other fastener, and/or the like.

Flow Distribution Vanes

Figure 19:
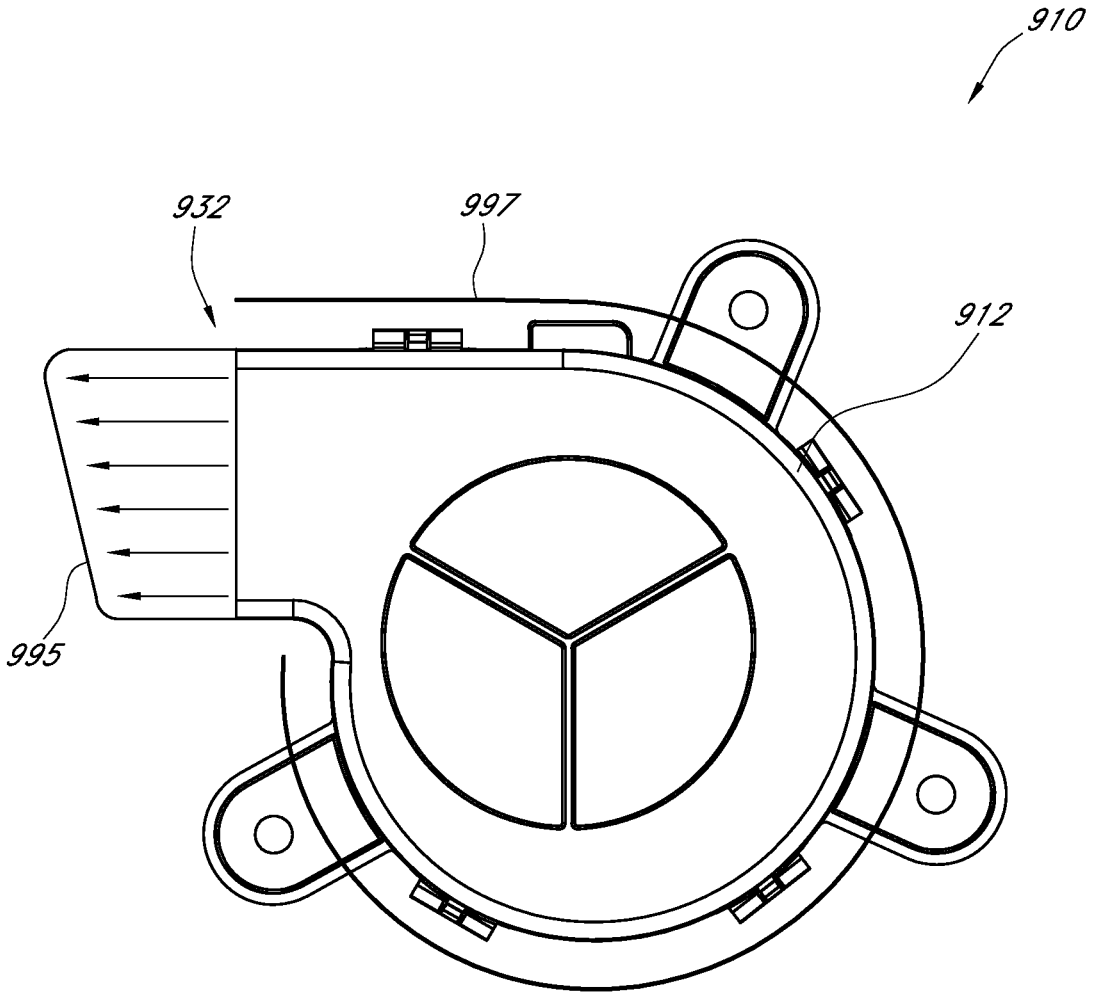
FIG. 19 schematically illustrates a fluid velocity distribution pattern at the outlet of a standard blower assembly.

FIG. 19 illustrates a blower 910 and an air flow pattern 995 at an outlet 932. The air flow pattern 995 is a schematic representation of fluid velocity exiting the blower 910. As shown, in many blowers 910 the velocity of fluid exiting the blower 910 through the outlet 932 can vary depending on the exact location of the fluid relative to a scroll 997 (e.g., the periphery of the fan and/or the periphery of the cavity) of the blower. For example, as depicted in FIG. 19, the fluid velocity can be greater near the scroll 997 in such standard blowers. Under certain conditions, however, it may be desirable to have a generally even fluid velocity distribution along the length of the blower outlet 932.

Figure 20:
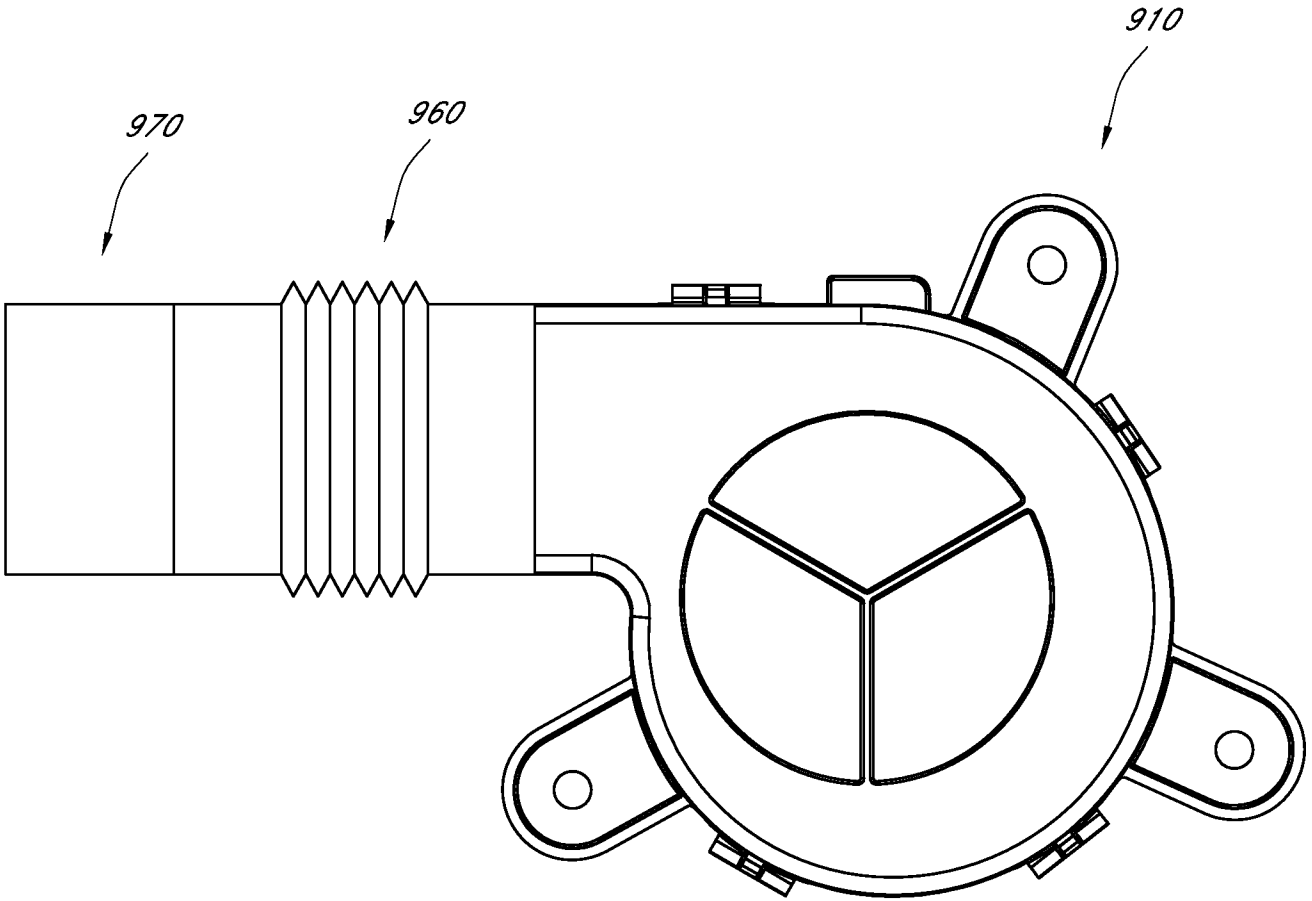
FIGS. 20 and 21 illustrate embodiments of a blower assembly and downstream components.
Figure 21:
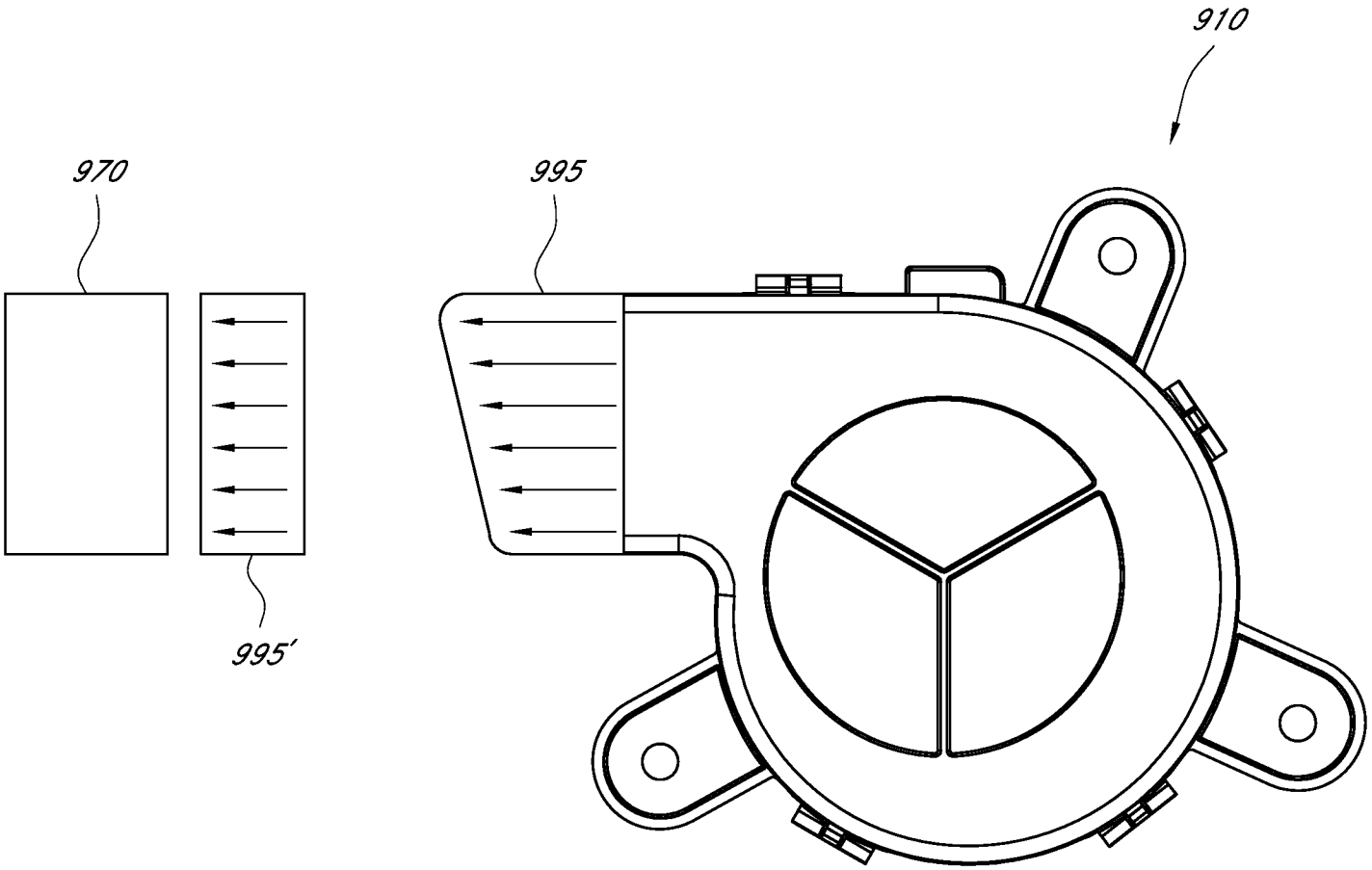

With reference to FIG. 20, one or more components of a climate control system can be secured to the blower outlet 932, such as, for example, a duct 960, a thermal conditioning device 970 (e.g., a thermoelectric device, a convective heater, another heating and/or cooling device, etc.) and/or the like. Thus, it may be desirable to create a more even fluid velocity distribution in such downstream devices or components in order to enhance the operation of the system (e.g., improved heat transfer) and/or provide some other benefits or advantages. For example, FIG. 21 schematically illustrates a more uniform lateral (e.g., in the radial direction) fluid velocity distribution pattern 995' upstream of a thermoelectric device 970 or some other environmental conditioning device.

Figure 22:
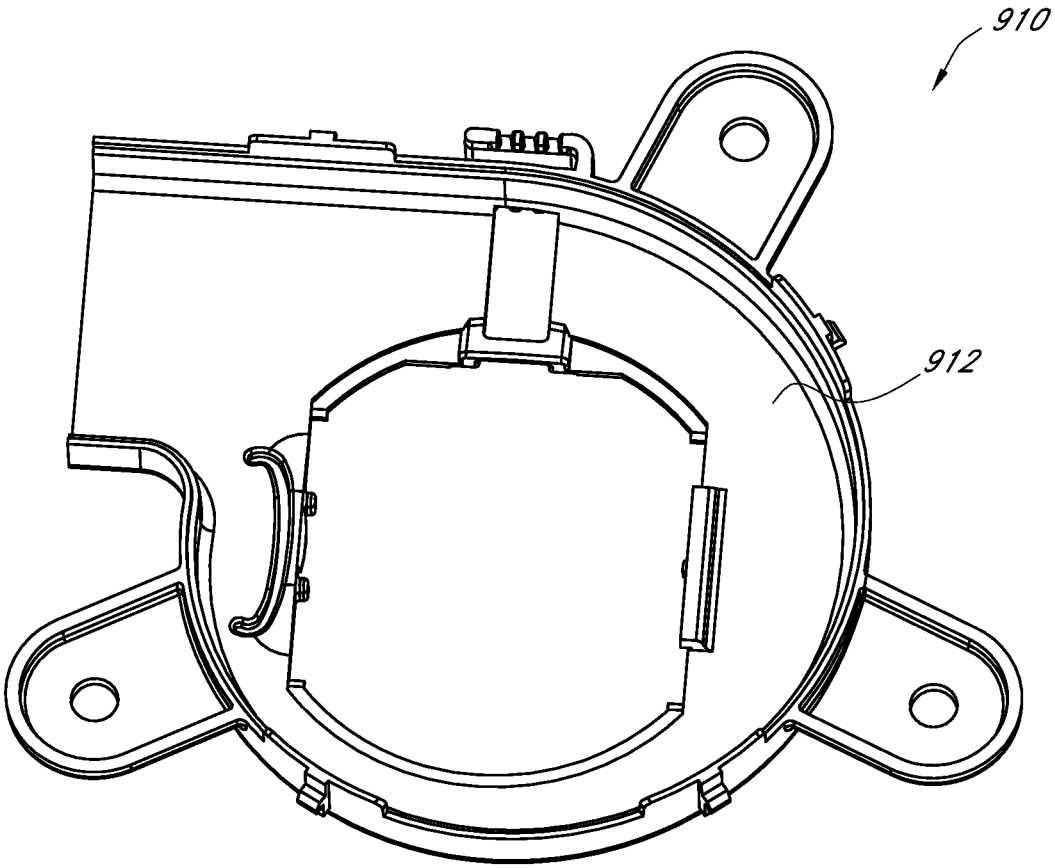
FIG. 22 illustrates an embodiment of an interior portion of a blower housing that does not comprise vanes or other flow distribution members.

FIG. 22 illustrates an arrangement of a blower that does not include any vanes or fluid distribution members within the interior of the housing 912. Accordingly, with such a design, an uneven lateral fluid velocity distribution pattern 995 (e.g., as schematically depicted in FIG. 19) can be expected.

Figure 23:
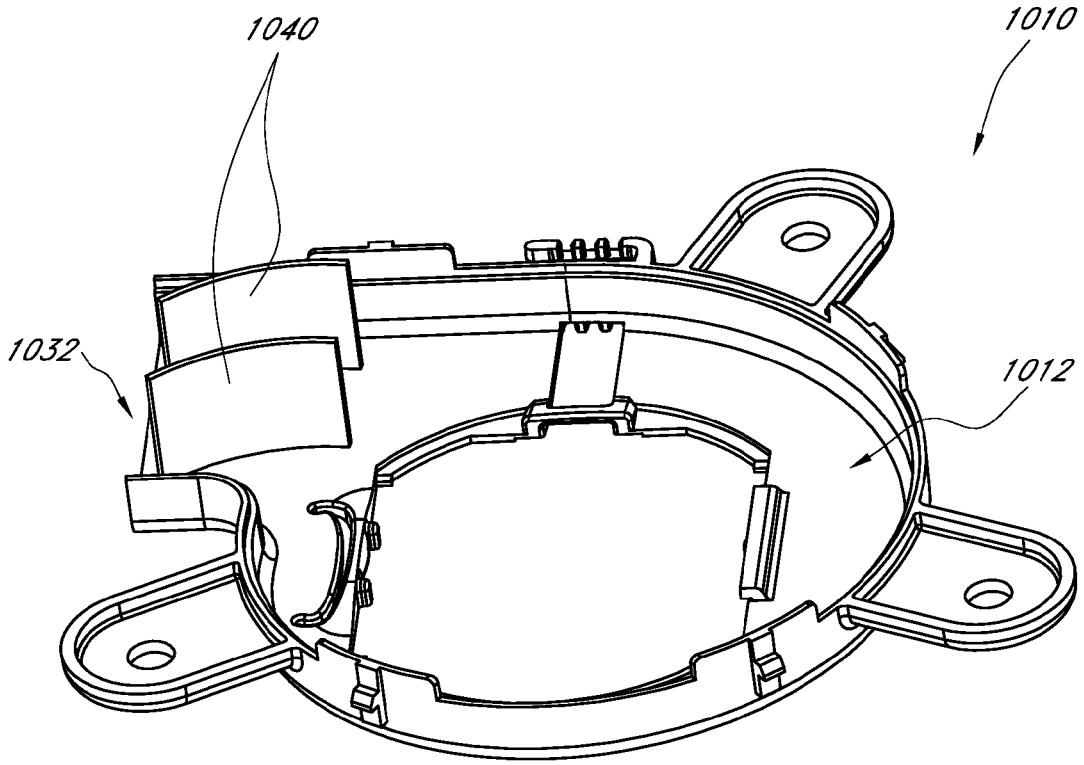
Figure 24A:
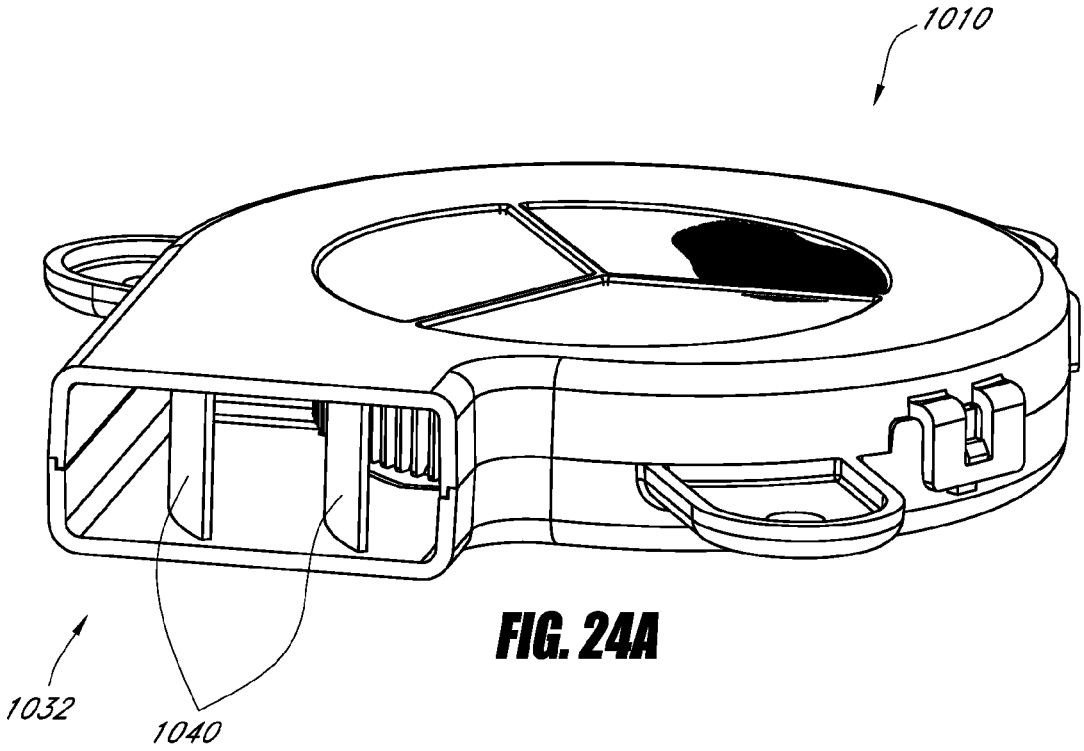
Figure 24B:
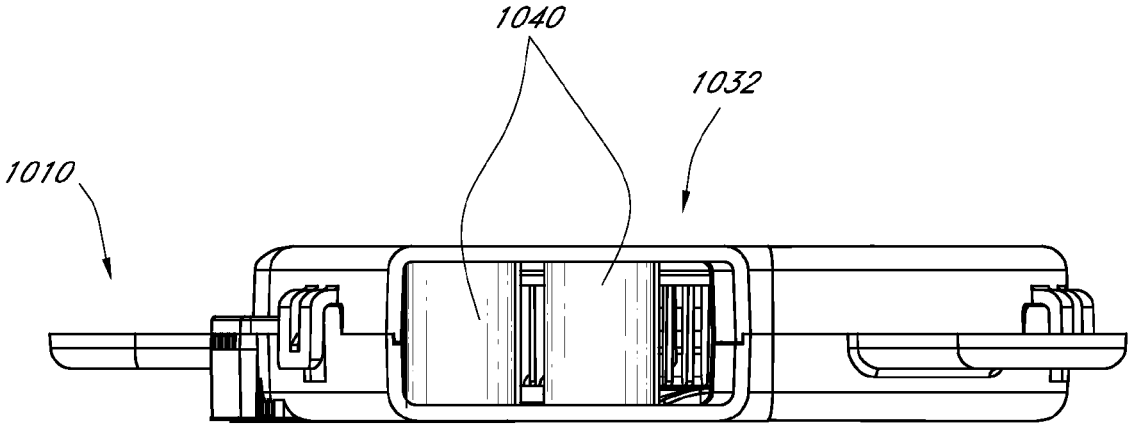

FIG. 23 illustrates a portion of a housing 1012 of another embodiment of a blower 1010. In many respects, the blower 1010 is identical or similar to (and can include any or all of the features and components of) the blowers discussed above, with some of the differences discussed below. As shown, the blower 1010 includes one or more fluid distribution members or vanes 1040 within an interior of the blower housing 1012. Additional views of this configuration of the blower 1010 are provided in FIGS. 24A, 24B, and 25. In the depicted arrangements, the blower 1010 comprises a total of two vanes 1040 that are angularly disposed at or near the blower outlet 1032. As shown, the vanes 1040 can be generally parallel to each other. In other embodiments, however, the quantity, shape, size, location, spacing, relative orientation and/or other details or properties of the vanes 1040 can vary, as desired or required.

In some embodiments, the vanes are integrally molded into the housing 12 using an injection molding, blow molding, compression molding, thermoforming and/or any other manufacturing method. In other embodiments, the vanes are separate items that are subsequently attached to the housing and/or any other portion of the blower 10 using one or more connection methods or devices (e.g., welds, adhesives, fasteners, etc.).

Figure 25:
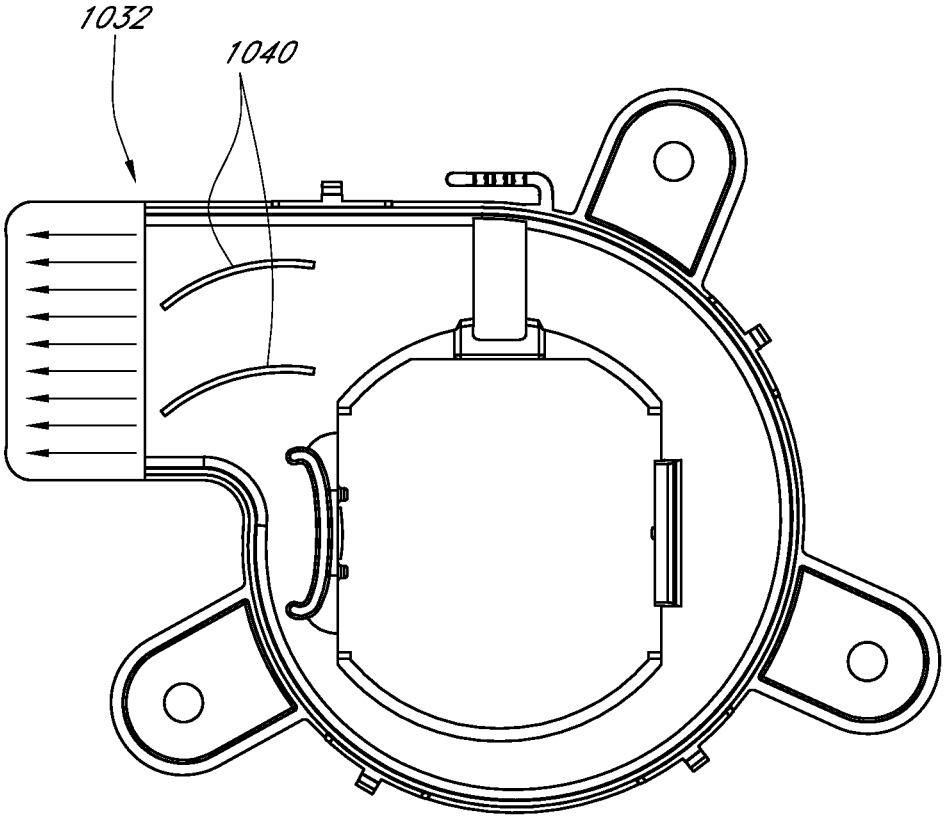

In certain arrangements, the vanes 1040 can, for example, facilitate achieving a substantially uniform fluid velocity distribution along the lateral length of the blower outlet 1032. FIG. 25 generally and schematically illustrates such an embodiment and the velocity distribution pattern of fluid exiting the blower outlet 1032. Furthermore, in embodiments in which the vanes 1040 span the axial thickness of the blower 1010 (e.g., the vanes extend between the first and second sides of the housing), the vanes 1040 can improve the structural strength of the housing 1012 and inhibit collapse. One or more other advantages or benefits can also be realized by the use of such vanes 1040.

In some embodiments, the vanes 1040 comprise one or more uninterrupted members. However, in some cases, such an uninterrupted member can cause turbulence, eddies, and/or low-pressure areas on the downstream side of the member, which in turn can reduce efficiency of the blower 1010 and/or increase noise and vibration. Thus, in some embodiments, one or more of the vanes 1040 comprises a plurality of spaced apart elongate members. For example, the vanes 1040 can comprise several pins that are separated from each other and are arrayed in an overall shape that is generally similar to the uninterrupted member that has been replaced. Such a configuration can, for example, allow fluid to flow between the pins, thereby reducing or avoiding the turbulence, eddies, and/or low-pressure areas described above. Further details and examples regarding elongate members as vanes can be found in U.S. Provisional Application No. 61/483,590, filed May 6, 2011, the entirety of which is hereby incorporated by reference.

Wire Protection Member

Figure 26:
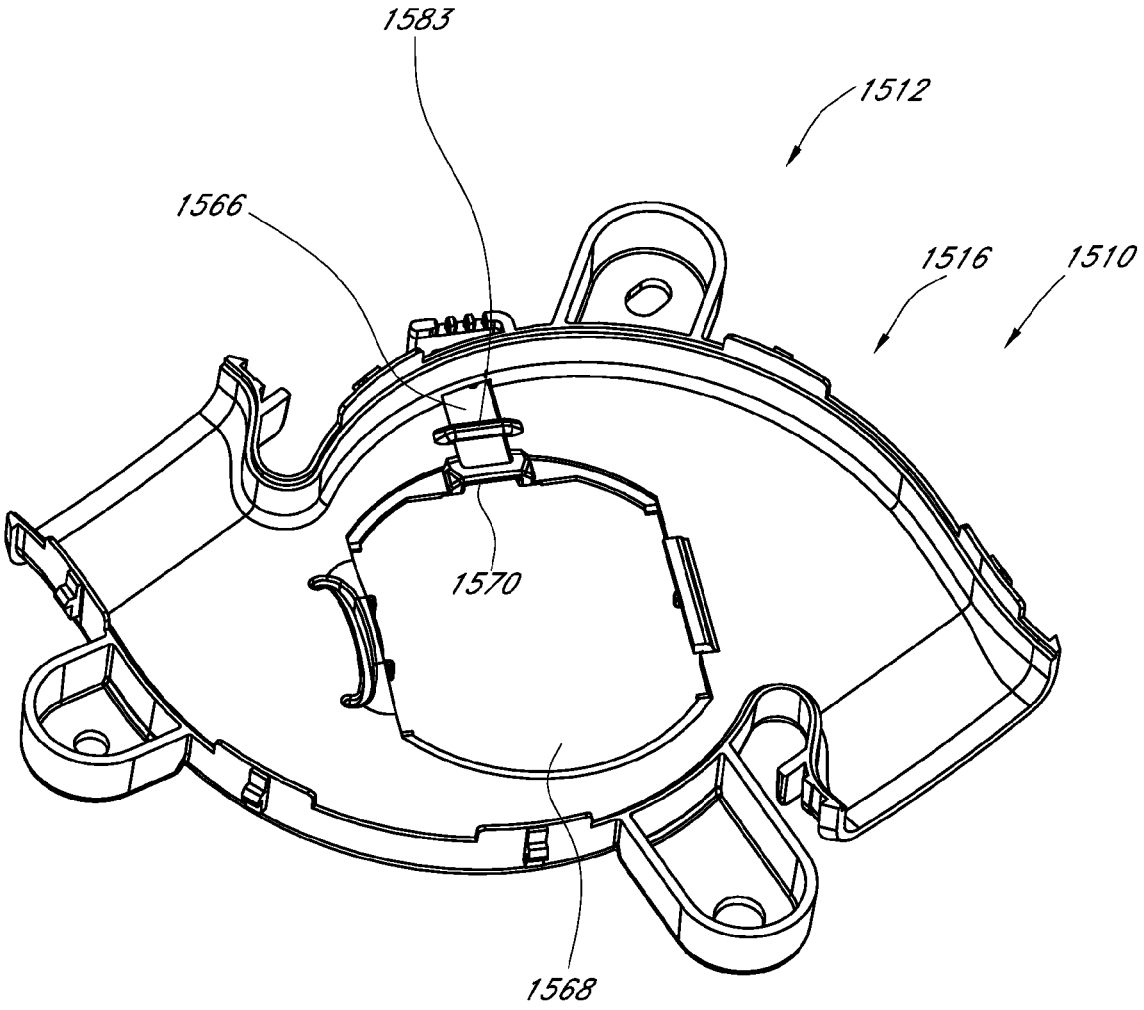
FIG. 26 illustrates a perspective view of a second side of a housing of another embodiment for a blower.

With reference to FIG. 26, a perspective view of a second side 1516 of a housing 1012 of another embodiment of a blower 1510 is illustrated. In many respects the blower 1510 is similar or identical to the blowers described above and can include any or all of the features previously discussed. As shown, second side 1516 includes a mounting aperture 1568 and a channel 1566 for routing wires (not shown) therethrough. A first retaining member 1570 is disposed near the mounting aperture 1568 and can encourage the wires to route away from the impeller (not shown) as impact with the impeller could cause damage, fire, electrical shock, or other unwanted results. In some embodiments, the blower 1510 has a plurality of outlets.

In certain embodiments, the second side 1516 has a wire protection member 1083, which inhibits or prevents the wires in the channel 1566 from bending, curving, or otherwise angling upward into contact with the impeller. In some respects, the wire protection member 1583 is similar to the first retaining member 1570. For example, the wire protection member 1583 can be a bridge-like member that generally spans the width of the channel 1566. Alternate configurations of the wire protection member 1583 include, for example, one or more clips, clamps, clasps, staples, straps, latches, bars, posts, other fasteners, glues, epoxies, other adhesives, ties, hook and loop fasteners and/or the like. Generally, the wire protection member 1583 is smoothed, rounded, and/or or chamfered to inhibit or reduce the likelihood of wear on the wires. Although only one wire protection member 1583 is illustrated in FIG. 26, other embodiments include two, three, four, or more wire protection members 1583.

Various configurations for the wire protection member 1583 are contemplated. In some embodiments, such as in the embodiment illustrated in FIG. 26, the wire protection member 1583 is disposed on the inside of the second side 1516, e.g., the side along with air or fluid flows when the blower 1510 is operating. In other embodiments, the wire protection member 1583 is disposed on the outside of the second side 1516. In certain arrangements, the wire protection member 1583 is located radially outward of the outside diameter of the impeller. However, in other embodiments, the wire protection member 1583 is located axially below, and radially inward of the outside diameter of, the impeller. In some embodiments, the radial and/or axial thickness of the wire protection member 1583 is about the same as the thickness of the second side 1516 (e.g., about 2.0 mm). In some embodiments, the wire protection member 1583 has a substantially uniform radial and/or axial thickness.

In certain arrangements, the wire protection member 1583 is configured to allow fluid to smoothly traverse around and/or along the wire protection member 1583. Indeed, in certain instances, the wire protection member 1583 is configured to not substantially block fluid flow. For example, the wire protection member 1583 can include ends (e.g., the connection between the wire protection member 1583 and the second side 1516) that are curved, chambered, rounded, or otherwise configured to allow fluid flow in the blower 1510 to smoothly traverse along the wire protection member 1583. In some embodiments, the wire protection member 1583 is substantially parallel with the fluid flow in the blower 1510. In some arrangements, the wire protection member 1583 is substantially parallel to a tangent line drawn from a portion of the impeller that is nearest the wire protection member 1583. In some embodiments, the wire protection member 1583 is positioned substantially perpendicular to a radial line drawn from approximately the center of the blower 1510. In certain embodiments, as shown in FIG. 26, the wire protection member 1583 is approximately transverse to the channel 1566. In some embodiments, the wire protection member 1583 is generally straight. In other embodiments, the wire protection member 1583 is curved. For example, the wire protection member 1583 can define an arc similar to the outside diameter of the impeller.

Shrouded Impeller

Figure 27:
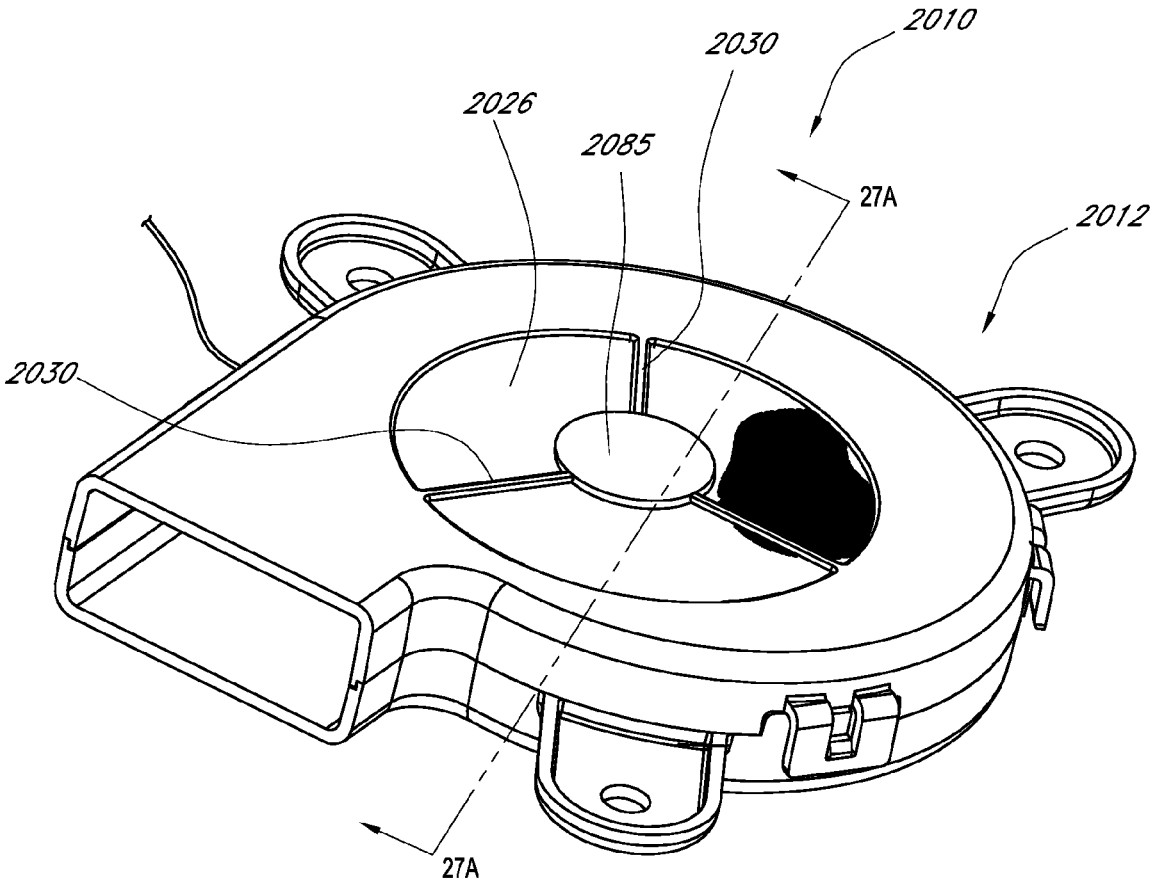
FIG. 27 illustrates a perspective view of another embodiment of a blower.

With reference to FIG. 27, a cross sectional view of a housing 2012 of another embodiment of a blower 2010 is illustrated. In many respects the blower 2010 is similar or identical to the blowers described above and can include any or all of the features previously discussed. As shown, the housing 2012 has a first side 2014, which in turn includes an inlet 2026 and a shroud 2085. As shown, the shroud 2085 can be supported by one or more ribs 2030. In certain embodiments, the shroud 2085 is integrated with and/or monolithically formed with the one or more of ribs 2030. In other embodiments, the shroud 2085 is a discrete piece from the one or more ribs 2030. As shown in the cross sectional view of FIG. 27A, the blower 2010 includes a motor 2046 and an impeller 2048. In turn, the impeller 2048 can include an upper portion 2058, an annular portion 2060, and lower portion 2062.

In certain conventional blowers not including a shroud, fluid entering the housing is allowed to contact the rotating upper portion and/or the motor. Such a design can result in friction between the fluid and the rotating upper portion and/or the motor, which can reduce the efficiency of the blower and/or generate noise. In comparison, the shroud 2085 of the blower 2010 inhibits or prevents air or other fluid from contacting the upper portion 2058 and/or the motor 2046. For example, the shroud 2085 can deflect air or other fluid away from the upper portion 2058 and/or the motor 2046. Accordingly, the blower 2010 can reduce or avoid the above-described friction and noise concerns.

Figure 27A:
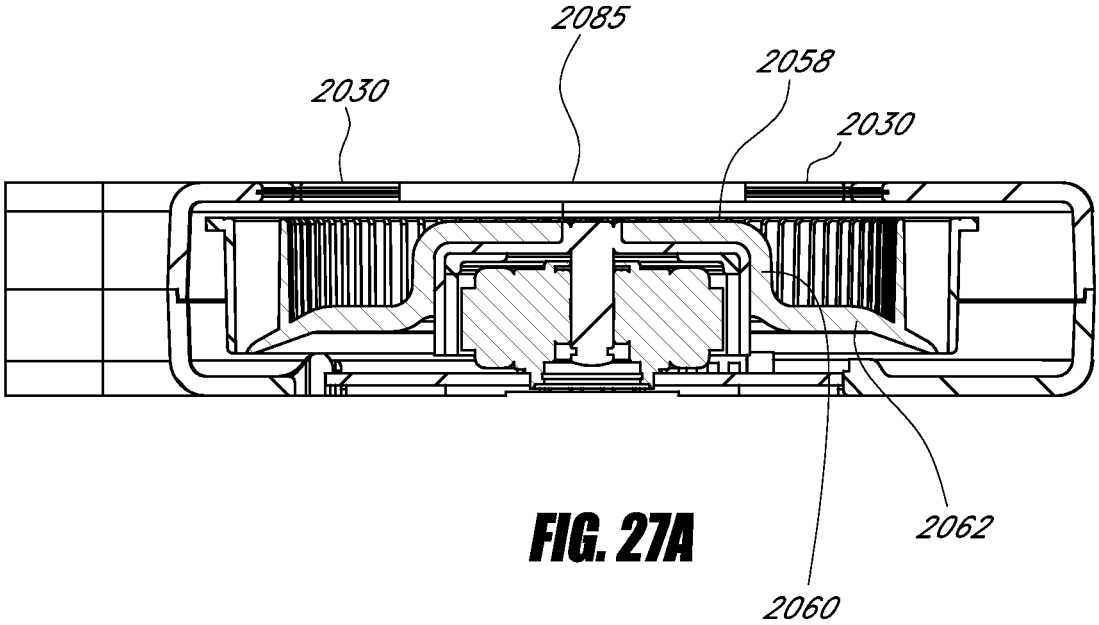
FIG. 27A illustrates a cross-sectional view of the blower of FIG. 27.

As shown in FIGS. 27 and 27A, the shroud 2085 can comprise a substantially disk-shaped member configured to approximately cover the top of the upper portion 2058 of the impeller 2048 and/or the motor 2046. However, various other configurations of the shroud 2085 are contemplated as well. For example, the shroud 2085 can comprise a cylindrical shape with at least one open end. In some such cases, the shroud 2085 further comprises an outwardly flared flange disposed at or near the open end.

In certain embodiments, the shroud 2085 extends along some, a majority, substantially all, or all of the upper portion 2058, such as is shown in FIG. 27A. In other embodiments, the shroud 2085 extends along the upper portion 2058 and along the annular portion 2060. In further arrangements, the shroud 2085 extends along upper portion 2058, the annular portion 2060, and the lower portion 2062. In some embodiments, at least some of the shroud 2085 extends substantially horizontally (e.g., approximately perpendicular to the axis of rotation of the impeller 2048). In certain embodiments, at least some of the shroud 2085 extends substantially vertically (e.g., approximately parallel with the axis of rotation of the impeller 2048). In some embodiments, substantially no air or other fluid passing through the inlet 2026 contacts the upper portion 2058 of the impeller 2048.

Integrated Connector

Figure 28:
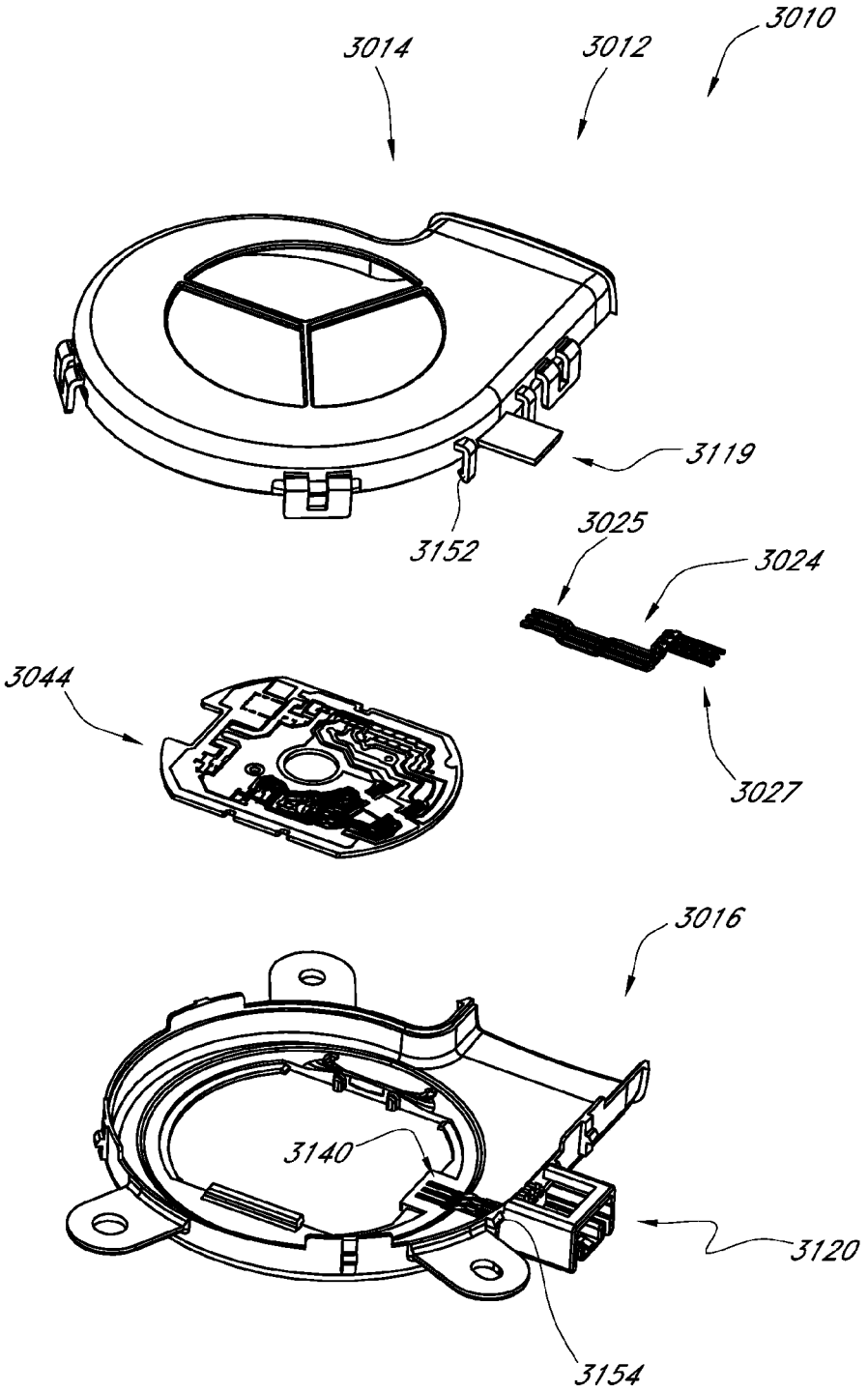
FIG. 28 illustrates an exploded perspective view of another embodiment of a blower, the blower having a first side, second side, and conductors.

With reference to FIG. 28, an exploded perspective view of another embodiment of a blower 3010 is illustrated. In many respects the blower 3010 is similar or identical to the blowers described above and can include any or all of the features previously discussed. As shown, the blower 3010 includes a housing 3012 comprising a first side 3014 and a second side 3016. The blower 3010 also includes a PCB 3044, which can be operably coupled (e.g., soldered) with and a first end 3025 of one or more conductors 3024. In certain arrangements, the conductors 3024 can be at least partly received in one or more recesses or grooves 3140 formed in the second side 3016. In some embodiments, the first side 3114 includes a first locking member 3152 (such as a clip) and a corresponding second locking member 3154 (such as a hook) is included on the second side 3016.

In some embodiments, the first side 3014 includes a cover 3119 and the second side 3016 includes an integrated connector 3120, each of which can project radially outward. The cover 3119 can be configured to be received in, and partly seal a portion of, the integrated connector 3120. In some embodiments, the cover 3119 is unitarily formed with the first side 3014. In other embodiments, the cover 3119 is formed separately from the first side 3014 and is subsequently joined with the first side 3014, such as by fasteners, adhesive, ultrasonic welding, or otherwise. Likewise, in some embodiments, the integrated connector 3120 is unitarily formed with the second side 3016. In other embodiments, the integrated connector 3120 is formed separately from the second side 3016 and is subsequently joined with the second side 3016, such as by fasteners, adhesive, ultrasonic welding, or otherwise. In certain embodiments, the integrated connector 3120 receives and supports a second end 3027 of the conductors 3024, as is discussed in further detail below.

Figure 29:
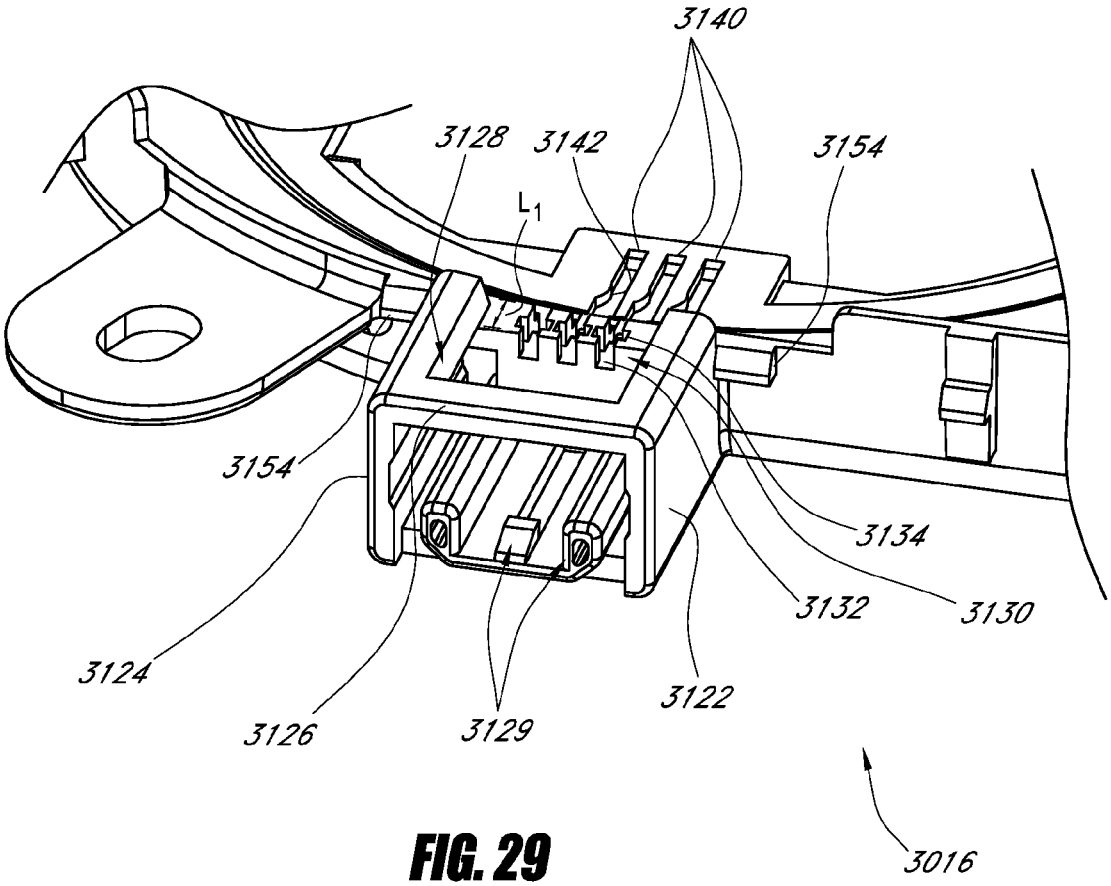
FIG. 29 illustrates a focused perspective view of a portion of the second side of the blower of FIG. 28.

As illustrated in the focused view of FIG. 29, the integrated connector 3120 can include wall portions 3122, 3124 joined by a top portion 3126. As shown, the top portion 3126 can define an opening 3128, which is generally the portion of the integrated connector 3120 that is configured to receive the cover 3119. Although some embodiments do not include the top portion 3126, such a portion can, for example, provide rigidity to integrated connector 3120 and support for the wall portions 3122, 3124. For example, in cases in which the integrated connector 3120 is formed by molding, the top portion 3126 can facilitate maintaining the wall portions 3122, 3124 substantially parallel to each other and/or substantially perpendicular to the top portion 3128.

In some embodiments, the integrated connector 3120 can be configured to receive a mating connector, thereby allowing electrical coupling of the blower 3010 with other components, such as a power source, vehicle on-board computer, etc. In some instances, the integrated connector 3120 can include one or more features 3129 (e.g., ribs, tabs, bars, detents, or the like) to encourage proper orientation and inhibit unintentional removal of the mating connector. For example, the integrated connector 3120 can be shaped such that only a single orientation of the mating connector permits the mating connector to be received in the integrated connector 3120.

The illustrated integrated connector 3120 is a female connector and is configured to slidingly receive a male connector. However, various embodiments employ alternate configurations. For example, in certain cases, the integrated connector 3120 is a male connector and is configured to be press fit into a female connector.

In certain embodiments, the integrated connector 3120 includes one or more containment features 3130. As shown, the containment features 3130 can be open (e.g., not fully enclosed) along the axial direction. In other embodiments, containment features 3130 are substantially closed along the axial direction. The illustrated containment features 3130 comprise a channel 3132 that is intersected by a rectangular recess 3134. Of course, other configurations are contemplated, such as the channel portion 3132 and/or recess 3134 being circular, elliptical, triangular, other polygonal, or otherwise shaped. In various embodiments, the number of containment features 3130 corresponds with the number of conductors 3024.

With continued reference to FIG. 29, in some embodiments the grooves 3140 include stabilization features 3142. Such stabilization features 3142 can be configured to inhibit the conductors 3024 from moving out of the grooves 3140. For example, in the illustrated embodiment, the stabilization features 3142 comprise rounded elements that project into the grooves 3140. Indeed, in the illustrated embodiment each of the grooves 3140 includes at least two oppositely projecting stabilization features 3142. In such an arrangement, the conductors 3024 are slightly deflected (e.g., bent laterally) by the stabilization features 3142, thereby enhancing friction between the conductors 3024 and the stabilization features 3142 and inhibiting movement of the conductors 3024. Such a configuration can, for example, maintain the conductors 3024 steady during the process of coupling (e.g., soldering) the conductors 3024 with the PCB 3044.

Of course, other embodiments have differently configured stabilization features 3142. For example, in some cases, rather then being round, the stabilization features 3142 are pointed, rectangular, wedge-shaped, or otherwise. Certain arrangements have one, three, four, or more stabilization features 3142 in each of the grooves 3140. In some cases, the grooves 3140 are tapered in the axial direction such that pressing the conductors 3024 into the grooves 3140 encourages the conductors 3024 toward the narrower portion of the taper. In alternate embodiments, the stabilization features 3142 comprise springs, clips, hooks, detents, ratchets, cantilevered members, welds, or otherwise. In certain embodiments, the stabilization features 3142 include one or more bosses (typically formed as a part of the second side 3016) adjacent one or more of the grooves 3140. The bosses can be configured to be thermally or ultrasonically deformed at least partly over the conductors 3024, thereby staking the conductors 3024 in the grooves 3140.

In many aspects, the conductors 3024 are similar to the wires previously discussed. For example, both are configured to transmit electrical power to the PCB. In some embodiments, the conductors 3024 are different than the wires previously discussed in certain aspects. For example, in some arrangements, the conductors 3024 do not include a sheath of insulation (e.g., rubber or plastic). Such a configuration can, for example, reduce the axial space occupied by the conductors 3024, which in turn can reduce the axial thickness of the blower 3010.

Figure 30:
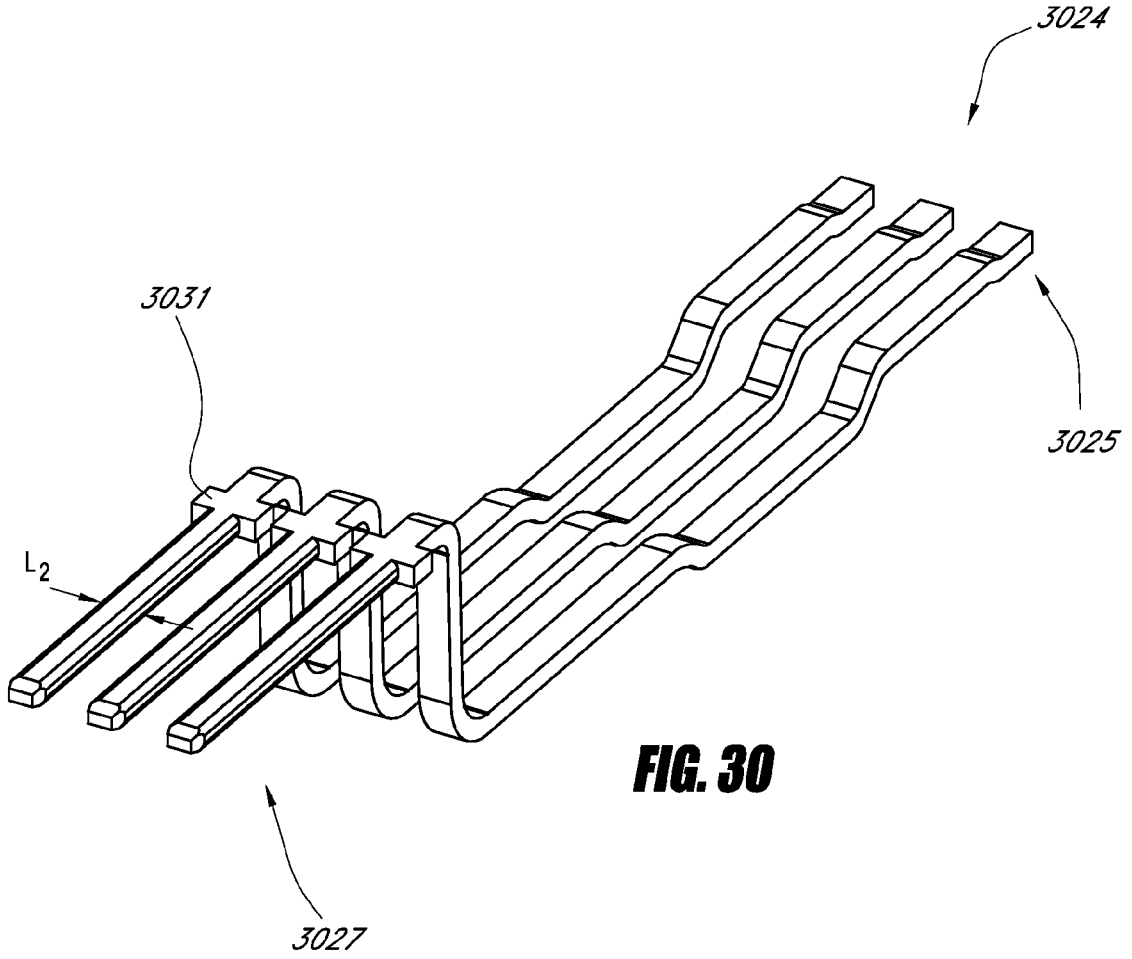
FIG. 30 illustrates a perspective view of the conductors of the blower of FIG. 28.

As illustrated in FIG. 30, the conductors 3024 can have a rectangular cross-sectional shape. However, other embodiments of the conductors 3024 have different cross-sectional shapes, such as circular, elliptical, triangular, other polygonal. In certain embodiments, the conductors 3024 are copper, copper alloy, brass, gold, aluminum, steel, or other readily electrically conductive material. In some instances, the conductors 3024 include a coating, such as tin, silver, or gold plate. Although the conductors 3024 can have most any size, in certain arrangements, the conductors have a thickness (e.g., along the axial direction) of about 0.6 mm, about 0.8 mm, about 1.0 mm, about 1.2 mm, about 1.4 mm, or otherwise. Generally, the conductors 3024 include various bends, angles, and curves so as to substantially mimic the shape of the bottom of the groove 3140. In certain embodiments, the conductors 3024 have a sinusoidal or undulating shape and the groove 3140 is correspondingly shaped.

In some embodiments, the second end 3027 of the conductors 3024 is configured to be identical or similar to other types of electrical connectors. For example, in some cases, the second end 3027 of the conductors 3024 is sized and shaped to correspond to a standard blower wiring terminal. Such standard terminals are typically crimped or otherwise coupled with the end of the previously discussed wires 24, which are then generally inserted into a connector housing. Thus, by integrating the connector housing with the housing 3012 and by configuring the second end 3027 of the conductors 3024 to be sized and shaped like the standard terminals, the mating connector may connect directly with the blower 3010. Such a configuration beneficially reduces the number of discrete components of the blower 3010. Furthermore, such a configuration can eliminate the steps of, for example, crimping the terminals onto the wires and positioning such terminals in a separate connector. Further, as the conductors 3024 are protected by the housing 3012, such a configuration can reduce or eliminate the need for a protective wire conduit or loom, as well as the step of routing the wires through such a member.

As previously discussed, the integrated connector 3120 is configured to mate with a mating connector. Generally, when the mating connector is joined with the integrated connector 3120, a radially inwardly directed force (e.g., toward the center of the blower 3010) is applied to the integrated connector 3120 as well as the conductors 3024. Accordingly, to maintain the position of the conductors 3024 in the integrated connector 3120, the conductors 3024 are configured to counteract above-described force. For example, the conductors 3024 can include tabs 3031 or other features that are configured to be received in the recesses 3134 of the containment features 3130. In such embodiments, interference in the radial direction between the tabs 3031 and the walls that define the recesses 3134 inhibit or prevent radial inward movement of the conductors 3024. In the illustrated embodiment, the tabs 3031 are generally rectangularly shaped projections on two sides of each of the conductors 3024. Other embodiments include differently configured tabs 3031, such being on only one side of the conductors 3024 and/or having an alternative shape, such as round, triangular, other polygonal, or otherwise.

Generally, bending or deformation of the conductors 3024 during mating with another connector is not desired as it could result in damage to conductors 3024 or an ineffective connection. Thus, in certain embodiments, the conductors 3024 are sized to reduce the likelihood of bending or deformation. For example, in some cases, the thickness L2 (FIG. 30) of the conductors 3024 is a function of the radial length L1 (FIG. 29) of the channel 3132. In some cases, L1 is greater than L2. In certain arrangements, the ratio of L1 to L2 is greater than about 1.5. In certain instances, the ratio of L1 to L2 is about 0.8 to about 2.5. In some cases, the ratio of L1 to L2 is about 1.0 to about 1.5. Such configurations can, for example, locate and/or orient the conductors 3024 to properly interface with a mating connector or terminal.

In some embodiments, the second end 3027 of the conductors 3024 is configured to reduce the likelihood of bending or deformation of the conductors 3024 during mating with another connector. For example, in certain such embodiments, the second end 3027 is rounded or chamfered. Such a configuration can, for example, facilitate the conductors 3024 being received into mating conductors of the other coupling, even if the alignment of the connectors is not wholly parallel. Thus, the chance of bending or deformation of the conductors 3024 can be reduced.

As noted above, in some embodiments, the first side 3114 includes first locking member 3152 (such as a clip) and the second side 3016 has corresponding second locking member 3154 (such as a hook). Typically, the first and second locking members 3052, 3054 are configured to matingly engage. In some such embodiments, the first and second locking members 3052, 3054 are located near or directly adjacent to the integrated connector 3120. Some embodiments include first and second locking members 3052, 3054 located near or directly adjacent to both walls 3122, 3124 of the integrated connector 3120. This configuration can, for example, reduce the likelihood of first and/or second sides 3014, 3016 warping or flexing with respect to each other, which could result in an axial gap between the first and second sides 3014, 3016. In certain instances, such an axial gap could allow the conductors 3024 to rattle, shift, or otherwise move within the integrated connector 3120, which could result in incorrect positioning (e.g., in the axial direction) of the conductors 3024, which in turn could lead to bending or damage to the conductors 3024 during mating with another connector.

Figure 31:
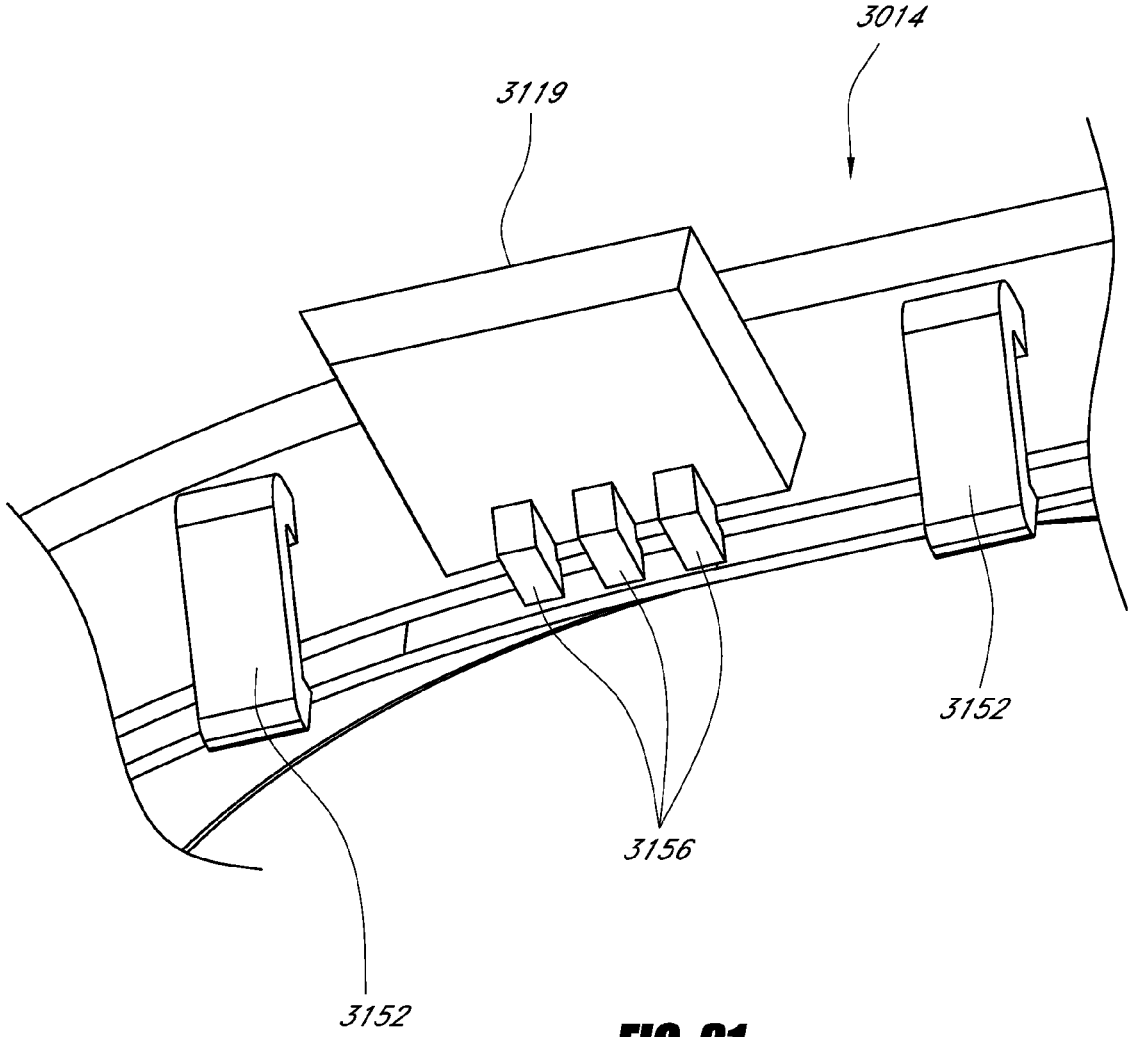
FIG. 31 illustrates a focused perspective view of a portion of the first side of the blower of FIG. 28.

In some embodiments, the conductors 3024 are further supported by one or more projection members 3156 that extend from the cover 3119, as shown in FIG. 31. As previously discussed, when the first and second sides 3014, 3016 are mated together, the cover 3119 can be received in the integrated connector 3120. In particular, the cover 3119 can be received in the opening 3128, thus substantially enclosing the conductors 3024. Furthermore, a portion of the projection members 3156 can be received in the channels 3132. Thus, in such embodiments, the conductors 3024 can be restrained in the axial direction by the bottom of the channels 3132 and the projection members 3156. Such an arrangement can, for example, reduce the chance of axial movement of the conductors 3024.

In some embodiments, the length of the projection members 3156 in the radial direction is about the same as the radial length L1 (FIG. 30) of the channel 3132. In certain embodiments, the ratio of the radial length of the projection members 3156 to the thickness L2 (FIG. 29) of the conductors 3024 is greater than about 1.5.

In certain arrangements, the first side 3014 and/or the projection members 3156 are configured to provide support for the conductors 3024 against the above-noted radially inwardly (e.g., toward the PCB) directed force that occurs when the integrated connector 3120 is mated with another connector. For example, the projection members 3156 can be configured such that when the first and second sides 3014, 3016 are joined, one or more of the projection members 3156 is partially or wholly disposed radially inward of the channels 3132. Furthermore, the part of the projection members 3156 that is located radially inward of the channels 3132 can be configured to extend axially beyond the channels 3132. In certain such embodiments, the part of the projection members 3156 that is radially inward of, and extends axially beyond, the channels 3132 can prevent radially inward movement of the conductors 3024 that are mounted in the channels 3132. Indeed, in some such instances, such support allows the second end 3027 of the conductors 3024 to be substantially uniform throughout their length. For example, in certain such cases, because the projection members 3156 are providing radial support for the conductors 3024, the conductors 3024 can be formed without tabs 3031 and the containment features 3130 can be formed without the corresponding recess 3134. Such a configuration can, for example, facilitate manufacturing and reduce costs.

In other embodiments, a portion of each of the conductors 3024 has been bent or formed into a generally "U" shaped configuration, which is configured to receive at least some of the sidewall of the second side 3016. In other words, the conductors 3024 can route axially up, radially over, and axially down the sidewall of the second side 3016. In certain embodiments, the conductors 3024 include further curves or bends, such that the second end 3027 projects radially outward within the integrated connector 3120, like in the previous embodiments discussed. In various such embodiments, the radial interference between the sidewall received in the "U" of the conductors 3024 can counteract the radially inwardly (e.g., toward the PCB) directed force that occurs when the integrated connector 3120 is mated with another connector. Thus, the position of the conductors 3024 within the integrated connector 3120 can be maintained and a proper electrical connection can be facilitated.

In certain embodiments, a method of manufacturing the blower 3010 includes forming or otherwise providing the housing 3012. Then, the PCB 3044 can be installed in the second side 3016 of the housing 3012. The conductors 3024 can be placed (e.g., by a press fit) into grooves 3140 in the second side 3016 and into the containment features 3130 of the integrated connector 3120. In some such embodiments, during the process of placing the conductors 3024, the conductors 3024 pass through the opening 3128 in the integrated connector 3120. In another embodiment, during the process of placing the conductors 3024, the conductors 3024 are rotated about an axis that is perpendicular to the axial of rotation of the impeller of the blower 3010. In some instances, the conductors 3024 are welded or staked (e.g., thermally or ultrasonically) with the second side 3016. In yet another alternate embodiment, the conductors 3024 are molded (e.g., insert molded) with the second side 3016. In certain arrangements, the conductors 3024 are coupled with the PCB 3044, such as by soldering. In some instances, other components are mated with the PCB 3044 as well, such as a motor. Also, the first and second sides 3014, 3016 can be joined, such as with one or more mating hooks and clips.

Example Noise Testing

Figure 32:
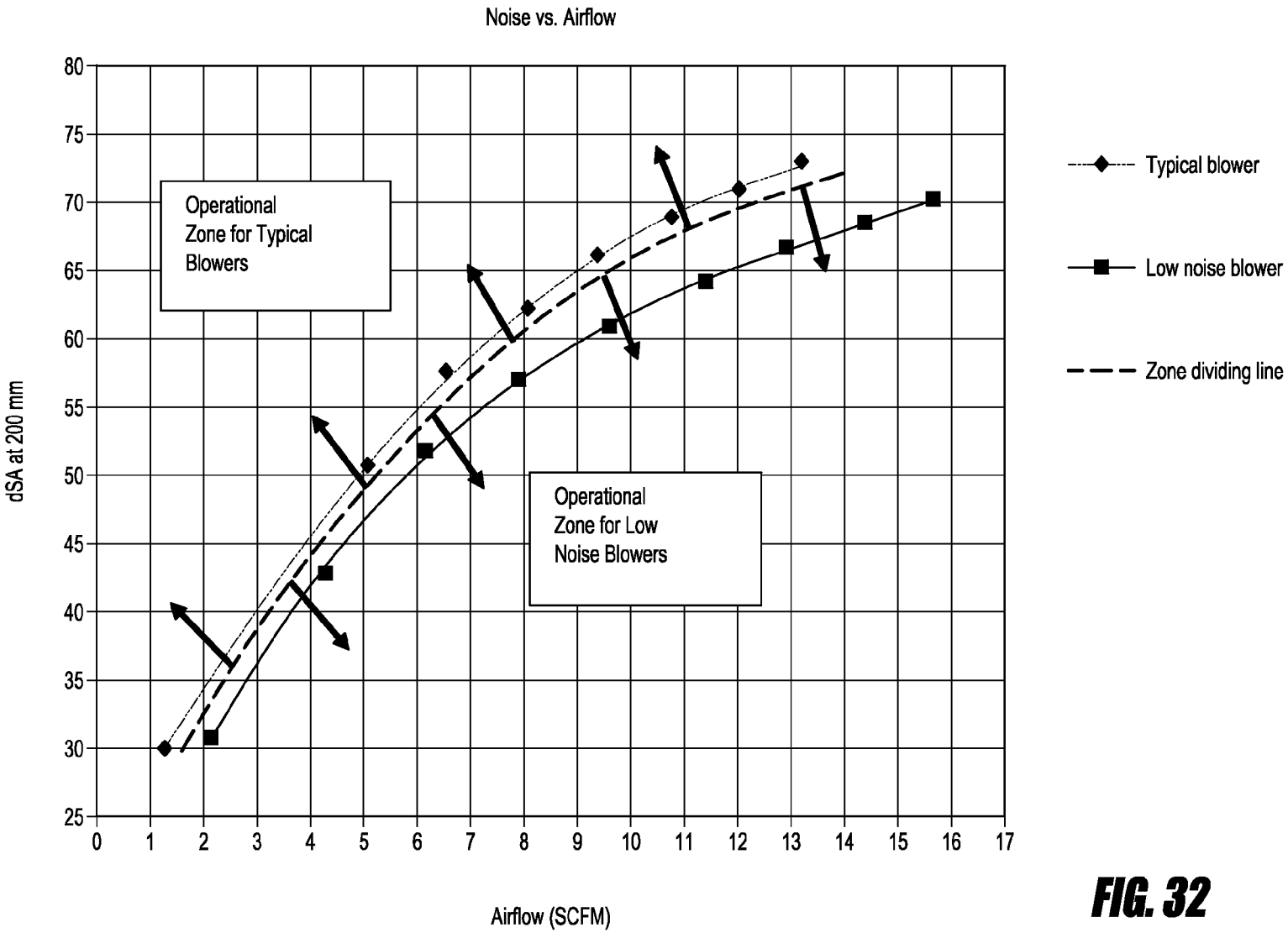
FIG. 32 illustrates a chart of noise as a function of airflow of an improved blower in accordance with some of the embodiments disclosed herein and a conventional prior art blower.

In various embodiments, the low-profile blower 10 provides enhanced airflow and/or reduced noise. For example, as illustrated in FIG. 32, when an improved blower in accordance with some of the embodiments disclosed herein and a conventional prior art blower are operating at the same airflow rate (e.g., in standard cubic feet per minute (SCFM)), the blower 10 generates less noise. Such a reduction in noise can be profoundly beneficial in the confined space of a vehicle or in instances in which the occupant's ears may be in close proximity to the cushion surface (e.g., beds). In the example of FIG. 32, the sound measuring device was positioned at about 200 mm from the inlet of each blower and generally collinearly with the axis of rotation each blower's impeller. Based on the results, it was found that, for an airflow rate of about 2-13 SCFM, the improved blower was at least about 7%-12% (e.g., 7%, 8%, 9%, 10%, 11%, 12%) quieter than the prior art blower.

Figure 33:
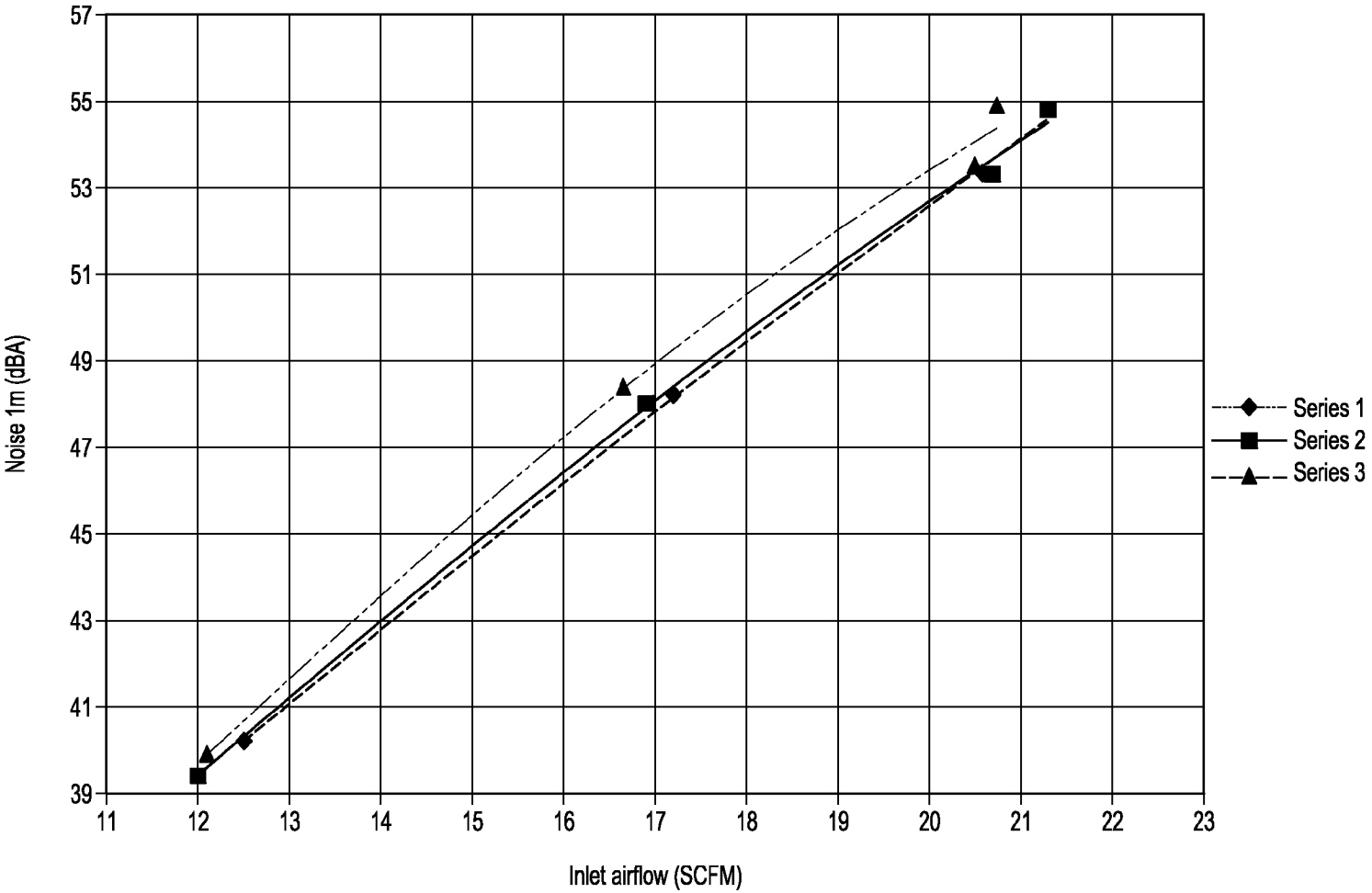
FIG. 33 illustrates a chart of noise as a function of airflow of three embodiments of a reduced noise blower.

With reference to FIG. 33, a chart plotting airflow (capacity) versus generated noise for three embodiments of the reduced noise blower 10 disclosed herein is illustrated. The blowers were operated at about ambient air pressure and the outlet 32 was not connected to any downstream conduits (e.g., the blowers were discharging to the environment). For the testing conducted, the blowers included a filter and a substantially identical filter was used on each of the blowers. The sound device was measured about 1 m from the inlet 26 and generally collinearly with the axis of rotation of the impeller 48. The tested embodiments of the blower 10, included impellers having an axial height of about 13 mm and a diameter of about 69 mm. Example data points from FIG. 33 are shown in Table A below:

TABLE A

| Blower 1 | | Blower 2 | | Blower 3 | |
|---|---|---|---|---|---|
| Airflow (SCFM) | Noise (dBA) | Airflow (SCFM) | Noise (dBA) | Airflow (SCFM) | Noise (dBA) |
| 12.5 | 40.2 | 12.0 | 39.4 | 12.1 | 39.9 |
| 17.2 | 48.2 | 16.9 | 48.0 | 16.7 | 48.4 |
| 20.6 | 53.3 | 20.7 | 53.3 | 20.5 | 53.5 |
| 21.3 | 54.7 | 21.3 | 54.8 | 20.8 | 54.9 |

As indicated in Table A, some embodiments of the blower 10, when discharging about 12 SCFM, produce no more than about 40-42 dBA (e.g., 40 dBA, 40.5 dBA, 41.0 dBA, 41.5 dBA, 42.0 dBA) of noise. Certain embodiments, when discharging about 17 SCFM, produce no more than about 48-49 dBA (e.g., 48.1 dBA, 48.3 dBA, 48.5 dBA, 48.7 dBA, 48.9 dBA) of noise. Some embodiments, when discharging about 20.5 SCFM, produce no more than about 53-54 dBA (e.g., 53.1 dBA, 53.3 dBA, 53.5 dBA, 53.7 dBA, 53.9 dBA) of noise. Certain embodiments, when discharging about 21 SCFM, produce no more than about 54-55 dBA (e.g., 54.1 dBA, 54.3 dBA, 54.5 dBA, 54.7 dBA, 54.9 dBA) of noise. Of course, these values are illustrative only and are not intended to be limiting. Indeed, other embodiments produce other amounts of noise. For example, certain embodiments, when discharging about 12 SCFM, can produce no more than about 42 dBA of noise. As another example, some embodiments, when discharging about 17 SCFM, can produce no more than about 19 dBA of noise. As a further example, certain embodiments, when discharging about 20.5 SCFM, can produce no more than about 55 dBA of noise. As still another example, some embodiments, when discharging about 21 SCFM, can produce no more than about 57 dBA of noise.

CONCLUSION

Although the low-profile blower has been disclosed in the context of certain preferred embodiments and examples, it will be understood by those skilled in the art that the low-profile blower extends beyond the specifically disclosed embodiments to other alternative embodiments and/or uses of the low-profile blower and obvious modifications and equivalents thereof. In addition, while a number of variations of the low-profile blower have been shown and described in detail, other modifications, which are within the scope of this disclosure, will be readily apparent to those of skill in the art based upon this disclosure. It is also contemplated that various combinations or subcombinations of the specific features and aspects of the embodiments may be made and still fall within the scope of the disclosure. For example, in one arrangement, the low-profile blower comprises an integrated filter and housing, snap-fit PCB, and sweeping impeller. According to another variant, the low-profile blower comprises an integrated filter and housing, a wire channel, and an exposed backplate. Accordingly, it should be understood that various features and aspects of the disclosed embodiments can be combined with, or substituted for, one another in order to perform varying modes of the disclosed inventions. Thus, it is intended that the scope of the low-profile blower herein disclosed should not be limited by the particular disclosed embodiments described above, but should be determined only by a fair reading of the claims.

What is claimed is:

1. A low-profile blower, comprising:

a housing defining an interior space, the housing including an inlet and an outlet;

wherein the housing has a first side and a second side joined by a sidewall;

an electric motor assembly disposed within the interior space, the motor assembly comprising a backplate, the backplate being coupled to the housing;

an impeller comprising a plurality of blades, the impeller being coupled with the motor assembly, the motor assembly configured to selectively rotate the impeller;

wherein the impeller is configured to draw a fluid into the interior space of the housing via the inlet and to discharge the fluid from the interior space via the outlet;

wherein the fluid proceeds through a portion of the interior space with a non-uniform velocity, the portion being in communication with the outlet;

a filter disposed at least partly in the inlet such that at least some of the fluid passes through the filter, wherein the filter comprises a mesh and is integrated with the housing, wherein some of the housing is located in voids in the filter;

a circuit board positioned in the interior space and below the impeller, the circuit board having an outer periphery and comprising a plurality of electronic components coupled to the circuit board;

wherein the blades are axially disposed generally above the circuit board by an axial distance, the blades disposed at least partly within the outer periphery by a radial distance;

at least one wire, the wire configured to supply electric power to the electric motor assembly;

wherein the least one wire extends from outside the housing into the interior space;

wherein at least one channel is formed in the housing, at least a portion of the channel being covered with a cover member; and wherein an exterior surface of the housing comprises a recess, the recess being configured to receive the cover member such that a surface of the cover member is generally flush with the exterior surface of the housing.

2. The blower of claim 1, wherein:

the at least one channel extending at least partly between the sidewall and the circuit board;

the at least one channel is configured to at least partly receive the at least one wire; and the at least one channel is configured to axially fully receive the wire.

3. The blower of claim 1, wherein the at least one wire does not axially protrude into the interior space beyond an inner surface of the housing.

4. The blower of claim 1, wherein at least one rib at least partly spans the inlet, the rib being configured to support the filter.

5. The blower of claim 1, further comprising a humidity sensor or a moisture sensor, the sensor positioned at or near the inlet.

6. The blower of claim 1, wherein the backplate of the motor assembly is connected with the housing via a snap fit, and the backplate forms a part of an exterior of the blower.

7. The blower of claim 6, wherein the housing further comprises an aperture configured to at least partly receive the backplate.

8. The blower of claim 1, wherein the backplate is coupled to the circuit board.

9. The blower of claim 8, wherein at least a portion of the backplate is open to the surrounding environment.

10. The blower of claim 9, wherein, during operation, the circuit board produces heat, at least a portion of the heat being dissipated to the surrounding environment via the backplate.

11. The blower of claim 1, further comprising a vane positioned in the portion, the vane configured to direct at least a portion of the fluid, thereby promoting a substantially uniform fluid velocity across the length of the outlet.

12. The blower of claim 11, wherein the vane comprises a plurality of pins.

* * * * *

UNITED STATES PATENT AND TRADEMARK OFFICE

CERTIFICATE OF CORRECTION

PATENT NO. : 9,121,414 B2
APPLICATION NO. : 13/289923
DATED : September 1, 2015
INVENTOR(S) : John Lofy It is certified that error appears in the above-identified patent and that said Letters Patent is hereby corrected as shown below:

In The Specification

In column 2 at line 7, Change “therethough,” to --therethrough,--.

In column 20 at line 65, Change “preciously” to --previously--.

In column 43 at line 45, Change “rather then” to --rather than--.

In The Claims

In column 48 at line 52, In Claim 1, change “the least” to --the at least--.

Signed and Sealed this
Ninth Day of August, 2016

Michelle K. Lee

Michelle K. Lee
*Director of the United States Patent and Trademark Office*